US009440455B2

(12) United States Patent
Sayama et al.

(10) Patent No.: US 9,440,455 B2
(45) Date of Patent: Sep. 13, 2016

(54) PRINTING DEVICE, CONTROL METHOD FOR PRINTING DEVICE, AND CONTROL PROGRAM FOR PRINTING DEVICE

(71) Applicant: SEIKO EPSON CORPORATION, Tokyo (JP)

(72) Inventors: Tomohiro Sayama, Nagano (JP); Toru Matsuyama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/635,065

(22) Filed: Mar. 2, 2015

(65) Prior Publication Data

US 2015/0251446 A1 Sep. 10, 2015

(30) Foreign Application Priority Data

Mar. 7, 2014 (JP) ..... 2014-044569

(51) Int. Cl.

| | |
|---|---|
| ***B41J 2/15*** | (2006.01) |
| ***B41J 3/407*** | (2006.01) |
| ***B41J 2/045*** | (2006.01) |
| ***B41J 11/48*** | (2006.01) |
| *B41J 2/165* | (2006.01) |

(52) U.S. Cl.

CPC ..... *B41J 3/4078* (2013.01); *B41J 2/04503* (2013.01); *B41J 2/04551* (2013.01); *B41J 2/04581* (2013.01); *B41J 2/04588* (2013.01); *B41J 2/04593* (2013.01); *B41J 2/04596* (2013.01); *B41J 11/485* (2013.01); *B41J 2/16508* (2013.01); *B41J 2/16523* (2013.01); *B41J 2/16538* (2013.01); *B41J 2/16579* (2013.01)

(58) Field of Classification Search

CPC B41J 3/4078; B41J 11/009; B41J 2029/395; B41J 2/04503; B41J 11/485

USPC ..... 347/5–10, 14–16, 40, 103, 105

See application file for complete search history.

(56) References Cited

U.S. PATENT DOCUMENTS

| | | | | |
|---|---|---|---|---|
| 5,396,275 | A * | 3/1995 | Koike et al. | 347/101 |
| 6,338,542 | B1 | 1/2002 | Fujimori | |
| 6,705,717 | B1 * | 3/2004 | Fujita et al. | 347/106 |
| 2009/0281219 | A1 * | 11/2009 | Watanabe et al. | 524/317 |
| 2010/0103207 | A1 * | 4/2010 | Kushner et al. | 347/5 |
| 2012/0044293 | A1 * | 2/2012 | Morohoshi et al. | 347/15 |
| 2013/0222465 | A1 * | 8/2013 | Akatani et al. | 347/20 |

FOREIGN PATENT DOCUMENTS

| | | | |
|---|---|---|---|
| JP | 2000-225717 | A | 8/2000 |
| JP | 4322968 | B2 | 9/2009 |

* cited by examiner

*Primary Examiner* — Lamson Nguyen
(74) *Attorney, Agent, or Firm* — Global IP Counselors, LLP

(57) ABSTRACT

A printing device includes a paper medium print mode configured to execute printing on a paper medium; and a textile print mode configured to execute printing on a fabric medium, a print resolution in the textile print mode being lower than a print resolution in the paper medium print mode.

10 Claims, 43 Drawing Sheets

TBL14

| Print Mode | | | | | Movement Setting Information | | | (Reference) |
|---|---|---|---|---|---|---|---|---|
| Medium Mode (m) | Medium Type Mode (p) | Image Quality Mode (q) | Print Direction Mode (r) | Dot Type Mode (d) | Moveout Position (dZ) | Maximum Dot Formation Inequality (W) | Number of Overlap (n) | Print Speed (U) |
| Photograph Paper | (All) | (All) | (All) | (All) | dZ-L | (Not Illustrated) | (Not Illustrated) | (Not Illustrated) |
| Plain Paper | (All) | Image Quality Priority | Bi-Direction Mode | 2 B-TS | dZ-L | 16 | 6 | 2.53 |
| | | | | 4 B-TS | dZ-L | 18 | 6 | 2.30 |
| | | | Single Direction | 2 B-TS | dZ-L | 16 | 6 | 2.11 |
| | | | | 4 B-TS | dZ-L → dZ-H | 18 | 6 | 1.92 |
| | | Speed Priority | Bi-Direction Mode | 2 B-TS | dZ-L | 20 | 4 | 9.93 |
| | | | | 4 B-TS | dZ-L | 23 | 4 | 9.19 |
| | | | Single Direction | 2 B-TS | dZ-L | 20 | 4 | 8..28 |
| | | | | 4 B-TS | dZ-L | 22 | 4 | 7.66 |
| Fabric | Natural Fiber | Image Quality Priority | Bi-Direction Mode | 2 B-TS | dZ-H | 8 | 32 | 0.36 |
| | | | | 4 B-TS | dZ-H → dZ-L | 10 | 32 | 0.43 |
| | | | Single Direction | 2 B-TS | dZ-H | 8 | 32 | 0.30 |
| | | | | 4 B-TS | dZ-H → dZ-L | 10 | 32 | 0.39 |
| | | Speed Priority | Bi-Direction Mode | 2 B-TS | dZ-H | 12 | 28 | 1.42 |
| | | | | 4 B-TS | dZ-H | 14 | 28 | 1.66 |
| | | | Single Direction | 2 B-TS | dZ-H | 12 | 28 | 1.18 |
| | | | | 4 B-TS | dZ-H | 14 | 28 | 1.39 |
| | Chemical Fiber | (All) | (All) | (All) | dZ-H | (Not Illustrated) | (Not Illustrated) | (Not Illustrated) |

| Print Mode | Mode Number | Mode Name |
|---|---|---|
| Medium Mode (m) | m=1 | Photograph Paper Mode |
| | m=2 | Plain Paper Mode |
| | m=3 | Fabric Mode |
| Image Quality Mode (g) | g=1 | Image Quality Priority Mode |
| | g=2 | Speed Priority Mode |
| Print Direction Mode (h) | h=1 | Bi-Direction Mode |
| | h=2 | Single Direction Mode |
| Dot Type Mode (d) | d=1 | 2 Bits Mode |
| | d=2 | 4 Bits Mode |
| Color Mode (c) | c=1 | Pure Black Mode |
| | c=2 | Basic Color Mode |
| | c=3 | Light And Shade Color Mode |
| | c=4 | Characteristic Color Mode |
| | c=5 | All Color Mode |

Fig. 10

TBL11

| Medium Type | Medium Mode (m) | |
|---|---|---|
| Photo Paper | Photograph Paper Mode | (m=1) |
| Luster Photo Paper | | |
| Mat Photo Paper | | |
| Coated Paper | | |
| Luster Photograph Paper | | |
| Silky Tone Luster Photograph Paper | | |
| Plain Paper | Plain Paper Mode | (m=2) |
| Recycled Paper | | |
| Fine Paper | | |
| Chemical Fiber | Fabric Mode | (m=3) |
| Natural Fiber | | |

Fig. 11

TBL12

| Usable Ink / Color Mode (c) | Basic Color | | | | Characteristic Color | | | Light Color | |
|---|---|---|---|---|---|---|---|---|---|
| | Black (Bk) | Cyan (Cy) | Magenta (Mg) | Yellow (Yl) | Green (Gr) | Violet (Vl) | Orange (Or) | Light Cyan (CyL) | Light Magenta (MgL) |
| Pure Black (c=1) | ○ | × | × | × | × | × | × | × | × |
| Basic Color (c=2) | ○ | ○ | ○ | ○ | × | × | × | × | × |
| Light And Shade Color (c=3) | ○ | ○ | ○ | ○ | × | × | × | ○ | ○ |
| Characteristic Color (c=4) | ○ | ○ | ○ | ○ | ○ | ○ | ○ | × | × |
| All Color (c=5) | ○ | ○ | ○ | ○ | ○ | ○ | ○ | ○ | ○ |

○: Used Ink
×: Non-Used Ink

Fig. 12

(*) Mode Number = (m,g,h,d,c)

| Medium Mode (m) | Image Quality Mode (g) | Print Direction Mode (h) | Dot Type Mode (d) | Color Mode (c) | | | | |
|---|---|---|---|---|---|---|---|---|
| | | | | Pure Black | Basic Color | Light And Shade Color | Characteristic Color | All Color |
| Photograph Paper | Image Quality Priority | Bi-Direction | 2 Bits | 11111 | 11112 | 11113 | 11114 | 11115 |
| | | | 4 Bits | 11121 | 11122 | 11123 | 11124 | 11125 |
| | | Single Direction | 2 Bits | 11211 | 11212 | 11213 | 11214 | 11215 |
| | | | 4 Bits | 11221 | 11222 | 11223 | 11224 | 11225 |
| | Speed Priority | Bi-Direction | 2 Bits | 12111 | 12112 | 12113 | 12114 | 12115 |
| | | | 4 Bits | 12121 | 12122 | 12123 | 12124 | 12125 |
| | | Single Direction | 2 Bits | 12211 | 12212 | 12213 | 12214 | 12215 |
| | | | 4 Bits | 12221 | 12222 | 12223 | 12224 | 12225 |
| Plain Paper | Image Quality Priority | Bi-Direction | 2 Bits | 21111 | 21112 | 21113 | 21114 | 21115 |
| | | | 4 Bits | 21121 | 21122 | 21123 | 21124 | 21125 |
| | | Single Direction | 2 Bits | 21211 | 21212 | 21213 | 21214 | 21215 |
| | | | 4 Bits | 21221 | 21222 | 21223 | 21224 | 21225 |
| | Speed Priority | Bi-Direction | 2 Bits | 22111 | 22112 | 22113 | 22114 | 22115 |
| | | | 4 Bits | 22121 | 22122 | 22123 | 22124 | 22125 |
| | | Single Direction | 2 Bits | 22211 | 22212 | 22213 | 22214 | 22215 |
| | | | 4 Bits | 22221 | 22222 | 22223 | 22224 | 22225 |
| Fabric | Image Quality Priority | Bi-Direction | 2 Bits | 31111 | 31112 | 31113 | 31114 | 31115 |
| | | | 4 Bits | 31121 | 31122 | 31123 | 31124 | 31125 |
| | | Single Direction | 2 Bits | 31211 | 31212 | 31213 | 31214 | 31215 |
| | | | 4 Bits | 31221 | 31222 | 31223 | 31224 | 31225 |
| | Speed Priority | Bi-Direction | 2 Bits | 32111 | 32112 | 32113 | 32114 | 32115 |
| | | | 4 Bits | 32121 | 32122 | 32123 | 32124 | 32125 |
| | | Single Direction | 2 Bits | 32211 | 32212 | 32213 | 32214 | 32215 |
| | | | 4 Bits | 32221 | 32222 | 32223 | 32224 | 32225 |

Fig. 13

TBL13

| Medium Mode (m) | Image Quality Mode (g) | Print Direction Mode (h) | Dot Type Mode (d) | Color Mode (c) | | | | |
|---|---|---|---|---|---|---|---|---|
| | | | | Pure Black | Basic Color | Light And Shade Color | Charact-eristic Color | All Color |
| Photograph Paper | Image Quality Priority | Bi-Direction | 2 Bits | × | ○ | ○ | ○ | ○ |
| | | | 4 Bits | × | ○ | ○ | ○ | ○ |
| | | Single Direction | 2 Bits | × | ○ | ○ | ○ | ○ |
| | | | 4 Bits | × | ○ | ○ | ○ | ◎ |
| | Speed Priority | Bi-Direction | 2 Bits | △ | ○ | ○ | ○ | ○ |
| | | | 4 Bits | △ | ○ | ○ | ○ | ○ |
| | | Single Direction | 2 Bits | △ | ○ | ○ | ○ | ○ |
| | | | 4 Bits | △ | ○ | ○ | ○ | ○ |
| Plain Paper | Image Quality Priority | Bi-Direction | 2 Bits | × | ○ | ○ | ○ | × |
| | | | 4 Bits | × | ○ | ○ | ○ | × |
| | | Single Direction | 2 Bits | × | ○ | ○ | ○ | × |
| | | | 4 Bits | × | ○ | ○ | ○ | × |
| | Speed Priority | Bi-Direction | 2 Bits | △ | ◎ | ○ | ○ | × |
| | | | 4 Bits | △ | ○ | ○ | ○ | × |
| | | Single Direction | 2 Bits | △ | ○ | ○ | ○ | × |
| | | | 4 Bits | △ | ○ | ○ | ○ | × |
| Fabric | Image Quality Priority | Bi-Direction | 2 Bits | × | × | × | × | × |
| | | | 4 Bits | × | × | × | × | × |
| | | Single Direction | 2 Bits | × | × | × | ○ | × |
| | | | 4 Bits | × | × | × | ◎ | × |
| | Speed Priority | Bi-Direction | 2 Bits | × | × | × | × | × |
| | | | 4 Bits | × | × | × | × | × |
| | | Single Direction | 2 Bits | × | × | × | ○ | × |
| | | | 4 Bits | × | × | × | ○ | × |

Fig. 14

| Type of Recording Medium | General Surface Roughness (Sa) (x10) | Surface Roughness * (Sa) (x10) | Surface Waving * (Wa) (x10) | |
|---|---|---|---|---|
| Plain Paper | 2.48 μm | 1.56 μm | 1.65 μm | Plain Paper |
| Recycled Paper | 2.75 μm | 1.41 μm | 1.97 μm | |
| Fine Paper | 3.86 μm | 1.96 μm | 2.78 μm | |
| Photo Paper | 0.09 μm | 0.03 μm | 0.05 μm | Photograph Paper |
| Luster Photo Paper | 0.19 μm | 0.09 μm | 0.14 μm | |
| Mat Photo Paper | 0.08 μm | 0.08 μm | 0.05 μm | |
| Coated Paper | 0.14 μm | 0.05 μm | 0.07 μm | |
| Luster Photograph Paper | 0.32 μm | 0.07 μm | 0.27 μm | |
| Silky Tone Photograph Paper | 0.65 μm | 0.07 μm | 0.48 μm | |
| Chemical Fiber | 1.37 μm | 1.04 μm | 1.65 μm | Fabric |
| Natural Fiber | 3.85 μm | 2.86 μm | 1.84 μm | |

Fig. 21

RELATION BETWEEN INK DUTY AND RECORD RATE OF EACH INK

| INK DUTY (%) | DOT RECORD RATE (%) | | | | | |
|---|---|---|---|---|---|---|
| | Bk | Cy | CyL | Mg | MgL | Yl |
| 40 | 20 | -- | -- | 5 | -- | 15 |
| 50 | 15 | 5 | -- | 10 | -- | 20 |
| 60 | 10 | 10 | -- | 15 | -- | 25 |
| 70 | 5 | 15 | -- | 20 | -- | 30 |
| 80 | -- | 20 | -- | 25 | -- | 35 |
| 100 | -- | 10 | 20 | 15 | 20 | 35 |

Fig. 23

TBL14

| Print Mode | | | Mode Number (mghdc) | Operation Set Information | | | | |
|---|---|---|---|---|---|---|---|---|
| Medium Mode (m) | Image Quality Mode (g) | Dot Type Mode (d) | | Maximum Dot Formation Ink Quantity (W) | Resolution (R) | Driving Frequency (F) | Number of Overlap (S) | Meniscus Position (dZ) |
| Photograph Paper | Image Quality Priority | 2 Bits | 11h1c | W1:32 | R1:1600*1600 | F1:56000 | S1:4 | dZ1:dZ-L |
| | | 4 Bits | 11h2c | W2:36 | R2:1400*1400 | F2:48000 | S2:4 | dZ2:dZ-L |
| | Speed Priority | 2 Bits | 12h1c | W3:24 | R3:1200*1200 | F3:72000 | S3:2 | dZ3:dZ-L |
| | | 4 Bits | 12h2c | W4:28 | R4:1000*1000 | F4:64000 | S4:2 | dZ4:dZ-L |
| Plain Paper | Image Quality Priority | 2 Bits | 21h1c | W5:16 | R5:1400*1400 | F5:48000 | S5:6 | dZ5:dZ-L |
| | | 4 Bits | 21h2c | W6:18 | R6:1200*1200 | F6:32000 | S6:6 | dZ6:dZ-L |
| | Speed Priority | 2 Bits | 22h1c | W7:20 | R7:1000*1000 | F7:64000 | S7:4 | dZ7:dZ-L |
| | | 4 Bits | 22h2c | W8:22 | R8:900*900 | F8:48000 | S8:4 | dZ8:dZ-L |
| Fabric | Image Quality Priority | 2 Bits | 31h1c | W9:8 | R9:800*800 | F9:12000 | S9:32 | dZ9:dZ-H |
| | | 4 Bits | 31h2c | W10:10 | R10:600*600 | F10:8000 | S10:32 | dZ10:dZ-H |
| | Speed Priority | 2 Bits | 32h1c | W11:12 | R11:500*500 | F11:16000 | S11:28 | dZ11:dZ-H |
| | | 4 Bits | 32h2c | W12:14 | R12:400*400 | F12:12000 | S12:28 | dZ12:dZ-H |

Fig. 24

TBL15

| Print Mode | | | | Print Speed (U) | Main Scanning Print Speed (UY) |
|---|---|---|---|---|---|
| Medium Mode (m) | Image Quality Mode (g) | Print Direction Mode (h) | Dot Type Mode (d) | | |
| Photograph Paper | Image Quality Priority | Bi-Direction | 2 Bits | 3.39 | 63 |
| | | | 4 Bits | 3.80 | 62 |
| | | Single Direction | 2 Bits | 2.83 | 53 |
| | | | 4 Bits | 3.17 | 52 |
| | Speed Priority | Bi-Direction | 2 Bits | 15.52 | 218 |
| | | | 4 Bits | 19.86 | 232 |
| | | Single Direction | 2 Bits | 12.93 | 181 |
| | | | 4 Bits | 16.55 | 193 |
| Plain Paper | Image Quality Priority | Bi-Direction | 2 Bits | 2.53 | 41 |
| | | | 4 Bits | 2.30 | 32 |
| | | Single Direction | 2 Bits | 2.11 | 35 |
| | | | 4 Bits | 1.92 | 27 |
| | Speed Priority | Bi-Direction | 2 Bits | 9.93 | 116 |
| | | | 4 Bits | 9.19 | 97 |
| | | Single Direction | 2 Bits | 8.28 | 97 |
| | | | 4 Bits | 7.66 | 81 |
| Fabric | Image Quality Priority | Bi-Direction | 2 Bits | 0.36 | 3.4 |
| | | | 4 Bits | 0.43 | 3.0 |
| | | Single Direction | 2 Bits | 0.30 | 2.8 |
| | | | 4 Bits | 0.36 | 2.5 |
| | Speed Priority | Bi-Direction | 2 Bits | 1.42 | 8.3 |
| | | | 4 Bits | 1.66 | 7.8 |
| | | Single Direction | 2 Bits | 1.18 | 6.9 |
| | | | 4 Bits | 1.39 | 6.5 |

Fig. 25

<DOT TYPE MODE: 4 BITS MODE>

| | SI (b1, b2) | Ts1 | | Ts2 | |
|---|---|---|---|---|---|
| | | Sa | Sb | Sa | Sb |
| LARGE DOT | (1, 1) | H | L | H | L |
| MIDDLE DOT | (1, 0) | H | L | L | H |
| SMALL DOT | (0, 1) | L | H | H | L |
| NON-RECORD | (0, 0) | L | H | L | H |

<DOT TYPE MODE: 2 BITS MODE>

| | Sl (b1) | Tu | |
|---|---|---|---|
| | | Sa | Sb |
| LARGE DOT | (1) | H | L |
| NON-RECORD | (0) | L | H |

Fig. 28

SCANNING PARAMETER

NOZZLE PITCH: k=3
NUMBER OF USED NOZZLE: Nuse=4
NUMBER OF OVERLAP: S=1
NUMBER OF EXECUTION Neff=4

| PASS NUMBER | 1 | 2 | 3 | 4 |
|---|---|---|---|---|
| FEED QUANTITY L | 0 | 4 | 4 | 4 |
| Lsum | 0 | 4 | 8 | 12 |
| Noff | 0 | 1 | 2 | 0 |

$Lsum = \Sigma L$ $Noff = Lsum\%k$

| PASS NUMBER | 1 | 2 | 3 | 4 | 5 | 6 | 7 |
|---|---|---|---|---|---|---|---|
| RECORD TARGET PIXEL | 0 | 1 | 0 | 1 | 0 | 1 | 0 |
| FEED QUANTITY L | 0 | 2 | 2 | 2 | 2 | 2 | 2 |
| Lsum | 0 | 2 | 4 | 6 | 8 | 10 | 12 |
| Noff | 0 | 2 | 1 | 0 | 2 | 1 | 0 |

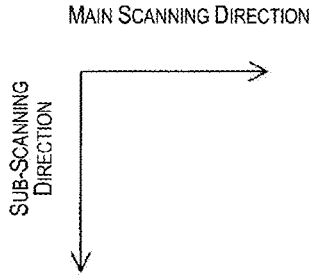

FIRST EXAMPLE OF DOT RECORDING SYSTEM (RELATION OF RASTER AND PASS)

NOZZLE PITCH: k=4
NUMBER OF USED NOZZLE: Nuse=12
NUMBER OF OVERLAP: S=4
SUB-SCANNING FEED AMOUNT L=3 (Dot)

PIXEL POSITION NUMBER

| RASTER NUMBER | 1 | 2 | 3 | 4 | 5 | 6 | 7 | 8 |
|---|---|---|---|---|---|---|---|---|
| 1 | 1 | 5 | 9 | 13 | 1 | 5 | 9 | 13 |
| 2 | 4 | 8 | 12 | 16 | 4 | 8 | 12 | 16 |
| 3 | 3 | 7 | 11 | 15 | 3 | 7 | 11 | 15 |
| 4 | 2 | 6 | 10 | 14 | 2 | 6 | 10 | 14 |
| 5 | 1 | 5 | 9 | 13 | 1 | 5 | 9 | 13 |
| 6 | 4 | 8 | 12 | 16 | 4 | 8 | 12 | 16 |
| 7 | 3 | 7 | 11 | 15 | 3 | 7 | 11 | 15 |
| 8 | 2 | 6 | 10 | 14 | 2 | 6 | 10 | 14 |

SECOND EXAMPLE (RELATION OF RASTER AND PASS)

NOZZLE PITCH: k=4
NUMBER OF USED NOZZLE: Nuse=12
NUMBER OF OVERLAP: S=4
SUB-SCANNING FEED AMOUNT L=3 (Dot)

PIXEL POSITION NUMBER

| RASTER NUMBER | 1 | 2 | 3 | 4 | 5 | 6 | 7 | 8 |
|---|---|---|---|---|---|---|---|---|
| 1 | 1 | 5 | 9 | 13 | 1 | 5 | 9 | 13 |
| 2 | 12 | 16 | 4 | 8 | 12 | 16 | 4 | 8 |
| 3 | 3 | 7 | 11 | 15 | 3 | 7 | 11 | 15 |
| 4 | 10 | 14 | 2 | 6 | 10 | 14 | 2 | 6 |
| 5 | 1 | 5 | 9 | 13 | 1 | 5 | 9 | 13 |
| 6 | 12 | 16 | 4 | 8 | 12 | 16 | 4 | 8 |
| 7 | 3 | 7 | 11 | 15 | 3 | 7 | 11 | 15 |
| 8 | 10 | 14 | 2 | 6 | 10 | 14 | 2 | 6 |

Fig. 36

MAIN SCANNING DIRECTION

SUB-SCANNING DIRECTION

SECOND EXAMPLE
(RELATION OF RASTER AND PASS)

NOZZLE PITCH: k=4
NUMBER OF USED NOZZLE: Nuse=12
NUMBER OF OVERLAP: S=4
SUB-SCANNING FEED AMOUNT L=3 (Dot)

PIXEL POSITION NUMBER

| RASTER NUMBER | 1 | 2 | 3 | 4 | 5 | 6 | 7 | 8 |
|---|---|---|---|---|---|---|---|---|
| 1 | 1 | 5 | 9 | 13 | 1 | 5 | 9 | 13 |
| 2 | 12 | 16 | 4 | 8 | 12 | 16 | 4 | 8 |
| 3 | 3 | 7 | 11 | 15 | 3 | 7 | 11 | 15 |
| 4 | 10 | 14 | 2 | 6 | 10 | 14 | 2 | 6 |
| 5 | 1 | 5 | 9 | 13 | 1 | 5 | 9 | 13 |
| 6 | 12 | 16 | 4 | 8 | 12 | 16 | 4 | 8 |
| 7 | 3 | 7 | 11 | 15 | 3 | 7 | 11 | 15 |
| 8 | 10 | 14 | 2 | 6 | 10 | 14 | 2 | 6 |

THIRD EXAMPLE
(RELATION OF RASTER AND PASS)

NOZZLE PITCH: k=4
NUMBER OF USED NOZZLE: Nuse=20
NUMBER OF OVERLAP: S=5
SUB-SCANNING FEED AMOUNT L=3 (Dot)

PIXEL POSITION NUMBER

| RASTER NUMBER | 1 | 2 | 3 | 4 | 5 | 6 | 7 | 8 | 9 | 10 |
|---|---|---|---|---|---|---|---|---|---|---|
| 1 | 1 | 17 | 13 | 9 | 5 | 1 | 17 | 13 | 9 | 5 |
| 2 | 12 | 8 | 4 | 20 | 16 | 12 | 8 | 4 | 20 | 16 |
| 3 | 19 | 15 | 11 | 7 | 3 | 19 | 15 | 11 | 7 | 3 |
| 4 | 10 | 6 | 2 | 18 | 14 | 10 | 6 | 2 | 18 | 14 |
| 5 | 1 | 17 | 13 | 9 | 5 | 1 | 17 | 13 | 9 | 5 |
| 6 | 12 | 8 | 4 | 20 | 16 | 12 | 8 | 4 | 20 | 16 |
| 7 | 19 | 15 | 11 | 7 | 3 | 19 | 15 | 11 | 7 | 3 |
| 8 | 10 | 6 | 2 | 18 | 14 | 10 | 6 | 2 | 18 | 14 |

Fig. 38

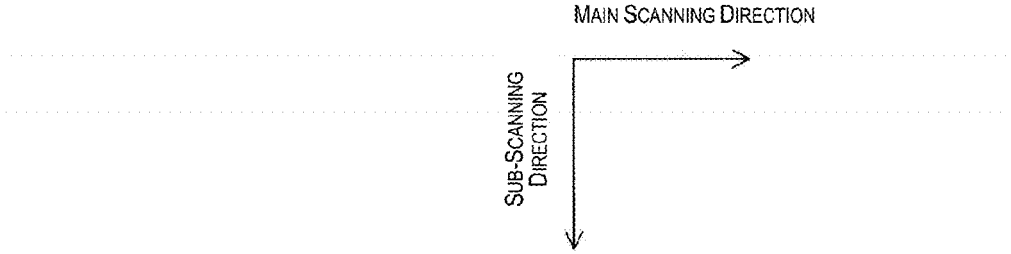

SECOND EXAMPLE
(RELATION OF RASTER AND PASS)

NOZZLE PITCH: k=4
NUMBER OF USED NOZZLE: Nuse=12
NUMBER OF OVERLAP: S=4
SUB-SCANNING FEED AMOUNT L=3 (Dot)

PIXEL POSITION NUMBER

| RASTER NUMBER | 1 | 2 | 3 | 4 | 5 | 6 | 7 | 8 |
|---|---|---|---|---|---|---|---|---|
| 1 | 1 | 5 | 9 | 13 | 1 | 5 | 9 | 13 |
| 2 | 12 | 16 | 4 | 8 | 12 | 16 | 4 | 8 |
| 3 | 3 | 7 | 11 | 15 | 3 | 7 | 11 | 15 |
| 4 | 10 | 14 | 2 | 6 | 10 | 14 | 2 | 6 |
| 5 | 1 | 5 | 9 | 13 | 1 | 5 | 9 | 13 |
| 6 | 12 | 16 | 4 | 8 | 12 | 16 | 4 | 8 |
| 7 | 3 | 7 | 11 | 15 | 3 | 7 | 11 | 15 |
| 8 | 10 | 14 | 2 | 6 | 10 | 14 | 2 | 6 |

FOURTH EXAMPLE
(RELATION OF RASTER AND PASS)

NOZZLE PITCH: k=4
NUMBER OF USED NOZZLE: Nuse=20
NUMBER OF OVERLAP: S=4
AVERAGE SUB-SCANNING FEED AMOUNT Lave=3 (Dot)
SUB-SCANNING FEED AMOUNT
- PASS 1-4, 8, 12-20: L=3 (Dot)
- PASS 5, 7, 9, 11: L=2 (Dot)
- PASS 6, 10: L=5 (Dot)

PIXEL POSITION NUMBER

| RASTER NUMBER | 1 | 2 | 3 | 4 | 5 | 6 | 7 | 8 |
|---|---|---|---|---|---|---|---|---|
| 1 | 1 | 6 | 10 | 13 | 1 | 6 | 10 | 13 |
| 2 | 12 | 16 | 4 | 8 | 12 | 16 | 4 | 8 |
| 3 | 3 | 7 | 11 | 15 | 3 | 7 | 11 | 15 |
| 4 | 9 | 14 | 2 | 5 | 9 | 14 | 2 | 5 |
| 5 | 1 | 6 | 10 | 13 | 1 | 6 | 10 | 13 |
| 6 | 12 | 16 | 4 | 8 | 12 | 16 | 4 | 8 |
| 7 | 3 | 7 | 11 | 15 | 3 | 7 | 11 | 15 |
| 8 | 9 | 14 | 2 | 5 | 9 | 14 | 2 | 5 |

Fig. 40

| Print Mode | Mode Number | Mode Name |
|---|---|---|
| Medium Mode (m) | m=1 | Photograph Paper Mode |
| | m=2 | Plain Paper Mode |
| | m=3 | Fabric Mode |
| Image Quality Mode (g) | g=1 | Image Quality Priority Mode |
| | g=2 | Speed Priority Mode |
| Print Direction Mode (h) | h=1 | Bi-Direction Mode |
| | h=2 | Single Direction Mode |
| Dot Type Mode (d) | d=1 | 2 Bits Mode |
| | d=2 | 4 Bits Mode |
| Color Mode (c) | c=1 | Pure Black Mode |
| | c=2 | Basic Color Mode |
| | c=3 | Light And Shade Color Mode |
| | c=4 | Characteristic Color Mode |
| | c=5 | All Color Mode |
| Medium Type Mode (p) | p=11 | Photo Paper |
| | p=12 | Luster Photo Paper |
| | p=13 | Mat Photo Paper |
| | p=14 | Coated Paper |
| | p=15 | Luster Photograph Paper |
| | p=16 | Silky Tone Luster Photograph Paper |
| | p=21 | Plain Paper |
| | p=22 | Recycled Paper |
| | p=23 | Fine Paper |
| | p=31 | Natural Fiber |
| | p=32 | Chemical fiber |

Fig. 41

TBL14

| Print Mode | | | | | Movement Setting Information | | | (Reference) |
|---|---|---|---|---|---|---|---|---|
| Medium Mode (m) | Medium Type Mode (p) | Image Quality Mode (g) | Print Direction m Mode (h) | Dot Type Mode (d) | Meniscus Position (dZ) | Maximum Dot Formation Ink Quantity (W) | Number of Overlap (S) | Print Speed (U) |
| Photograph Paper | (All) | (All) | (All) | (All) | dZ-L | (Not Illustrated) | (Not Illustrated) | (Not Illustrated) |
| Plain Paper | (All) | Image Quality Priority | Bi-Direction Mode | 2 Bits | dZ-L | 16 | 6 | 2.53 |
| | | | | 4 Bits | dZ-L | 18 | 6 | 2.30 |
| | | | Single Direction | 2 Bits | dZ-L | 16 | 6 | 2.11 |
| | | | | 4 Bits | dZ-L → dZ-H | 18 | 6 | 1.92 |
| | | Speed Priority | Bi-Direction Mode | 2 Bits | dZ-L | 20 | 4 | 9.93 |
| | | | | 4 Bits | dZ-L | 22 | 4 | 9.19 |
| | | | Single Direction | 2 Bits | dZ-L | 20 | 4 | 8..28 |
| | | | | 4 Bits | dZ-L | 22 | 4 | 7.66 |
| Fabric | Natural Fiber | Image Quality Priority | Bi-Direction Mode | 2 Bits | dZ-H | 8 | 32 | 0.36 |
| | | | | 4 Bits | dZ-H → dZ-L | 10 | 32 | 0.43 |
| | | | Single Direction | 2 Bits | dZ-H | 8 | 32 | 0.30 |
| | | | | 4 Bits | dZ-H → dZ-L | 10 | 32 | 0.36 |
| | | Speed Priority | Bi-Direction Mode | 2 Bits | dZ-H | 12 | 28 | 1.42 |
| | | | | 4 Bits | dZ-H | 14 | 28 | 1.66 |
| | | | Single Direction | 2 Bits | dZ-H | 12 | 28 | 1.18 |
| | | | | 4 Bits | dZ-H | 14 | 28 | 1.39 |
| | Chemical Fiber | (All) | (All) | (All) | dZ-H | (Not Illustrated) | (Not Illustrated) | (Not Illustrated) |

Fig. 42

TBL13

| Medium Mode (m) | Image Quality Mode (g) | Print Direction Mode (h) | Dot Type Mode (d) | Color Mode (c) | | | | |
|---|---|---|---|---|---|---|---|---|
| | | | | Pure Black | Basic Color | Light And Shade Color | Charact-eristic Color | All Color |
| Photograph Paper | Image Quality Priority | Bi-Direction | 2 Bits | × | ○ | ○ | ○ | ○ |
| | | | 4 Bits | × | ○ | ○ | ○ | ○ |
| | | Single Direction | 2 Bits | × | ○ | ○ | ○ | ○ |
| | | | 4 Bits | × | ○ | ○ | ○ | ◎ |
| | Speed Priority | Bi-Direction | 2 Bits | △ | ○ | ○ | ○ | ○ |
| | | | 4 Bits | △ | ○ | ○ | ○ | ◎ |
| | | Single Direction | 2 Bits | △ | ○ | ○ | ○ | ○ |
| | | | 4 Bits | △ | ○ | ○ | ○ | ○ |
| Plain Paper | Image Quality Priority | Bi-Direction | 2 Bits | × | ○ | ○ | ○ | × |
| | | | 4 Bits | × | ○ | ○ | ○ | × |
| | | Single Direction | 2 Bits | × | ○ | ○ | ○ | × |
| | | | 4 Bits | × | ◎ | ○ | ○ | × |
| | Speed Priority | Bi-Direction | 2 Bits | △ | ◎ | ○ | ○ | × |
| | | | 4 Bits | △ | ○ | ○ | ○ | × |
| | | Single Direction | 2 Bits | △ | ○ | ○ | ○ | × |
| | | | 4 Bits | △ | ○ | ○ | ○ | × |
| Fabric | Image Quality Priority | Bi-Direction | 2 Bits | × | × | × | × | × |
| | | | 4 Bits | × | × | × | × | × |
| | | Single Direction | 2 Bits | × | ○ | × | ○ | × |
| | | | 4 Bits | × | ○ | × | ◎ | × |
| | Speed Priority | Bi-Direction | 2 Bits | × | × | × | × | × |
| | | | 4 Bits | × | × | × | × | × |
| | | Single Direction | 2 Bits | △ | ○ | × | ○ | × |
| | | | 4 Bits | △ | ○ | × | ◎ | × |

Fig. 43

TBL13

| Medium Mode (m) | Image Quality Mode (g) | Print Direction Mode (h) | Dot Type Mode (d) | Color Mode (c) | | |
|---|---|---|---|---|---|---|
| | | | | Basic Color | Light And Shade Color | Characteristic Color |
| Photograph Paper | Image Quality Priority | Bi-Direction | 2 Bits | ○ | ○ | × |
| | | | 4 Bits | ○ | ○ | × |
| | | Single Direction | 2 Bits | ○ | ○ | × |
| | | | 4 Bits | ○ | ◎ | × |
| | Speed Priority | Bi-Direction | 2 Bits | ○ | ○ | × |
| | | | 4 Bits | ○ | ○ | × |
| | | Single Direction | 2 Bits | ○ | ○ | × |
| | | | 4 Bits | ○ | ○ | × |
| Plain Paper | Image Quality Priority | Bi-Direction | 2 Bits | ○ | ○ | × |
| | | | 4 Bits | ○ | ○ | × |
| | | Single Direction | 2 Bits | ○ | ○ | × |
| | | | 4 Bits | ○ | ○ | × |
| | Speed Priority | Bi-Direction | 2 Bits | ◎ | ○ | × |
| | | | 4 Bits | ○ | ○ | × |
| | | Single Direction | 2 Bits | ○ | ○ | × |
| | | | 4 Bits | ○ | ○ | × |
| Fabric | Image Quality Priority | Bi-Direction | 2 Bits | × | × | × |
| | | | 4 Bits | × | × | × |
| | | Single Direction | 2 Bits | × | × | ○ |
| | | | 4 Bits | × | × | ◎ |
| | Speed Priority | Bi-Direction | 2 Bits | × | × | × |
| | | | 4 Bits | × | × | × |
| | | Single Direction | 2 Bits | × | × | ○ |
| | | | 4 Bits | × | × | ○ |

Fig. 44

PRINTING DEVICE, CONTROL METHOD FOR PRINTING DEVICE, AND CONTROL PROGRAM FOR PRINTING DEVICE

CROSS-REFERENCE TO RELATED APPLICATIONS

This application claims priority to Japanese Patent Application No. 2014-044569 filed on Mar. 7, 2014. The entire disclosure of Japanese Patent Application No. 2014-044569 is hereby incorporated herein by reference.

BACKGROUND

1. Technical Field

The present invention relates to a printing device, a control method for a printing device, and a control program for a printing device.

2. Related Art

As a printing device, an inkjet printer for forming an image on a paper medium by ejecting ink onto a paper medium from each of a plurality of nozzles arranged at a head section (hereinafter referred to as "inkjet printer for paper medium printing") has been widely used (see Japanese Unexamined Patent Application Publication No. 2000-225717 (Patent Document 1), for example).

Further, with the recent years' development of an inkjet printer, an inkjet printer for textile printing is being developed, in which an inkjet printer conventionally used for printing on a paper medium is applied to printing on a fabric medium, such as, silk, cotton, nylon, etc., (hereinafter may also referred to as "fabric") (see Japanese Patent Publication No. 4322968 (Patent Document 2), for example).

SUMMARY

Conventionally, an inkjet printer for paper medium printing and an inkjet printer for textile printing have been separately developed. Therefore, for a user performing both printing to a paper medium and printing to a fabric, it is required to use an inkjet printer for paper medium printing and an inkjet printer for textile printing on difference occasions, which resulted in an increased cost for purchasing or maintaining printing devices and deteriorated convenience. Under the circumstances, there was a need for commonalizing an inkjet printer for paper medium printing and an inkjet printer for textile printing.

A paper medium which is a printing target of an inkjet printer for paper medium printing is a medium developed to enable visualization of characters and/or images by making a solid substance, such as, tonner, gel, etc., as well as liquid, such as, ink, black writing fluid, etc., adhere to, fix to, or permeate in a paper medium. For this reason, in many cases, in a paper medium, an ink absorbing layer for absorbing ink constituted so as to include synthetic silica, etc., is specially provided. Further, even in cases where no ink absorbing layer is provided in a paper medium, a base paper layer made of cellulose fibers, etc., as a main structural element of a paper medium can play a role of absorbing ink, so that a base paper layer can substitute for an ink absorbing layer.

As mentioned above, a paper medium is provided with an ink absorbing layer specially provided to absorb ink or a base paper layer playing a role for absorbing ink in place of the ink absorbing layer, and therefore excellent printing image quality can be secured.

On the other hand, a fabric which is a printing target of an inkjet printer for textile printing is developed and manufactured on the premise of being processed into clothes, and is given weight to wear comfort, feeling, etc., as clothes. Normally, such a fabric is not provided with an ink absorbing layer for absorbing ink. So, in printing on a fabric, fabric fibers which are not supposed to absorb ink play a role of absorbing ink in place of an ink absorbing layer.

For this reason, in printing on a fabric, for example, there often arise the following problems.

In performing printing on natural fibers, such as silk, cotton, wool, etc., which easily absorb ink among fabrics, in some cases, ink deeply permeates near to the rear side of the fabric, and therefore the color materials contained in the ink cannot be held at the vicinity of the surface of the fabric. In this case, a problem that an image having clear colors excellent in color reproducibility cannot be formed arises.

Further, in performing printing on a chemical fiber, such as, nylon, acrylic, etc., which hardly absorbs ink among fabrics, since ink stays on the surface of the fabric for a long period of time, a problem that ink drops held on the surface of the fabric join together to be condensed occurs.

Further, when ink lands on the fabric, the ink diffuses along the fibers of the fabric. However, since fibers of the fabric are not provided in a manner as to consider printing (e.g., in a manner such that ink diffuses evenly), when color materials of the ink diffuse in fiber extending directions, an ink blurring problem occurs.

In order to cope with various problems occurring when performing printing on a fabric as mentioned above, in a conventional inkjet printer for textile printing, various processing special for printing on a fabric were executed when printing on a fabric.

Concretely, in a conventional inkjet printer for textile printing, various processing not supposed in an inkjet printer for paper medium printing were executed. For example, a blurring preventive inhibitor for preventing occurrence of ink blurring was applied to a fabric as a preprocessing to be executed before ejecting ink onto the fabric, or a fabric was heated to stably fix the landed ink to the fabric as a post-processing to be executed after ejecting ink onto the fabric. Further, aside from a paper medium, an ink has been developed in accordance with the characteristic of a fiber, and printing using the ink dedicated for each fabric was performed.

Therefore, in order to commonalize such an inkjet printer for textile printing and an inkjet printer for paper medium printing, firstly, it is considered to give a structure for executing various special processing to a fabric, e.g., applying a blurring preventive inhibitor, when printing on a fabric to an inkjet printer for paper medium printing. In this case, however, the production cost of the inkjet printer increases, which in turn reduces the merits capable of reducing the printing cost by executing both the printing on a paper medium and the printing on a fabric with the common inkjet printer. As to the point that the merit of cost reduction reduces, the point can also be applied to the case in which printing is performed using a dedicated ink for each fabric.

Further, secondly, it can be considered to accept the aforementioned various problems occurring when printing on a fabric, such as, ink condensation, ink blurring, etc., and allow large deterioration of the image quality in printing on a fabric. However, printing on a fabric is often performed for the purpose of improving the design of clothes, etc., and therefore the image quality is often considered to be important. Therefore, such large deterioration of the image quality in printing on a fabric forfeits the general meaning of commonalization of the inkjet printer for paper medium printing and the inkjet printer for textile printing to secure excellent image quality in both the printing on a paper medium and the printing on a fabric.

The present invention was made in view of the aforementioned circumstances, and one of the objects is to provide a printing device, such as an inkjet printer, etc., capable of coping with at least one of the aforementioned problems occurring when printing on a fabric and also capable of printing on both a fabric and a paper medium with excellent image quality.

In order to solve the aforementioned problems, a printing device according to the present invention includes a paper medium print mode configured to execute printing on a paper medium, and a textile print mode configured to execute printing on a fabric medium, wherein a print resolution in the textile print mode is lower than a print resolution in the paper medium print mode.

In the present invention, since the print resolution when printing on a fabric medium is set to be lower than a print resolution when printing on a paper medium, it becomes possible to increase a distance between a dot corresponding to one pixel of an image to be printed on a fabric medium and a dot corresponding to another pixel adjacent to the one pixel as compared with the case in which printing is performed on a paper medium. For this reason, in printing on a fabric medium, it is possible to prevent an occurrence of events which may lead to image quality deterioration, such as, e.g., blurring of ink caused by mixing of inks of adjacent dots due to wide diffusion of ink, condensation occurred by joining of ink drops of the adjacent dots, etc. As a result, it is possible to prevent the image quality of an image to be printed on a fabric from being largely deteriorated as compared with the image quality of an image to be printed on a paper medium, which enables printing of an image having an excellent image quality on both a fabric and a paper medium.

Further, in the aforementioned printing device, it is preferable that a print resolution in a main scanning direction in the textile print mode is lower than a print resolution in the main scanning direction in the paper medium print mode.

According to this embodiment, it is possible to increase the distance between a dot corresponding to one pixel of an image to be printed on a fabric medium and a dot corresponding to another pixel adjacent to the one pixel in the main scanning direction as compared with the case of printing on a paper medium. For this reason, in printing on a fabric medium, it is possible to prevent an occurrence of blurring of ink caused by mixing of inks of adjacent dots adjacent in the main scanning direction, condensation occurred by joining of ink drops of the adjacent dots adjacent in the main scanning direction, etc.

Further, in the aforementioned printing device, it is preferable that a print resolution in a sub-scanning direction in the textile print mode is lower than a print resolution in the sub-scanning direction in the paper medium print mode.

According to this embodiment, it is possible to increase the distance between a dot corresponding to one pixel of an image to be printed on a fabric medium and a dot corresponding to another pixel adjacent to the one pixel in the sub-scanning direction as compared with the case of printing on a paper medium. For this reason, in printing on a fabric medium, it is possible to prevent an occurrence of blurring of ink caused by mixing of inks of adjacent dots adjacent in the sub-scanning direction, condensation occurred by joining of ink drops of adjacent dots adjacent in the sub-scanning direction, etc., in printing on a fabric medium.

Further, in the printing device, it is preferable that an ink weight required for forming a maximum dot in the textile print mode is smaller than an ink weight required for forming a maximum dot in the paper medium print mode.

According to this embodiment, since the ink weight for forming a maximum dot on a fabric medium is reduced than the ink weight for forming a maximum dot on a paper medium, as compared with the case of equalizing to the ink weight for forming a maximum dot on a paper medium, it becomes possible to increase the drying speed of the ink drop adhered to the fabric medium and narrow the range in which the ink is diffused inside the medium, etc. According to this embodiment, it is possible to increase the distance between a dot corresponding to one pixel of an image to be printed on a fabric medium and a dot corresponding to another pixel adjacent to the one pixel as compared with the case of printing on a paper medium. For this reason, in printing on a fabric medium, it is possible to prevent an occurrence of condensation occurred by joining of ink drops, blurring of ink caused by mixing of diffused inks, etc., in printing on a fabric medium.

Further, in the printing device, it is preferable that a print speed in the textile print mode is slower than a print speed in the paper medium print mode.

According to the present invention, since the print speed when printing on a fabric medium is set to be slower than a print speed when printing on a paper medium, it becomes possible to set a period of time from when a dot corresponding to one pixel of an image to be printed on a fabric medium is formed until when a dot corresponding to another pixel adjacent to the one pixel is formed to be longer than in a case of printing on a paper medium. For this reason, in printing on a fabric medium, it is possible to prevent an occurrence of events which may lead to image quality deterioration, such as, e.g., blurring of ink caused by mixing of inks of adjacent dots due to wide diffusion of ink, condensation occurred by joining of ink drops of the adjacent dots, etc.

Further, in the aforementioned printing device, it is preferable that types of ink used in the textile print mode are greater in number than types of ink used in the paper medium print mode.

Generally, in cases where printing is executed on a fabric medium using plural types of inks, as compared with the case in which printing is executed on a paper medium using the plural types of inks, it is hard to reproduce an ink color different from the plural types of ink colors.

Further, in cases where for the purpose of reproducing a certain color, both of the one ink capable of expressing a certain color and another ink which is ink capable of expressing the certain color in which the weight ratio of the solvent contained in the one ink is increased (i.e., a light color ink corresponding to the one ink) are used, as compared with the case in which the another ink (light color ink) is not used, the ink duty increases, which increases the ink amount to be ejected per unit area. For this reason, in printing on a fabric medium which is smaller in absorbable ink amount as compared with a paper medium, it is generally preferable to prevent the use of a light color ink.

Further, in cases where a light color ink is used, since plural types of inks, which largely differ in weight ratio of the solvent contained in ink, are used, the drying conditions and the fixing conditions differ every ink type. Therefore, if any processing before and/or after the print processing (a post-processing such as heating of a fabric medium, or a preceding processing such as application of a blue preventive inhibitor) are executed, the needs for adjusting the drying conditions and the fixing conditions arise every ink type, resulting in troublesome control of the printing device.

Also from such point of view, when printing on a fabric medium, it is preferable to restrain the use of a light color ink.

However, in cases where a light color ink is not used, in some cases, the number of representative gradation decreases, which makes it difficult to print an image with excellent image quality.

According to this embodiment, in printing on a fabric medium, more number of types of ink are used than in printing on a paper medium. For this reason, in printing on a fabric medium, it becomes possible to increase reproducible gradations as well as to widen the color region (gamut) reproducible on a color space without using a light color ink. With this case, also in printing on a fabric medium, in the same manner as in the case of printing on a paper medium, an image having excellent image quality can be printed.

Further, in the aforementioned printing device, it is preferable that a weight ratio of a solvent included in an ink not used in the textile print mode but used in the paper medium print mode to a whole ink is larger than a weight ratio of a solvent included in an ink used in the textile print mode and the paper medium print mode to a whole ink.

According to this embodiment, in printing on a fabric medium, since the use of the so-called light color ink which is large in weight ratio of the solvent is restricted, it is possible to prevent occurrence of blurring, ink condensation, etc., which highly occurs when using a light color ink.

Further, in the aforementioned printing device, it is preferable that a distance between a meniscus position of a nozzle ejecting ink in the textile print mode and the fabric medium is longer than a distance between a meniscus position of a nozzle ejecting ink in the paper medium print mode and the paper medium.

According to this embodiment, the meniscus position in printing on a fabric medium having a rough surface is arranged so as to increase a distance from a medium as compared with a meniscus position in printing on a paper medium having a smooth surface, and therefore it is possible to prevent occurrence of contamination of the fabric medium due to the contact of the fiber of the fabric medium to the ink in the nozzle.

Further, a control method for a printing device according to the present invention includes a paper medium print mode configured to execute printing on a paper medium, and a textile print mode configured to execute printing on a fabric medium, wherein a print resolution in the textile print mode is lower than a print resolution in the paper medium print mode.

In the present invention, since the print resolution when printing on a fabric medium is set to be lower than a print resolution when printing on a paper medium, it becomes possible to increase a distance between a dot corresponding to one pixel of an image to be printed on a fabric medium and a dot corresponding to another pixel adjacent to the one pixel as compared with the case in which printing is performed on a paper medium. For this reason, in printing on a fabric medium, it is possible to prevent an occurrence of events which may lead to image quality deterioration, such as, e.g., blurring of ink caused by mixing of inks of adjacent dots due to wide diffusion of ink, condensation occurred by joining of ink drops of the adjacent dots, etc.

Further, a control program for a printing device equipped with a computer according to the present invention includes a paper medium print mode configured to execute printing on a paper medium, and a textile print mode configured to execute printing on a fabric medium, wherein the control program causes the computer to execute printing in which a print resolution in the textile print mode is lower than a print resolution in the paper medium print mode.

In the present invention, since the print resolution when printing on a fabric medium is set to be lower than a print resolution when printing on a paper medium, it becomes possible to increase a distance between a dot corresponding to one pixel of an image to be printed on a fabric medium and a dot corresponding to another pixel adjacent to the one pixel as compared with the case in which printing is performed on a paper medium. For this reason, in printing on a fabric medium, it is possible to prevent an occurrence of events which may lead to image quality deterioration, such as, e.g., blurring of ink caused by mixing of inks of adjacent dots due to wide diffusion of ink, condensation occurred by joining of ink drops of the adjacent dots, etc.

BRIEF DESCRIPTION OF THE DRAWINGS

Referring now to the attached drawings which form a part of this original disclosure:

FIG. 10 is an explanatory view showing each of set contents of five types of setting modes constituting a print mode.

FIG. 11 is an explanatory view showing one example of a data structure of a medium type table TBL11.

FIG. 12 is an explanatory view showing one example of a data structure of a color mode table TBL12.

FIG. 13 is an explanatory view for explaining a mode number.

FIG. 14 is an explanatory view showing one example of a data structure of a mode evaluation table TBL13.

FIG. 21 is an explanatory view for explaining surface quality of a recording medium.

FIG. 23 is an explanatory view for explaining a relation between an ink duty and a dot record rate.

FIG. 24 is an explanatory view showing one example of a data structure of an operation set information table TBL14.

FIG. 25 is an explanatory view showing one example of a data structure of a print performance table TBL15.

FIG. 28 is an explanatory view showing a decode contents of the decoder DC.

FIG. 36 is an explanatory view showing pixels recorded by dots in each pass in the first example and the second example of the dot recording system.

FIG. 38 is an explanatory view showing pixels recorded by dots in each pass in the second example and the third example of the dot recording system.

FIG. 40 is an explanatory view showing pixels recorded by dots in each pass in the second example and the fourth example of the dot recording system.

FIG. 41 is an explanatory view showing each of set contents of six types of setting modes constituting a print mode according to the second embodiment of the present invention.

FIG. 42 is an explanatory view showing one example of a data structure of an operation set information table TBL14A according to the second embodiment.

FIG. 43 is an explanatory view showing one example of a data structure of a mode evaluation table TBL13 according to a modified Embodiment 2 of the present invention.

FIG. 44 is an explanatory view showing one example of a data structure of a mode evaluation table TBL13 according to a modified Embodiment 4 of the present invention.

DETAILED DESCRIPTION OF EMBODIMENTS

Hereinafter, embodiments for carrying out the present invention will be explained with reference to the drawings. However, in each of the drawings, the measurements and the reduced scales of each section are arbitrarily differed from the actual object. Also, the following embodiments are suitable concrete examples of the present invention, so there are various technically preferable limitations, but the scope of the present invention is not limited to the following embodiments unless there is a description in the following explanation especially limiting the present invention.

A. First Embodiment

Hereinafter, a printing device according to this embodiment will be explained.

1. Structure of Printing Device

Figure 1:
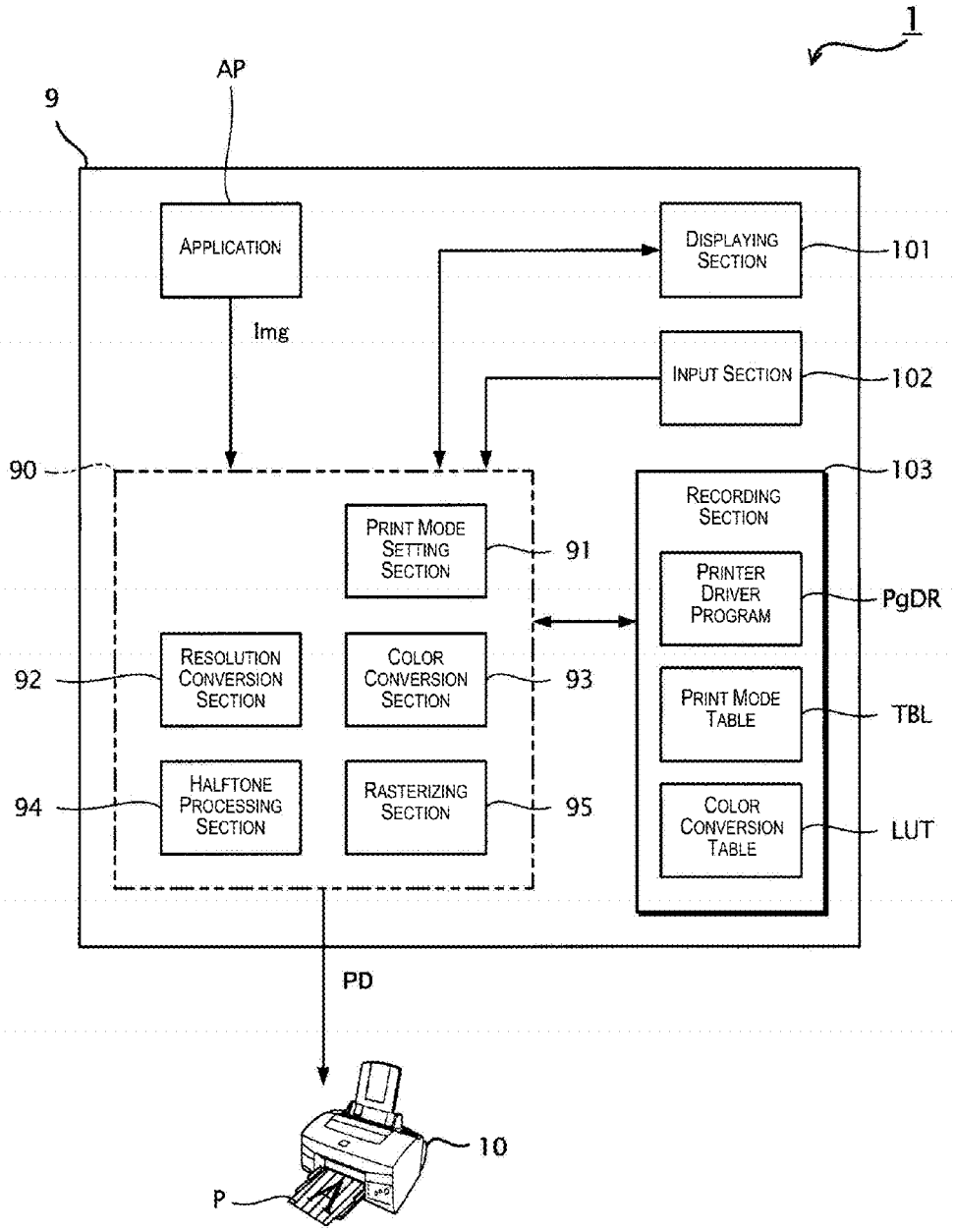
FIG. 1 is a block diagram illustrating a structure of a printing device 1 according to a first embodiment of the present invention.

FIG. 1 is a block diagram showing the structure of the printing device 1.

As shown in FIG. 1, the printing device 1 according to this embodiment includes a host computer 9 equipped with a print data generating section for generating print data PD and an inkjet printer 10.

Although the details will be explained later, the inkjet printer 10 is equipped with a print execution section for executing print processing by ejecting ink on a paper medium and a fabric to form an image and a print operation control section for controlling the operation of the print execution section based on the print data PD.

<1.1. Structure of Host Computer>

The host computer 9 is equipped with a CPU (Central Processing Unit) for controlling the operation of the host computer 9 (not illustrated). Also, as shown in FIG. 1, the host computer 9 is equipped with a display section 101 such as a display, etc., an input section 102 such as a keyboard, a mouse, etc., and a recording section 103 including a RAM (Random Access Memory), a hard disk drive, etc.

Further, the host computer 9 is equipped with a print data generating section 90 for executing print data generation processing for converting image data Img which is output from an application AP operating in the host computer 9 to print data PD which is data capable of being used in print processing by the inkjet printer 10.

In the recording section 103, an operating system (not illustrated), a printer driver program PgDR corresponding to the inkjet printer 10 and operating on the operating system, and various application programs (not illustrated) such as a word processing software, an image processing software, etc., are stored.

Further, the printer driver program PgDR can be incorporated into the operating system in advance, obtained from a recording medium which can be read by the host computer 9, such as a CD-ROM, a magnetic disc, a memory card, etc., or obtained by downloading from a certain site via the Internet.

In the recording section 103, a plurality of print mode tables TBL and a color conversion table LUT are stored.

In the plurality of print mode tables TBL, various information required for generating image data PD are stored. In this embodiment, the plurality of print mode tables TBL include a medium type table TBL11, a color mode table TBL12, a mode evaluation table TBL13, an operation set information table TBL14, and a print performance table TBL15. However, it can be configured such that these pluralities of print mode tables TBL are collected into one table.

In the color conversion table LUT, information for expressing a color expressed in a color space defined by, for example, three colors, red (R), green (G), and blue (B) in a color space defined by one or a plurality of ink colors (e.g., four colors CMYK) used by an inkjet printer 10 for print processing.

In this embodiment, the pluralities of print mode tables TBL and the color conversion table LUT are stored in a predetermined recording area of the recording section 103 when the CPU of the host computer 9 executes the printer driver program PgDR or when the printer driver program PgDR is installed in the host computer 9. Further, these pluralities of print mode tables TBL and color conversion table LUT can be included in the printer driver program PgDR.

When the CPU of the host computer 9 executes an application program stored in the recording section 103, an application AP having various functions such as word processing, image processing, etc., is started. The application AP outputs image data Img showing an image when, for example, a request for printing an image subject to processing by the application AP by an inkjet printer 10 is received from a user of the printing device 1.

The print data generating section 90 converts image data Img output from the application AP to image data PD. The print data generating section 90 is a functional block realized when the CPU of the host computer 9 executes the printer driver program PgDR and when the CPU of the host computer 9 functions according to the printer driver program PgDR.

As explained above, in this embodiment, the image data Img is data expressed by RGB. Therefore, to print the image expressed by the image data Img using the inkjet printer 10, the image is required to be expressed in a color space of ink colors used by the inkjet printer 10. Also, to print the image expressed by the image data Img using the inkjet printer 10, the image has to be expressed in a resolution that can be handled by the inkjet printer 10.

The print data generating section 90 converts an image represented by image data Img to an image expressed by a resolution and a color space corresponding to the print processing by the inkjet printer 10, and based on the converted image data, the inkjet printer 10 to print the image by the print processing generates print data PD showing the dot sizes, the dot allocation, etc., to be formed on a recording medium P. It becomes possible for the inkjet printer 10 to print an image shown by the image data Img on a recording medium P based on the print data PD generated by the print data generating section 90.

Hereinafter, the details of the print data generating section 90 will be explained.

As shown in FIG. 1, the print data generating section 90 according to this embodiment includes a print mode setting section 91 for setting the print mode of the inkjet printer 10, a resolution conversion section 92 for converting the resolution of an image represented by the image data Img to a resolution corresponding to the print mode set by the print mode setting section 91, a color conversion section 93 for converting the data of the color of an image represented by the image data Img to data represented by a color space defined by ink colors used by the inkjet printer 10 in the print mode set by the print mode setting section 91, a halftone processing section 94 for performing halftone processing for determining the dot allocation, the dot sizes, etc., to be formed on the recording medium P when the inkjet printer 10 prints an image represented by the image data Img, and a rasterizing section 95 for performing rasterizing processing for arranging the halftone processed image data in an order to be forwarded to the inkjet printer 10 and for forming the print data PD based on the rasterized image data.

Further, the details of the print data generating section 90 and the print mode will be explained later.

<1.2. Structure of Inkjet Printer>

Next, with reference to FIGS. 2 to 5, the structure of the inkjet printer 10 according to this embodiment will be explained.

Figure 2:
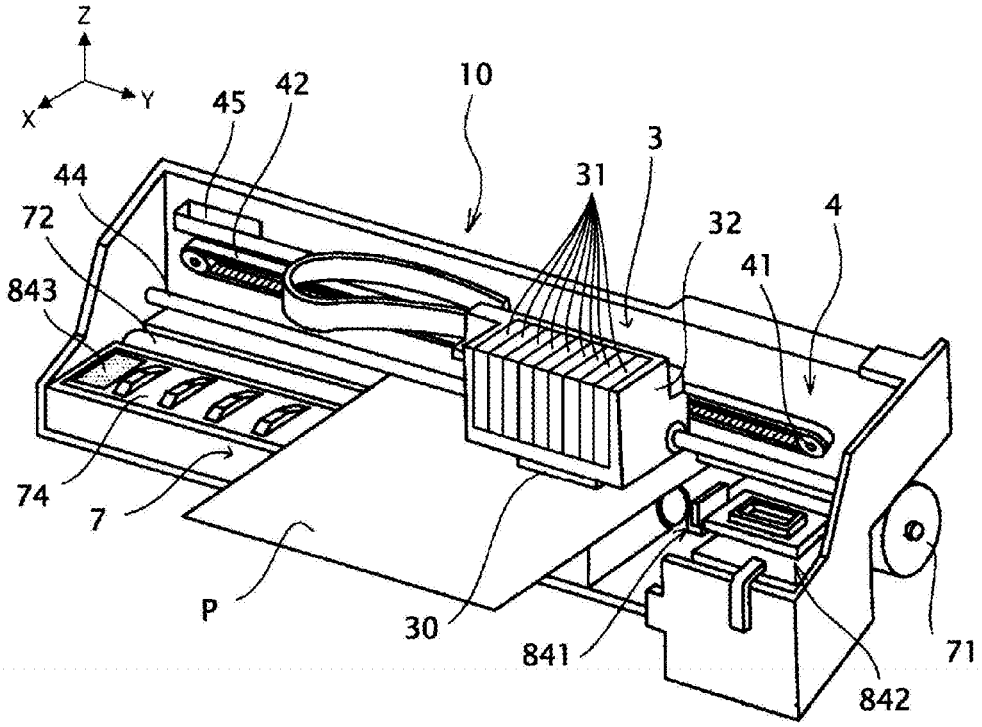
FIG. 2 is a schematic cross-sectional view showing a main section of an inkjet printer 10.

FIG. 2 is a perspective view schematically showing the inner structure of the inkjet printer 10. Further, FIG. 3 is a functional block diagram showing a structure of the inkjet printer 10 according to this embodiment.

As shown in FIG. 2, the inkjet printer 10 is equipped with a moving body 3 that reciprocates in the Y-axis direction (hereinafter may be referred to as "main scanning direction").

Figure 3:
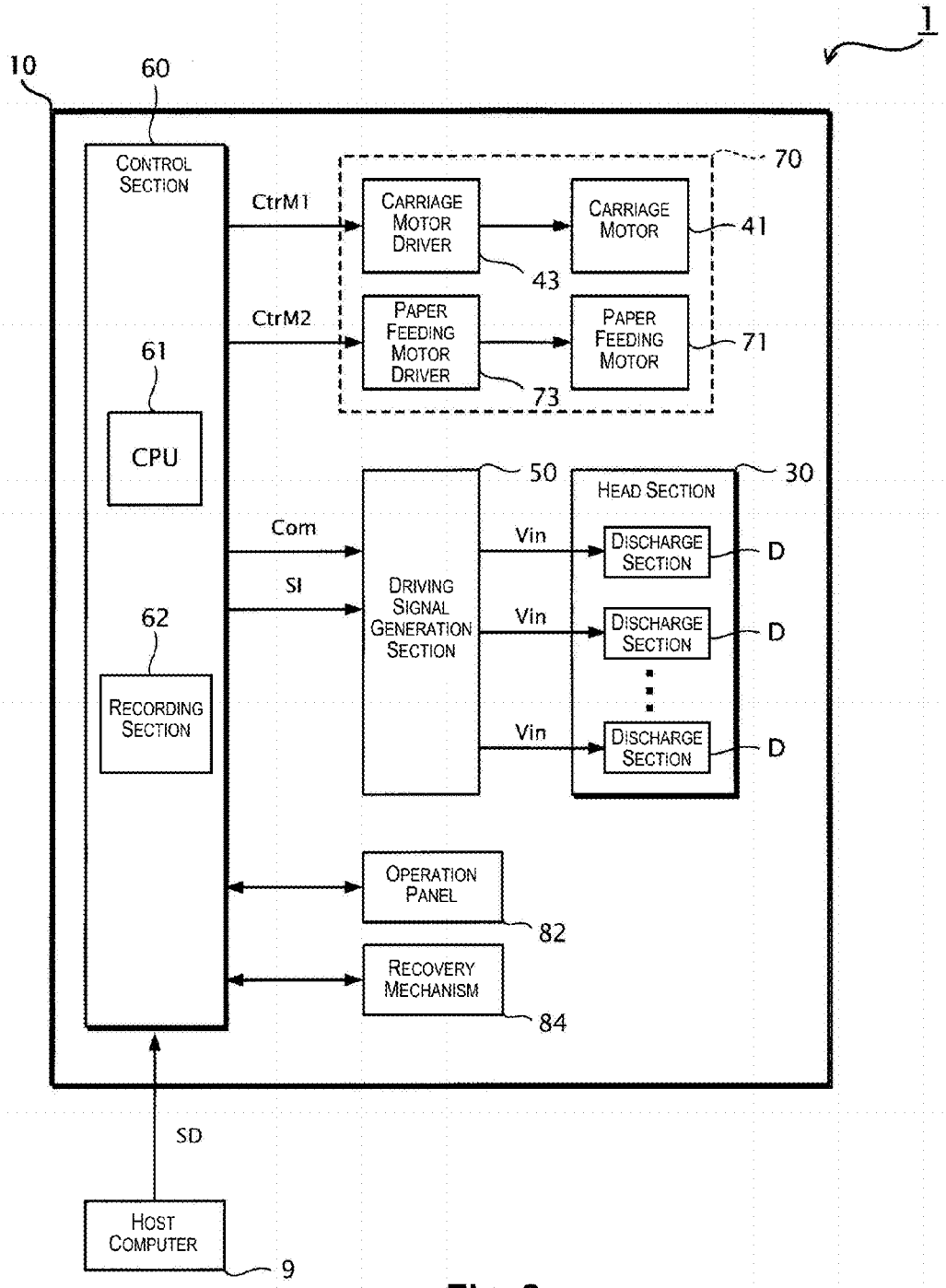
FIG. 3 is a block diagram showing a structure of the inkjet printer 10.

Also, as shown in FIGS. 2 and 3, the moving body 3 is equipped with a head section 30 having 9M ejection sections D, 9 ink cartridges 31, a driving signal generation section 50 for generating driving signals Vin for driving each ejection section D equipped in the head section 30, and a carriage 32 in which a head section 30, 9 ink cartridges 31, and the driving signal generation section 50 are mounted (M is a natural number of 1 or more). Each ejection section D is filled with an ink fed from the ink cartridge 31 inside and ejects the filled ink to the recording medium P according to the driving signal Vin.

Further, the head section 30 and the driving signal generation section 50 are examples of the aforementioned "print execution section."

Nine ink cartridges 31 are provided, corresponding to 1 to 1 for 9 types of colors, black (Bk), cyan (Cy), magenta (Mg), yellow (Yl), green (Gr), violet (Vl), orange (Or), light cyan (CyL), and light magenta (MgL), and each ink cartridge 31 is filled with an ink having a color corresponding to the ink cartridges 31.

Hereinafter, the aforementioned 9 types of colors are classified into three color classifications, i.e., a basic color, a characteristic color, and a light color. Specifically, four colors of black (Bk), cyan (Cy), magenta (Mg), and yellow (Yl) are classified as a basic color. The three colors of green (Gr), violet (Vl), and orange (Or) are classified as a characteristic color, and two colors of light cyan (CyL) and light magenta (MgL) are classified as a light color.

That is, the inkjet printer 10 according to this embodiment can use inks of a total of three color classifications of a basic color ink (hereinafter may be referred to as "basic color ink"), a characteristic color ink (hereinafter may be referred to as "characteristic color ink"), and a light color ink (hereinafter may be referred to as "light color ink"). In other words, the inkjet printer 10 according to this embodiment can use a total of 9 types of inks, which are 4 types of basic color inks, 3 types of characteristic color inks, and 2 types of light color inks.

A light color ink denotes an ink in which a weight ratio of water or other solvent components contained in the ink is larger as compared to a basic color or characteristic color ink. Specifically, a light cyan ink is an ink in which the weight ratio of a solvent component to cyan ink is increased, and a light magenta ink is an ink in which the weight ratio of a solvent component to magenta ink is increased.

Each of the 9M ejection sections D receives a feeding of ink from any one of the 9 ink cartridges 31.

More specifically, 9M ejection sections D are grouped into 9 ejection groups so as to correspond to the 9 ink cartridges 31 one-on-one. Each ejection group includes M ejection sections D, and each of the M ejection sections D constituting each ejection group receives a feeding of ink from an ink cartridge 31 corresponding to the ejection group. With this, it is possible to eject one color ink from M ejection sections D constituting each ejection group and to eject a total of 9 color inks from 9M ejection sections D constituting the 9 ejection groups.

In addition, in this embodiment, each ink cartridge 31 is mounted on the carriage 32, but it can be provided on a place other than the carriage 32 of the inkjet printer 10.

As shown in FIG. 2, the inkjet printer 10 is equipped with a moving mechanism 4 for reciprocating the moving body 3 in the Y-axis direction (hereinafter may be referred to as "main scanning direction").

As shown in FIGS. 2 and 3, the moving mechanism 4 is equipped with a carriage motor 41 as a driving source for reciprocating the moving body 3, a carriage guide shaft 44 in which both ends are fixed, a timing belt 42 extending parallel to the carriage guide shaft 44 and driven by the carriage motor 41, and a carriage motor driver 43 for driving the carriage motor 41.

The carriage 32 of the moving body 3 is supported by the carriage guide shaft 44 of the moving mechanism 4 in a manner such that it can be freely reciprocated and fixed to a portion of the timing belt 42. Therefore, when the timing belt 42 is made to travel normally/reversely by the carriage motor 41, the moving body 3 is guided by the carriage guide shaft 44 and thereby reciprocated.

Further, the moving mechanism 4 is equipped with a linear encoder 45 for detecting the position of the moving body 3 in the main scanning direction.

As shown in FIG. 2, the inkjet printer 10 is equipped with a paper feeding mechanism 7 for feeding and ejecting a recording medium P.

As shown in FIGS. 2 and 3, the paper feeding mechanism 7 is equipped with a paper feeding motor 71 as a driving source for the paper feeding mechanism, a paper feeding motor driver 73 for driving the paper feeding motor 71, a platen 74 provided below the head section 30 (−Z direction in FIG. 2), a paper feeding roller 72 which rotates with the operation of the paper feeding motor 71 and feeds a recording medium P one by one on the platen 74, and a paper ejection roller (not illustrated) which rotates with the operation of the paper feeding motor 71 and conveys the recording medium P on the platen 74 to a paper ejection opening. The paper feeding mechanism 7 can convey the recording medium P in an X-axis direction intersecting with a Y-axis direction (hereinafter may be referred to as "sub-scanning direction").

The inkjet printer 10, at a time when a recording medium P is conveyed onto the platen 74 by the paper feeding mechanism 7, executes print processing for forming an image on the recording medium P by ejecting ink from a plurality of ejection sections D to the recording medium P.

In addition, the aforementioned moving mechanism 4 and the paper feeding mechanism 7 are mechanisms for changing the relative position of the moving mechanism 3 (carriage 32) to the recording medium P and hereinafter, the moving mechanism 4 and the paper feeding mechanism 7 may be collectively referred to as a relative position changing section 70.

Further, the inkjet printer 10 is equipped with a recovery section 84 for executing recovery processing for restoring the ejection state of the ejection section D to a normal state, when an ejection abnormality occurs, which is a state in which an ink cannot be accurately ejected in the ejection section D.

As shown in FIGS. 2 and 3, the recovery mechanism 84 is equipped with, other than a cap 842 for sealing a nozzle plate 240 of the head section 30 (see FIG. 4), a wiper 841, an ink receiving section 843, and a tube pump (not illustrated), etc. With this, the recovery mechanism 84 executes recovery processing for restoring the ejection state of the ink in the ejection section D to a normal state, such as wiping processing for wiping foreign substances, such as paper dust, etc., adhered to a nozzle plate 240 of the ejection section D with a wiper 841, flushing processing for preliminary ejecting an ink to the ink receiving section 843 from the ejection section D, and pumping processing for absorbing thickened ink, air bubbles, etc., inside the ejection section D by a tube pump.

As shown in FIG. 3, the inkjet printer 10 is equipped with an operation panel 82 having a display section (not illustrated) constituted by a liquid crystal display, an organic electro luminescence display, and an LED lamp, etc., for displaying error messages, etc., and an operation section (not illustrated) constituted by various switches, etc.

As shown in FIG. 3, the inkjet printer 10 is equipped with a control section 60 for controlling the operations of each section of the inkjet printer 10 (an example of the aforementioned "printing operation control section").

The control section 60 executes, by controlling the driving signal generation section 50 and the relative position changing section 70, etc., based on a print data PD input from the host computer 9, print processing for forming an image on a recording medium P according to the print data PD.

Specifically, the control section 60 drives the carriage motor 41 so as to convey the paper medium P in the sub-scanning direction by controlling a carriage motor driver 43 and also drives a paper feeding motor 71 so as to reciprocate a moving body 3 in the main scanning direction by controlling the paper feeding motor driver 73, and by controlling the driving signal generation section 50, further controls the presence or absence of the ejection of ink from each ejection section D and the ejection amount and the ejection timing of ink when ink is ejected.

With this, the control section 60 executes print processing by adjusting the dot size to be formed by and the dot allocation of ink ejected on the recording medium P, to thereby form an image corresponding to the print data PD on the recording medium P.

The control section 60 is equipped with a CPU 61 and a recording section 62.

The recording section 62 is equipped with an EEPROM (Electrically Erasable Programmable Read-Only Memory), which is one type of a nonvolatile semiconductor memory for storing print data PD, fed from a host computer 9 via an interface section (not illustrated), in a data storage area, a RAM (Random Access Memory) which temporarily stores the necessary data when executing various processes such as print processing, etc., and temporarily develops a control program for executing various processing such as print processing, etc., and a PROM, which is one type of a nonvolatile semiconductor memory for storing a control program for controlling each section of the inkjet printer 10.

The CPU 61 stores the print data PD fed from the host computer 9 in the recording section 62.

Further, the CPU 61, based on various data such as print data PD, etc., stored in the recording section 62, generates and outputs a print signal SI and a driving waveform signal Com, etc., for controlling the operation of the driving signal generation section 50 and driving each ejection section D.

Also, the CPU 61, based on various data stored in the recording section 62, generates various control signals such as a control signal CtrM1 for controlling the operation of the carriage motor driver 43, a control signal CtrM2 for controlling the operation of the paper feeding motor driver 73, a control signal for controlling the operation of a discharge mechanism 84, etc., and outputs the generated various control signals.

In this way, the control section 60 (CPU 61) controls the operation of each section of the inkjet printer 10 by generating and feeding various control signals such as a print signal SI, a driving waveform signal Com, etc., to each section of the inkjet printer 10. With this, the control section 60 (CPU 61) executes various processing such as print processing, recovery processing, etc.

The driving signal generation section 50, based on the print signal SI, the driving waveforms signal Com, etc., fed from the control section 60, generates driving signals Vin for driving each of the 9M ejection sections D provided in the head section 30. In this embodiment, the driving waveform signal Com includes a driving waveform signal Com-A and a driving waveform signal Com-B.

Further, the details of the print data generating section 50 and the driving waveform signal Com will be explained later.

<1.3. Structure of Head Section and Ejection Section>

Next, with reference to FIGS. 4 to 7, the head section 30 and the ejection section D provided in the head section 30 will be explained.

Figure 4:
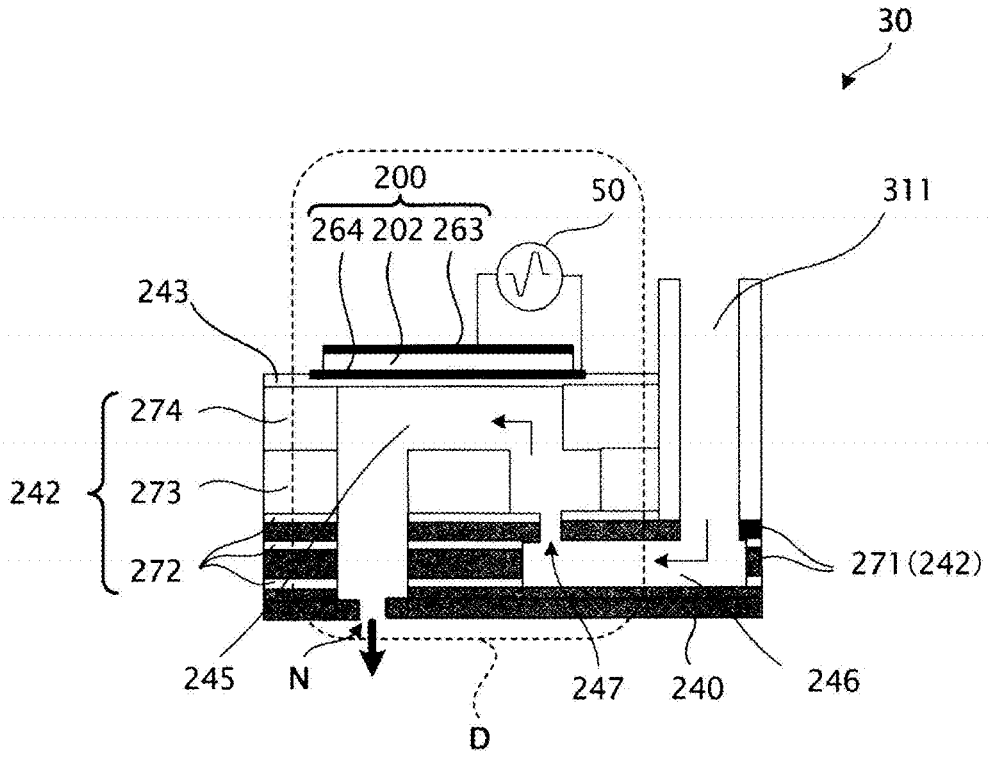
FIG. 4 is a schematic cross-sectional view showing a main section of a head section 30.

FIG. 4 is an example of a schematic cross-sectional view of a portion of a head section 30. Further, in this drawing, among the head section 30, one ejection section D among 9M ejection sections D and a reservoir 246 in communication with the ejection section D via an ink supply opening 247 are shown.

As shown in FIG. 4, the ejection section D is equipped with a piezoelectric element 200, a cavity 245 filled with ink inside (pressure chamber), a nozzle N in communication with the cavity 245, and a diaphragm 243. In the ejection section D, by driving the piezoelectric element 200 by a driving signal Vin, an ink inside the cavity 245 is ejected from a nozzle N.

The cavity 245 of the ejection section D is a space partitioned by a cavity plate 242, a nozzle plate 240 to which nozzles N are formed, and a diaphragm 243. The cavity 245 is in communication with the reservoir 246 via the ink supply opening 247.

The reservoir 246 is a space partitioned by the cavity plate 242 and the nozzle plate 240 and is in communication with an ink cartridge 31 via an ink intake opening 311.

The cavity plate 242 includes a first plate 271, an adhesive film 272, a second plate 273, and a third plate 274. The nozzle plate 240, the first plate 271, the adhesive film 272, the second plate 273, and the third plate 274 are each formed into a predetermined shape (a shape in which a concave portion is formed), and the cavity 245 and the reservoir 246 are formed by stacking them.

In this embodiment, a unimorph (monomorph) type piezoelectric element as shown in FIG. 4 is used as a piezoelectric element 200. The piezoelectric element 200 includes a lower electrode 263, an upper electrode 264, and a piezoelectric member 202 provided between the lower electrode 263 and the upper electrode 264. Then, when the driving signal Vin is supplied to the piezoelectric element 200 and a voltage is applied between the lower electrode 263 and the upper electrode 264, the piezoelectric element 200 bends in the up and down direction of the drawing according to the applied voltage, which in turn vibrates the piezoelectric element 200 as a result.

At the upper surface opening portion of the third plate 274, a diaphragm 243 is provided, and to the diaphragm 243, the lower electrode 263 of the piezoelectric element 200 is adhered. When the piezoelectric element 200 vibrates by the driving signal Vin, the diaphragm 243 adhered to the piezoelectric element 200 also vibrates. Then, the volume of the cavity 245 (the pressure inside the cavity 245) changes by the vibration of the diaphragm 243 and the ink filled in the cavity 245 is ejected from the nozzle N.

When the ink inside the cavity 245 is reduced by the ejection of ink, ink is supplied from the reservoir 246. Also, ink is supplied to the reservoir 246 from the ink cartridge 31 via the ink intake opening 311.

Figure 5:
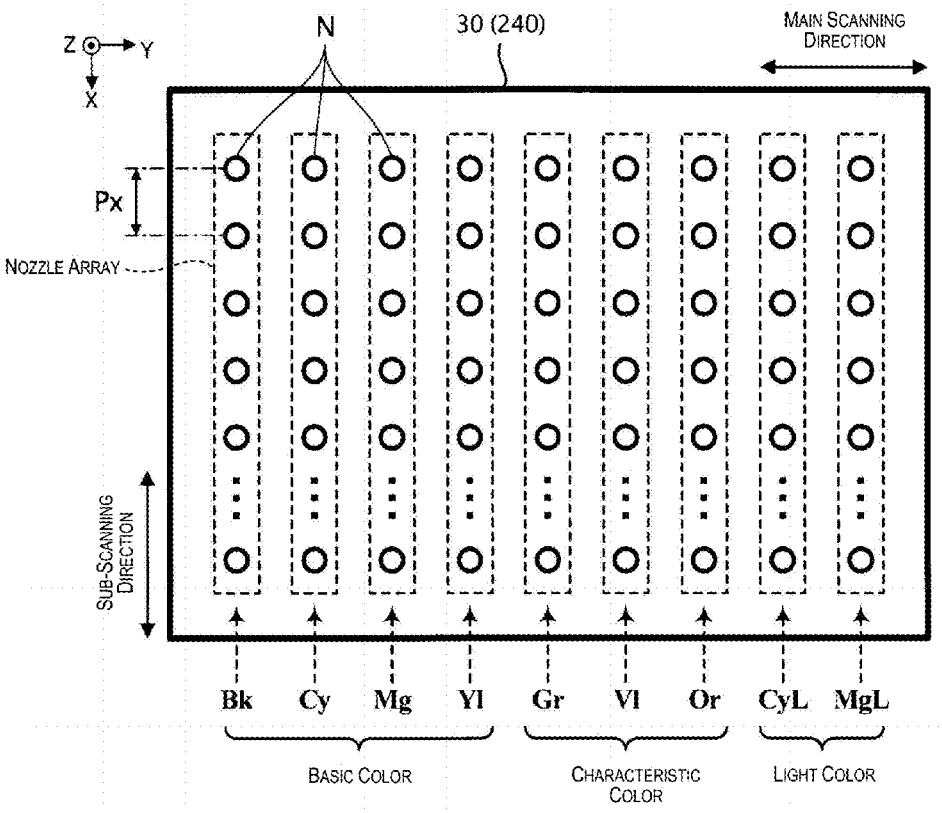
FIG. 5 is an explanatory view illustrating an arrangement of nozzles.

FIG. 5 is a view showing an example of the allocation of 9M nozzles N provided in the head section 30 when the nozzle plate 240 is seen from the bottom surface of the head section 30, that is, seen in the −Z direction (that is, a direction intersecting with both X-axis direction and Y-axis direction).

9M nozzles N are divided into 9 nozzle lines and arranged on the nozzle plate 240 so as to correspond to the 9 ejection groups (9 colors of ink) one-to-one. An ink of a color corresponding to the nozzle line is ejected from M nozzles N constituting each nozzle line.

In addition, in this embodiment, as shown in FIG. 5, a case in which M nozzles N constituting each nozzle line are arranged so as to be aligned in a line in the X-axis direction is exemplified, but for example, they can be arranged in a so-called zigzag manner so that the positions of a group of nozzles N among M nozzles N constituting each nozzle line (for example, even numbered nozzles N) and other nozzles N (for example, odd numbered nozzles N) in the Y-axis direction are different.

In addition, the detailed will be explained later, but in the present specification, the resolution of the sub-scanning direction is denoted as "Rx." Also, the interval between two adjacent pixels in the X-axis direction when the resolution in the sub-scanning direction is "Rx" is called a "dot pitch Pxd." Also, the interval between two adjacent nozzles N in the X-axis direction is called a "pitch Px." At this time, there is a relationship of "Px=Rx*k" between the pitch Px and the dot pitch Pxd. Here, k is a positive integer and hereinafter referred to as a "nozzle pitch."

Next, the ejection of ink in the ejection section D will be explained with reference to FIGS. 6A, 6B and 6C.

Figures 6A, 6B, 6C:
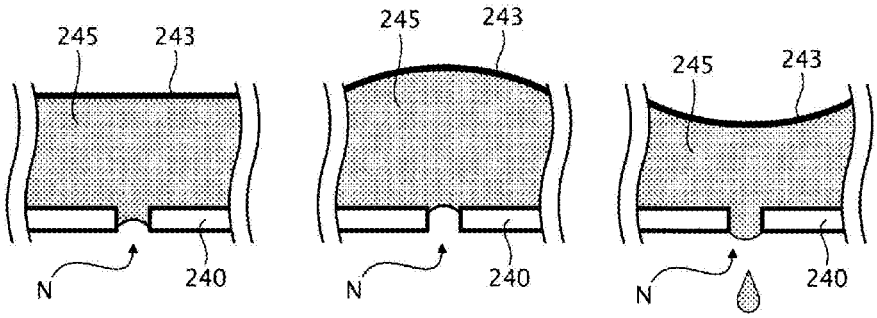
FIGS. 6A, 6B and 6C are explanatory views for explaining changes of a cross-sectional shape of an ejection section D when supplying a driving signal Vin.

In the state shown in FIG. 6A, when a driving signal Vin is supplied from the driving signal generation section 50 to the piezoelectric element 200, distortion in response to an electric field applied between the electrodes is generated in the piezoelectric element 200, and the diaphragm 243 bends in the upward direction of the drawing. Consequently, as compared with the initial state shown in FIG. 6A, the volume of the cavity 245 increases as shown in FIG. 6B. In the state shown in FIG. 6B, when the voltage shown by the driving signal Vin is changed by controlling the driving signal generation section 50, the diaphragm 243 is restored by the elastic restoring force and moves in the downward direction of the drawing exceeding the position of the diaphragm 243 in the initial state, and the volume of the cavity 245 rapidly shrinks as shown in FIG. 6C. At this time, due to the compression pressure generated in the cavity 245, a portion of the ink filling the cavity 245 is ejected as an ink drop from the nozzle N in communication with the cavity 245.

Figure 7:
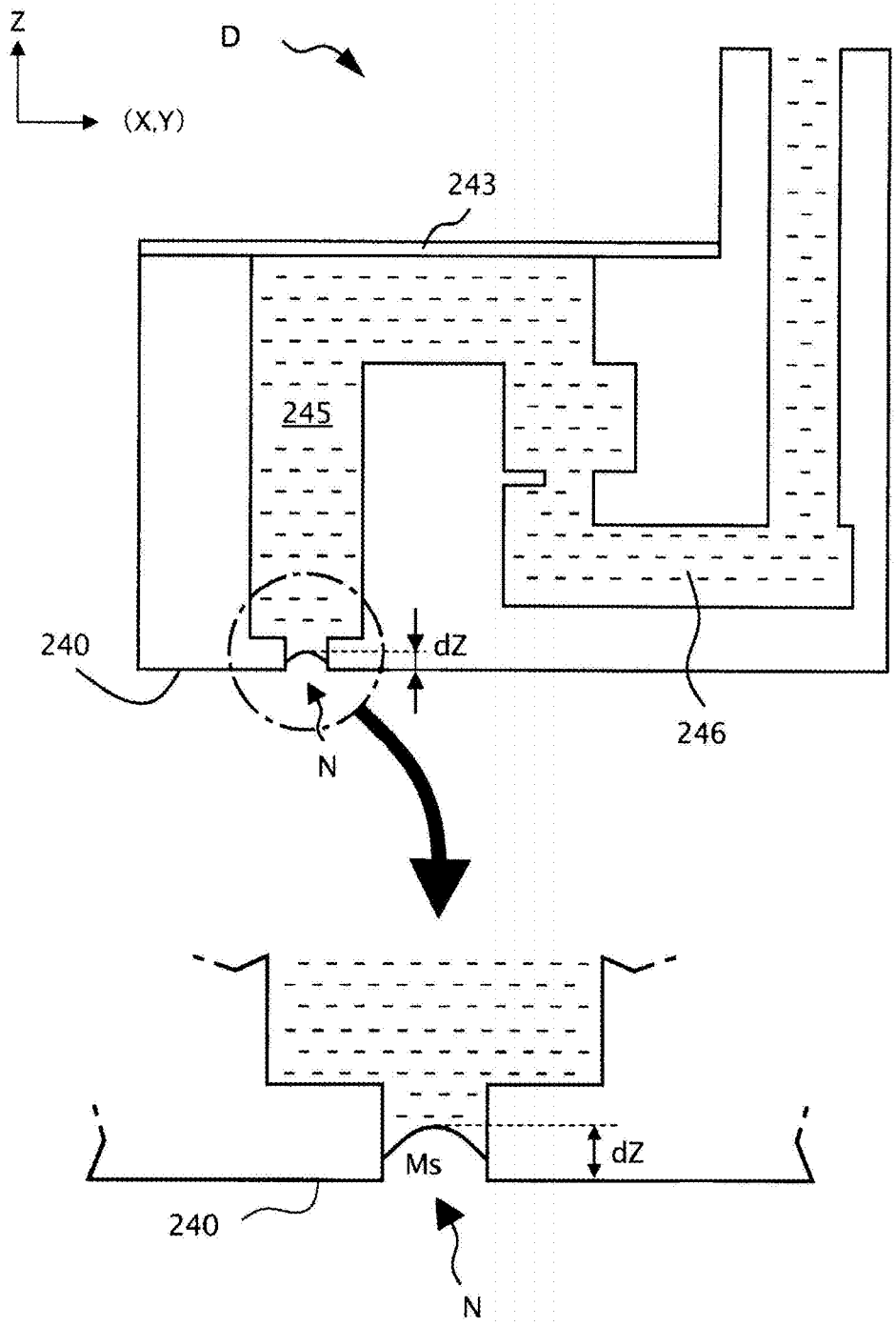
FIG. 7 is an explanatory view for explaining a meniscus Ms and a meniscus position dZ.

FIG. 7 is a drawing showing a meniscus Ms which is an interface of the ink filled in the cavity 245 of the ejection section D and air.

As shown in the drawing, in this embodiment, the distance between the nozzle plate 240 (strictly, the bottom surface of the nozzle plate 240 positioned on the −Z side) and the meniscus Ms in the Z-axis direction is denoted as the meniscus position dZ.

Further, generally, the meniscus Ms has a curved shape at a timing of not ejecting ink due to the surface tension of the ink, and has a wave-like shape at the timing of ejecting ink or immediately after ejecting ink. Therefore, in this embodiment, the meniscus position dZ at a certain moment is defined as the maximum value of the distance between the nozzle plate 240 and the meniscus Ms in the Z-axis direction at the certain moment. Here, "the maximum value of the distance between the nozzle plate 240 and the meniscus Ms in the Z-axis direction" is not meant to be limited to a strict maximum value, and for example, as shown in FIG. 7, it can be the distance between the meniscus Ms near the center of the nozzle N in the X-axis direction and the Y-axis direction and the nozzle plate 240 in the Z-axis direction.

However, the meniscus position dZ can be determined in any way as long as the position of the meniscus Ms in the Z-axis direction can be identified. For example, the meniscus position dZ at a certain moment can be the average value or the minimum value of the distance between the nozzle plate 240 and the meniscus Ms in the Z-axis direction at the certain moment. Also, for example, the meniscus position dZ can be the maximum value (or the average value or the minimum value) of the distance between a platen 74 (or a recording medium P conveyed onto the platen 74) and the meniscus Ms at certain moment in the Z-axis direction.

2. Print Mode

Next, a print mode set by a print data generating section 90 will be explained with reference to FIG. 1 and FIGS. 8 to 14.

As explained above, the print data generating section 90 includes a print mode setting section 91, a resolution conversion section 92, a color conversion section 93, a halftone processing section 94, and a rasterizing section 95.

Figure 8:
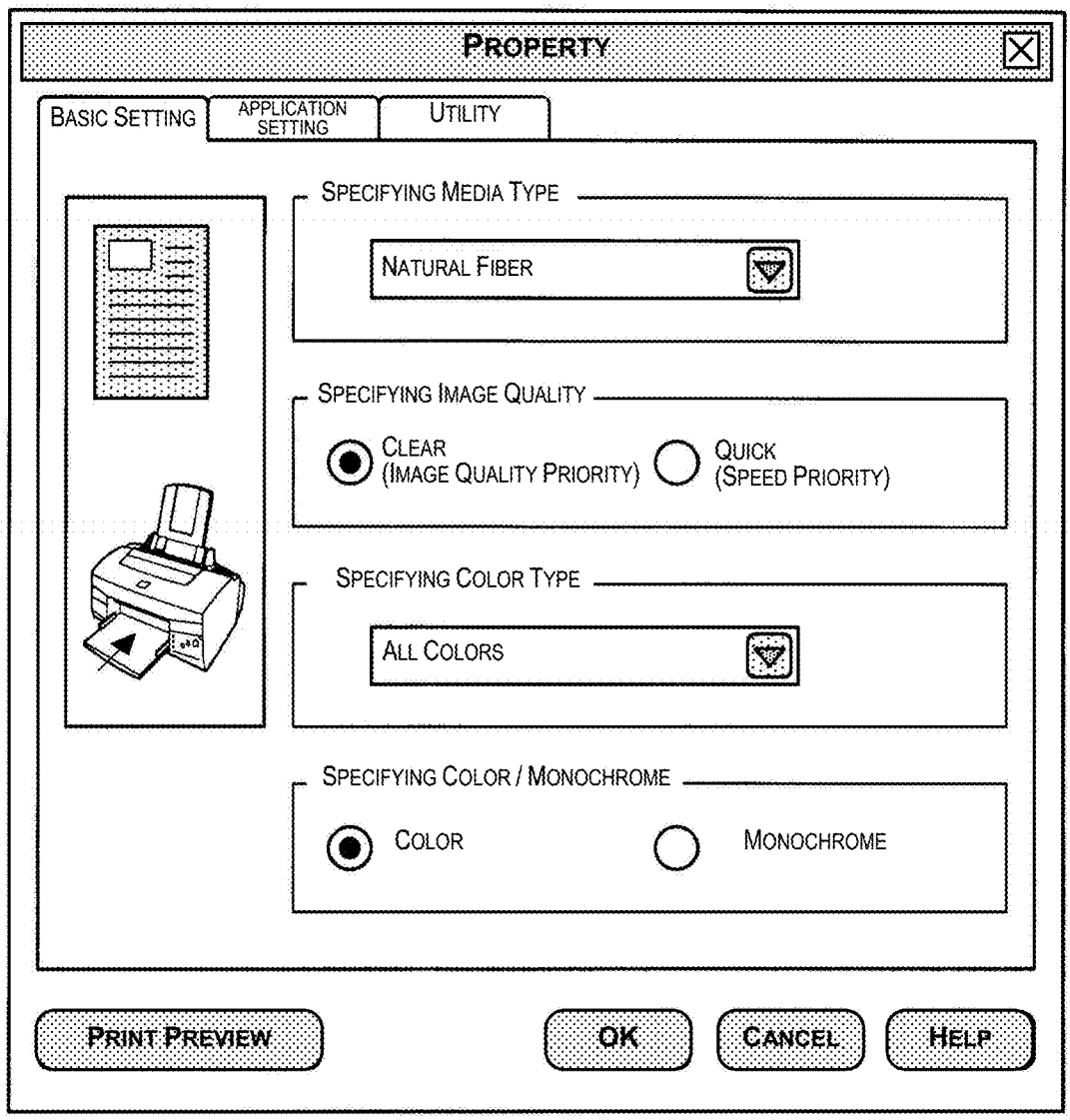
FIG. 8 is an explanatory view showing one example of a print condition specifying screen.
Figure 9:
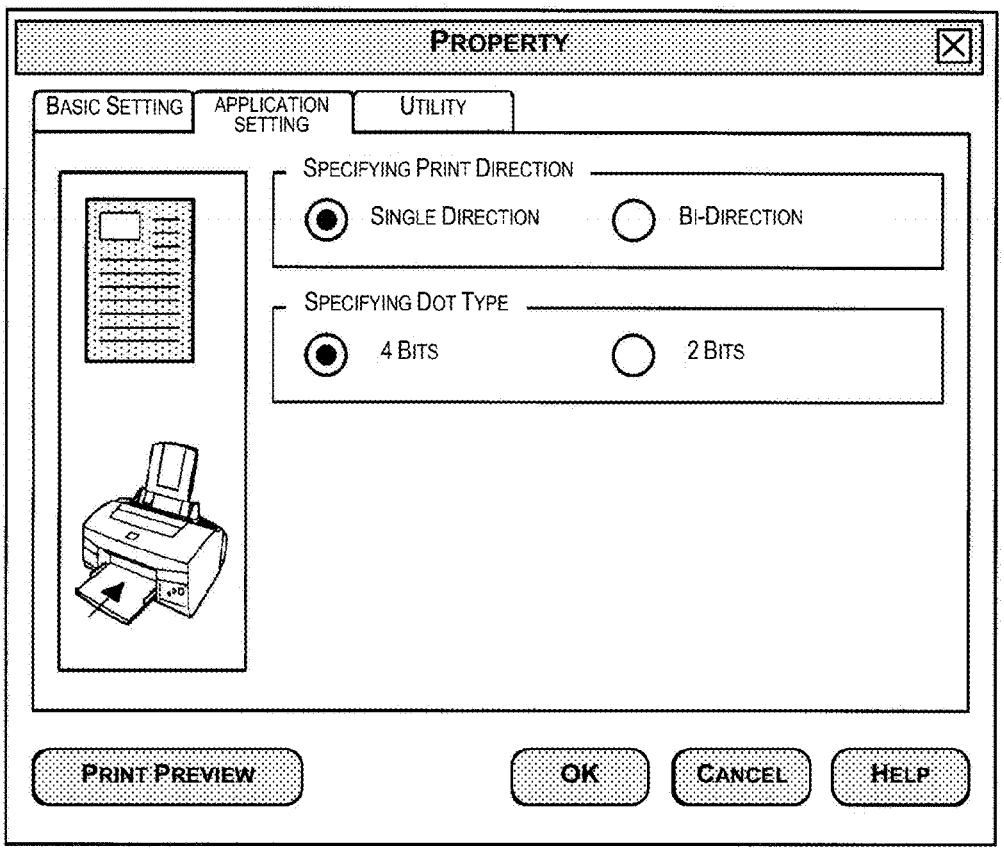
FIG. 9 is an explanatory view showing one example of a print condition specifying screen.

Among them, the print mode setting section 91 generates, when the CPU of a host computer 9 executes an application program stored in the recording section 103 and the application AP outputs image data Img, first, screen display information for displaying a print condition specifying screen (so-called control panel of a printer) exemplified in FIG. 8 and FIG. 9 on a display section 101. Then, the CPU of the host computer 9, based on the screen display information, makes the print condition specifying screen display on the display section 101.

A user of the printing device 1 can specify a print mode on the print condition specifying screen.

Here, "print mode" is the information for prescribing the operation of print processing executed by an inkjet printer 10, such as, the resolution of an image to be formed on a recording medium P, the ejection amount of ink for forming a dot corresponding to each pixel of the image, etc.

Specifically, in this embodiment, a print mode is defined as a combination of 5 types of setting modes, i.e., a medium mode m, an image quality mode g, a print direction mode h, a dot type mode d, and a color mode c.

Among them, the medium mode m is a mode for prescribing the type of recording medium P subjected to print processing. Further, the image quality mode g is a mode for prescribing the image quality of an image to be formed by the print processing. The print direction mode h is a mode for prescribing the relationship between the moving direction of a carriage 32 to be explained later and the presence or absence of ink ejection. The dot type mode d is a mode for prescribing the number of types of size of each dot. The color mode c is a mode for prescribing the type of ink used in the inkjet printer 10.

A user of the printing device 1 can specify the medium mode m by selecting the type of a recording medium P by "specifying the media type," specify the image quality mode g by "specifying the image quality," and specify the color mode c by "specifying the color type" on the print condition specifying screen exemplified in FIG. 8.

Further, a user of the printing device 1 can specify, on the print condition specifying screen exemplified in FIG. 9, the printing direction mode h by "specifying the printing direction," and specify the dot type mode d by "specifying the dot type."

Furthermore, a user of the printing device 1 can specify, on the print condition specifying screen, various print conditions other than the print mode, for example, the distinction of color printing and monochrome printing, size of a recording medium P, etc.

Further, in this embodiment, the medium mode m is an essential setting mode that a user of the printer device 1 is required to always specify on the print condition specifying screen, and the other four types of setting modes are arbitrary setting modes that a user of the printing device 1 is not required to always specify. Although details will be explained later, when the user of the printing device 1 does not specify setting modes other than the medium mode m, the print mode setting section 91 determines the four setting modes other than the medium mode m according to the medium mode m specified by the user of the printing device 1.

FIG. 10 is an explanatory view showing each of set contents of five types of setting modes constituting a print mode.

As shown in FIG. 10, the medium mode m is set to any one of modes among a photograph paper mode for printing on a photograph paper, a normal paper mode for printing on a normal paper, or a fabric mode for printing on a fabric. That is, a recording medium P subjected to print processing by the inkjet printer 10 according to this embodiment includes a photograph paper, a normal paper, and a fabric.

Here, a photograph paper is a general term for a recording medium P such as, a photo paper, a luster photo paper, a mat photo paper, a coated paper, a luster photograph paper, a silky tone photograph paper, etc., and a normal paper is a general term for a recording medium P such as, a normal paper, a recycled paper, a fine paper, etc. Hereinafter, these photograph papers and normal papers may be collectively referred to as "paper medium." Further, a photograph paper mode and a normal paper mode may be collectively referred to as "paper medium print mode."

Also, a fabric is a general term for a recording medium P such as, a fabric made of natural fibers (hereinafter may be simply referred to as "natural fiber"), a fabric made of chemical fibers (hereinafter may be simply referred to as "chemical fiber"), etc. Among them, as a natural fiber, silk, cotton, wool, etc., can be exemplified, and as a chemical fiber, nylon, acryl, polyester, etc., can be exemplified.

In this embodiment, a fabric including a chemical fiber and a natural fiber is an example of a "fabric medium" and a fabric print mode for executing print processing on a fabric is an example of a "textile print mode."

In addition, hereinafter, various setting modes may be denoted as "mode number" as shown in FIG. 10, rather than denoting as a mode name such as "photograph paper mode" or the like.

Specifically, the medium mode m may be denoted by a mode number such that a photograph paper mode is "medium mode m=1," a normal paper mode is "medium mode m=2," and a fabric mode is "medium mode m=3."

When a user of the printing device 1 selects a type (medium type) of a recording medium P on the print condition specifying screen, the print mode setting section 91 accesses the medium type table TBL11 correspondingly storing a medium type and a medium mode m as exemplified in FIG. 11 and obtains a mode number (or a mode name) of a medium mode m corresponding to the medium type specified by the user of the printing device 1. Then, the print mode setting section 91 sets the medium mode m to a content corresponding to the mode number obtained from the medium type table TBL11.

In addition, in the present specification, a value represented by data may be denoted as a word or a symbol, but this is only to make it easier to be understood, and the values represented by data can be a number or other data form in actuality.

As shown in FIG. 10, the image quality mode g among the print modes is set to either the image quality priority mode for printing prioritizing an image quality rather than a print speed (image quality mode g=1) or a speed priority mode for printing prioritizing a print speed rather than an image quality (image quality mode g=2).

Further, the printing direction mode h among the print modes is set to either a bi-direction mode for executing the formation of dots on a recording medium P by ejecting ink in both the going stroke and a returning stroke in the reciprocating movement in the main scanning direction of the carriage 32 (printing direction mode h=1) or a single direction mode for executing the formation of dots on a recording medium P by ejecting ink in either one of the going stroke or the returning stroke in the reciprocating movement in the main scanning direction of the carriage 32 (printing direction mode h=2).

Also, the dot type mode d among the print modes is set to either a 2-bit mode representing each dot by two gradations, "non-record" or "large dot" (dot type mode d=1) or a 4-bit mode representing each dot by four gradations, "non-record," "small dot," "middle dot," or "large dot" (dot type mode d=2).

Also, the color mode c among the print modes is set to any one of a pure black mode (color mode c=1), a basic color mode (color mode c=2), a light and shade color mode (color mode c=3), a characteristic color mode (color mode c=4), or all color mode (color mode c=5).

The color conversion section 93, by referring to the color mode table TBL12, determines the type of ink used by an inkjet printer 10 when the inkjet printer 10 executes print processing in a specified color mode c.

FIG. 12 is a view showing one example of a data structure of a color mode table TBL12. As shown in this drawing, the color mode table TBL12 stores a color mode c and a color that an inkjet printer 10 can use in each color mode c in an associated manner.

In this drawing, the symbol "○" means that, in a color mode c in a line that the circle is placed, the color ink denoted in the line that the circle is placed can be used.

Also, in this drawing, the symbol "x" means that, in a color mode c in a line that the x symbol is placed, the color ink denoted in the line that the x symbol is placed cannot be used.

As shown in FIG. 12, the inkjet printer 10 can use a black ink among the basic color inks in the pure black mode, four basic color inks in the basic color mode, two light color inks in addition to four basic color inks in the light and shade color mode, three characteristic color inks in addition to four basic color inks in the characteristic color mode, and all nine color inks in all color mode.

As described above, a user of the printing device 1 specifies a print mode by selecting the setting mode on the print condition specifying screen as shown in FIG. 8 and FIG. 9.

FIG. 13 shows theoretically existing print modes. As described above, a print mode is a combination of five types of setting modes, i.e., a medium mode m (m=1 to 3), an image quality mode g (g=1 to 2), a printing direction mode h (h=1 to 2), a dot type mode d (d=1 to 2) and a color mode c (c=1 to 5). That is, theoretically, as print modes that can be executed by the inkjet printer 10, 3×2×2×2×5=120 patterns of print modes exist.

Hereinafter, as shown in FIG. 13, each of the 120 patterns of print modes (m, g, h, d, c) may be denoted as a combination of five mode numbers.

For example, when a fabric mode (m=3) is specified as the medium mode m, an image priority mode (g=1) is specified as the image quality mode, a single direction mode (h=2) is specified as the printing direction mode h, a 4-bit mode (d=2) is specified as the dot type mode d, and a characteristic color mode (c=4) is specified as the color mode c, the mode numbers of the specified print modes (m, g, h, d, c) are shown as "3 1 2 2 4" as shown in FIG. 13.

Among the 120 patterns of print modes that can be obtained by combining five types of setting modes, there are unsuitable print modes that cannot appropriately execute print processing such as, a mode in which the image quality of the printed image is very poor, a mode in which the recording medium P is contaminated with ink and the print processing itself fails, etc. Further, there are unsuitable print modes in which print processing, contrary to the intent of the user of the printing device 1, such as, a mode in which the image quality is very poor even though an image quality priority mode is selected in the image quality mode g, a mode in which the print speed is extremely slow even though a speed priority mode is selected in the image quality mode g, etc., is executed.

Therefore, it is desired that the user of the printing device 1 avoids specifying such an unsuitable print mode and specifies an appropriate print mode that can appropriately execute print processing in a manner corresponding to the intent of the user.

Therefore, the print mode setting section 91 according to this embodiment judges, based on the evaluation information showing the degree of suitability for executing the print processing of each print mode, the suitability for the user of the printing device 1 to specify each print mode. With this, the print mode setting section 91 prevents unsuitable print modes from being specified by the user of the printing device 1 and prompts the user of the printing device 1 to specify an appropriate print mode.

The mode evaluation table TBL13 stores the evaluation information for each of the 120 patterns of print modes.

FIG. 14 is a drawing showing one example of a data structure of a mode evaluation table TBL13. As shown in this drawing, the mode evaluation table TBL13 stores each of the combinations of five types of setting modes (that is, 120 patterns of print modes) and the evaluation information in an associated manner.

In this embodiment, the evaluation information indicates one of four types of values, i.e., "most suitable" denoting a print mode most suited for executing print processing on a recording medium P to which a print mode is specified, "suitable" denoting a print mode inferior to the most suitable print mode in the degree of suitability but that can appropriately execute printing without inconvenience, "unsuitable" denoting that the print mode is unable to appropriately execute printing, and "limited suitability" denoting a print mode which corresponds to "unsuitable" in the case of color printing but corresponds to "suitable" in the case of monochrome printing.

In addition, in this embodiment, the evaluation information is information having four values, i.e., "most suitable," "suitable," "unsuitable," and "limited suitability," but this is just an example, and for example, the degree of suitability for printing can be information represented by actual values.

In FIG. 14, in the evaluation information, "most suitable" is shown by "◎: double circle," "suitable" is shown by "○: circle," "limited suitability" is shown by "Δ: triangle" and "unsuitable" is shown by "x: x mark." Hereinafter, a print mode having the "most suitable" evaluation information is denoted as "most suitable print mode," a print mode having "suitable" evaluation information is denoted as "suitable print mode," a print mode having "limited suitable print mode" is denoted as "limited suitability print mode," and a print mode having the "unsuitable" evaluation information is denoted as "unsuitable print mode."

In addition, FIG. 14 merely shows an example of a data structure of the mode evaluation table TBL13, and the mode evaluation table TBL13, for example, can store information that identifies each of the 120 patterns of print modes (for example, mode number) and the evaluation information of each print mode one-to-one in an associated manner.

The print mode setting section 91 displays, when an unsuitable print mode "x" is specified in the print condition specifying screen as shown in FIG. 8 and FIG. 9, or when a limited suitability print mode "Δ" is specified even though color printing is specified, a message showing that the specified print mode is unsuitable in the color print display section 101 and prompts the user of the printing device 1 to specify a different print mode. With this, the print mode setting section 91 prevents unsuitable print modes from being specified or limited suitability print mode from being specified in case of color printing. In other words, in the printing device 1 according to this embodiment, for color printing, either the most suitable print mode "◎" or the suitable print mode "○" is specified, and for monochrome printing, one of the most suitable print mode "◎," the suitable print mode "○," and the limited suitability print mode "○" is specified, and printing is executed by the specified print mode.

Further, in the following explanation, for simplicity, assuming a case in which color printing is specified, a case in which the limited suitability print mode is specified is included in a case in which the unsuitable print mode is specified.

Also, the print mode setting section 91 specifies, when the user of the printing device 1 only specifies the medium mode m which is an essential specifying item among the five types of setting modes on the print condition specifying screen, by referring to the mode evaluation table TBL13, a print mode corresponding to the most suitable print mode "◎" among the 40 patterns of print modes including the specified medium mode m. In other words, in the printing device 1 according to this embodiment, when the user of the printing device 1 does not specify a setting mode other than the medium mode m, the most suitable print mode is always specified by the print mode setting section 91.

3. Recording Medium

In this embodiment, the evaluation information is stored in the mode evaluation table TBL 13 in advance.

The values of the evaluation information are determined by comprehensively considering the properties of the operation of the inkjet printer 10 in the specified print mode, the properties of the recording medium P to be subjected to printing, and the properties of ink. Hereinafter, as an antecedent for explaining the content of the evaluation information (value of the evaluation information), the properties of each recording medium P, which must be considered to determine the values of the evaluation information, will be explained.

<3.1. Photograph Paper>

As described above, in this embodiment, as a recording medium P, a photograph paper, a normal paper, and a fabric are assumed. Hereinafter, first, with reference to FIG. 15 and FIG. 16, the properties of the photograph paper among these recording mediums P will be explained.

Figure 15:
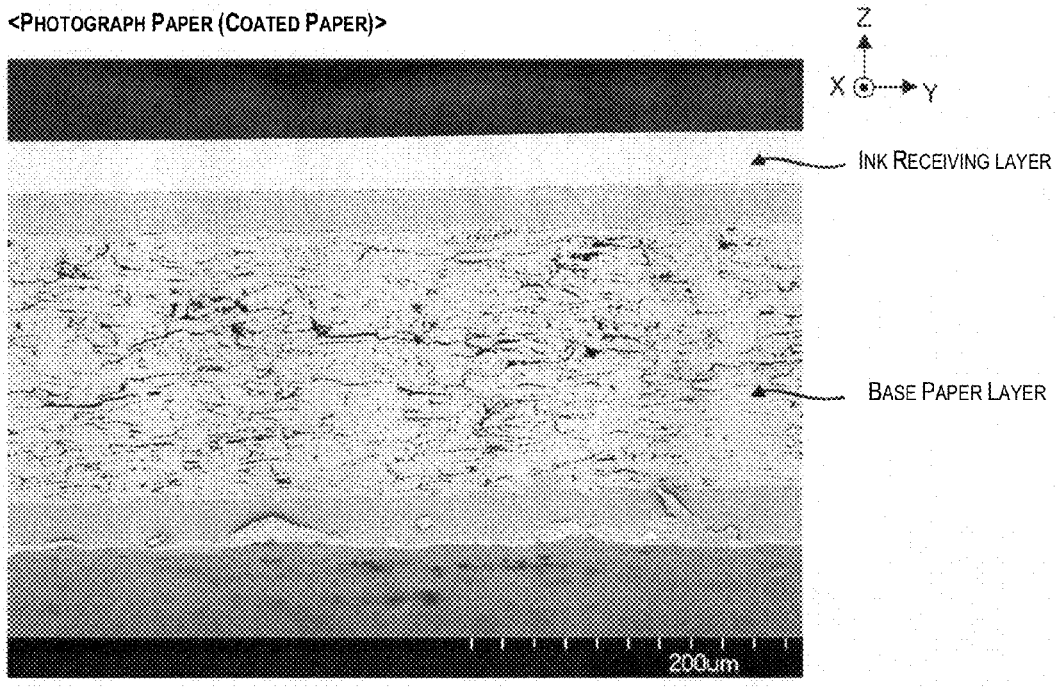
FIG. 15 is a microphotograph showing a cross-section of a coated paper which is one example of a photograph paper.

FIG. 15 is a microphotograph showing a cross-section of a coated paper which is one example of a photograph paper. As exemplified in this drawing, a photograph paper is generally provided with a base paper layer and an ink absorbing layer provided on the surface side of the base paper layer (+Z side).

The ink absorbing layer is a layer that absorbs ink and is coated on the surface side of the base paper layer for retaining the color material in the ink near the surface of the recording medium P, and for example, is constituted to include synthetic silica, etc. The base paper layer is a layer constituted to include a cellulose fiber, polyethylene terephthalate, etc.

Figure 16:
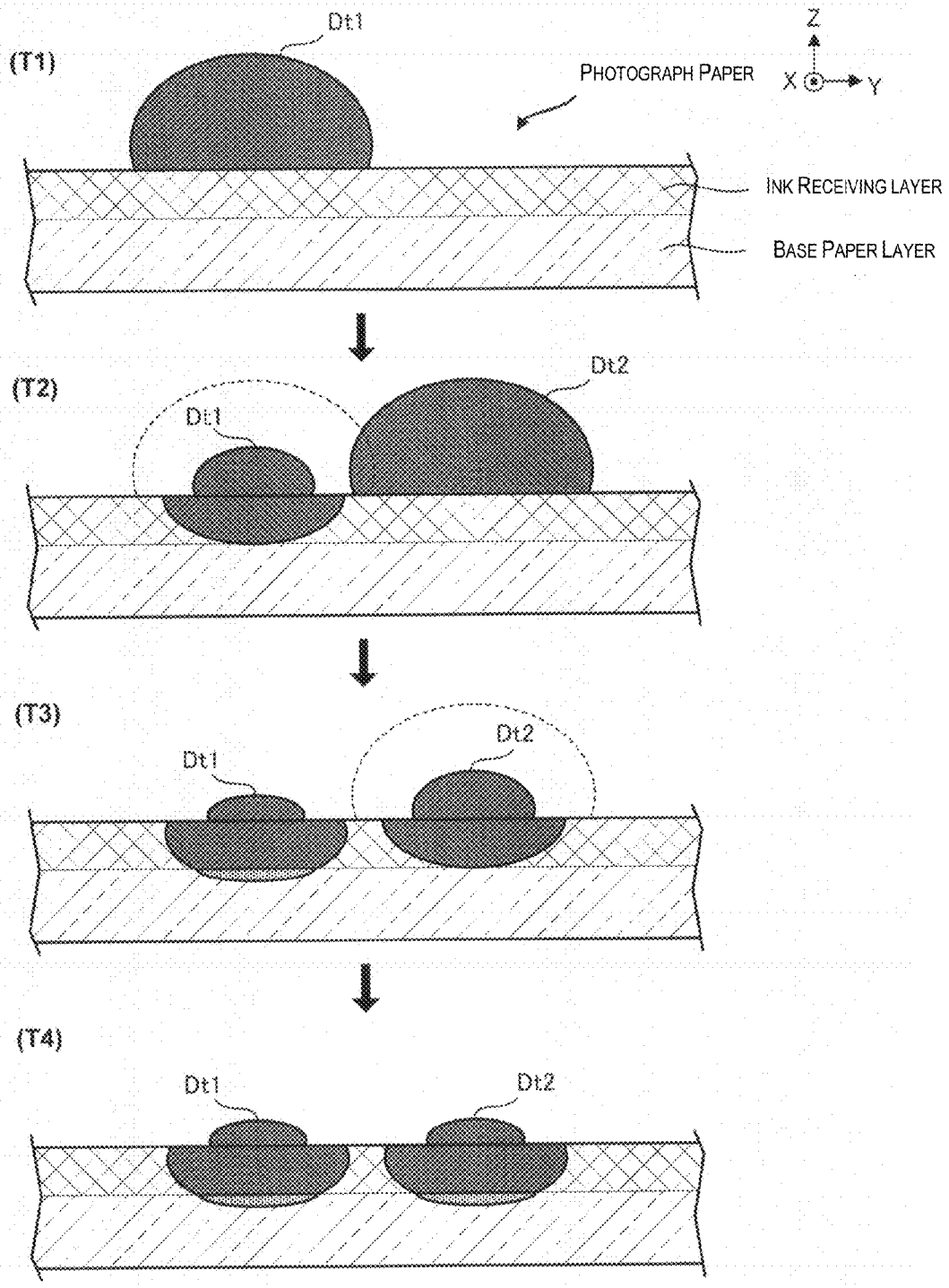
FIG. 16 is an explanatory view for explaining a formation of a dot on a photograph paper.

FIG. 16 is an explanatory view for exemplifying a manner in which a dot Dt1 is formed on a photograph paper and a dot Dt2 is later formed on a pixel adjacent to the pixel on which the dot Dt1 was formed. Here, adjacent pixels include a case in which they are adjacent in the sub-scanning direction, a case in which they are adjacent in the main scanning direction, and a case in which they are adjacent in the diagonal direction between the main scanning direction and the sub-scanning direction.

In an example in this drawing, at time T1, an ink drop forming the dot Dt1 lands on the photograph paper. Then, during a period from time T1 to time T2, most of the ink included in the ink drop for forming the dot Dt1 is absorbed in the ink absorbing layer and the moisture included in the ink drop evaporates, and therefore the volume of the ink drop remaining on the surface of the photograph paper reduces. Therefore, at time T2, even if the ink drop forming the dot Dt2 lands on the photograph paper, the ink drop forming the dot Dt2 and the ink drop forming the dot Dt1 can be prevented from joining. Consequently, it is possible to prevent phenomenon causing deterioration of the image quality such as condensation of ink, which is a state in which the joining of ink drops are continuous.

Generally, the ink absorbing layer is larger in the amount of ink that can be absorbed per unit volume compared to layers other than the ink absorbing layer such as the base paper layer, etc. Therefore, in the example shown in FIG. 16, at time T3, most portion of the ink included in the ink drop forming the dot Dt1 is absorbed in the ink absorbing layer, and at time T4, most portions of the ink included in the ink drop forming the dot Dt2 is absorbed by the ink absorbing layer.

In this way, when a recording medium P is equipped with an ink absorbing layer like a photograph paper, as compared with a case in which the recording medium P does not have an ink absorbing layer, the recording medium P can absorb more ink and a dark color having depth can be reproduced on the recording medium P.

Further, when the recording medium P is equipped with an ink absorbing layer such as a photograph paper, as shown in time T4 in FIG. 16, most portions of the ink included in the ink drop ejected on the recording medium P is retained in the ink absorbing layer. More specifically, since the recording medium P is equipped with an ink absorbing layer, the amount of ink that permeates to the base paper layer provided more inward than the ink absorbing layer can be controlled to be small and it becomes possible to retain the color material of ink around the surface of the recording medium P. With this, it becomes possible to form clear images excellent in color reproducibility.

In addition, in this specification, the spread of ink in the thickness direction (Z-axis direction) of the recording medium P is denoted as "permeation (of ink)," and the spread of ink in the face direction of the recording medium P (direction parallel to the surface including the X-axis and the Y-axis) is denoted as "diffusion (of ink)".

When ink drops are ejected on a base paper layer, since ink spreads in a direction along the fiber included in the base paper layer, the degree of spread of ink is different according to the direction of the fiber. Therefore, when the direction of the fiber of the base paper layer is toward a predetermined face direction (for example, X-axis direction), the ink is widely diffused only in the predetermined face direction extending the ink fiber.

On the other hand, generally, the ink absorbing layer, as compared with the base paper layer, can suppress the degree of the diffusion of ink and make the degree of the spread uniform when ink is diffused. That is, generally, as compared with the base paper layer, since the ink absorbing layer can equalize the spread of ink, it becomes easy to equalize the permeation of the ink in the thickness direction and the diffusion of ink in the face direction to thereby control the ink from excessively spreading only in the predetermined face direction.

Therefore, as shown in FIG. 16, at time T3 and T4 after the ink is absorbed in the recording medium P, it becomes possible to prevent inks forming the dots Dt1 and Dt2 from being mixed inside the recording medium P and reduce the ratio of the ink among the inks forming the dots Dt1 and Dt2 that mix inside the recording medium P.

In this way, when the recording medium P is equipped with an ink absorbing layer such as a photograph paper, as compared with a case in which the recording medium P is not equipped with an ink absorbing layer, the possibility that the inks forming two adjacent dots mix on the surface or inside the recording medium P can be reduced, the amount of mixing of the inks can be suppressed as much as possible, or a phenomenon that the amount of mixing of the inks becomes excessive in a predetermined direction can be controlled from occurring by equalizing the direction of the diffusion of ink as much as possible. Therefore, it becomes possible to form clear images excellent in color reproducibility.

Further, when the recording medium P is equipped with an ink absorbing layer, the permissible amount of absorbable ink is larger as compared with a case in which it is not equipped with an ink absorbing layer. Therefore, the occurrence of a so-called cockling phenomenon that an amount of ink exceeding the permissible amount that can be absorbed by the recording medium P is ejected to cause a wave-like swelling in the recording medium P can be controlled. With this, it becomes possible to accurately land the ink drop ejected from the ejection section D on a targeted position of a pixel, thereby allowing high quality printing.

As described in the following, a photograph paper was developed and produced with the assumption of being used for printing and an ink absorbing layer for absorbing ink is provided, and therefore it becomes possible to form a high quality image while preventing occurrence of the condensation of ink, blurring of ink, cockling phenomenon, etc.

<3.2. Normal Paper>

Next, the properties of a normal paper will be explained. Similarly to a photograph paper, a normal paper is developed and produced with the assumption of being used for printing.

Figure 17:
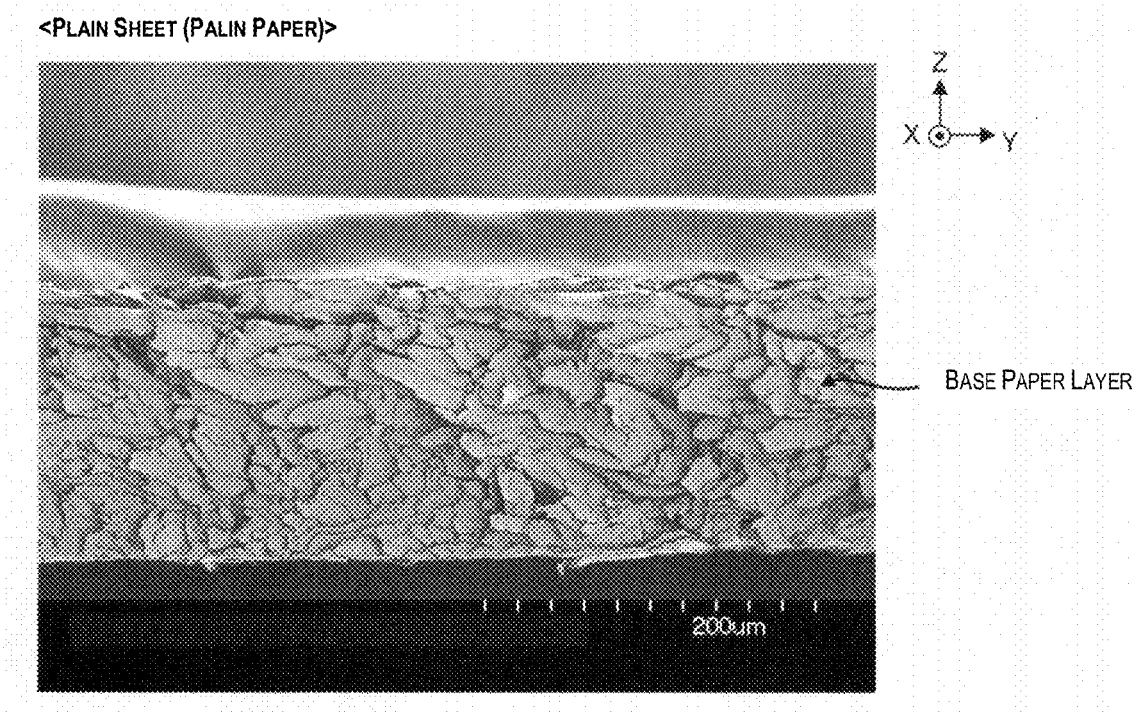
FIG. 17 is a microphotograph showing a cross-section of a plain paper which is one example of a plain sheet.

FIG. 17 is a microphotograph showing a cross-section of a plain paper which is one example of a plain sheet. As exemplified in this drawing, a normal paper is equipped with a base paper layer. However, a normal paper is generally not equipped with an ink absorbing layer, or even when an ink absorbing layer is provided, the thickness of the ink absorbing layer is thinner than a photograph paper. Therefore, in a normal paper, in place of an ink absorbing layer, the base paper layer carries a part or all of the function of absorbing ink.

As described above, generally, in a base paper layer, the amount of absorbable ink per unit volume is small as compared with the ink absorbing layer. Also, since a base paper layer is generally constituted by a fiber, as compared with an ink absorbing layer, it is difficult to control the degree of spreading of ink when the ink is permeated and diffused.

For example, in a normal paper, when the base paper layer is formed with a material in which ink is easily permeated or diffused, as compared with a photograph paper, the color material of the ink permeates deeply inside a recording medium P instead of being retained near the surface of the recording medium P, increasing the possibility that the color of the ink will not be sufficiently reproduced. Also, in a normal paper, ink is diffused exceeding the region of a pixel in which a dot should be formed and the inks of dots formed on adjacent pixels mix, increasing the possibility that colors are blurred.

Also, for example, in a normal paper, when the base paper layer is made with materials that do not easily absorb ink, as compared with a photograph paper, the speed in which the volume of the ink drop ejected onto a surface of the base paper layer decreases is slow, increasing the possibility that inks retained on the surface of a recording medium P condense, and since the absorbed amount of the ink of the recording medium P is small, the possibility that a dark color having a depth cannot be reproduced becomes higher.

In this way, although a normal paper is developed and produced with the assumption of being used for printing, as compared with a normal paper, there are more cases that the image quality of the image to be printed is low.

<3.3. Fabric>

Next, the properties of a fabric will be explained.

A fabric differs from a photograph paper or a normal paper in that many of fabrics are developed and produced aiming for processing on clothing, etc., so comfort, texture, etc., as a clothing are seriously considered. Therefore, generally, a fabric is not provided with an ink absorbing layer for absorbing ink. Consequently, when printing on a fabric, in place of an ink absorbing layer, the fiber of the fabric carries the role of absorbing ink.

However, since the fibers of a fabric are not developed under the assumption to be used for printing, there is an increased possibility that the image quality of the image to be printed may be decreased as compared with, needless to say, a photograph paper as well as a normal paper. Therefore, when printing on a fabric, after sufficiently considering the properties of a fabric, it is desired that print processing is executed so that a certain degree of image quality can be maintained for the image to be printed.

As described above, for a fabric according to this embodiment, natural fibers and chemical fibers are present and their properties are different. Therefore, hereinafter, a natural fiber and a chemical fiber will be explained separately.

<3.3.1. Natural Fiber>

Figure 18:
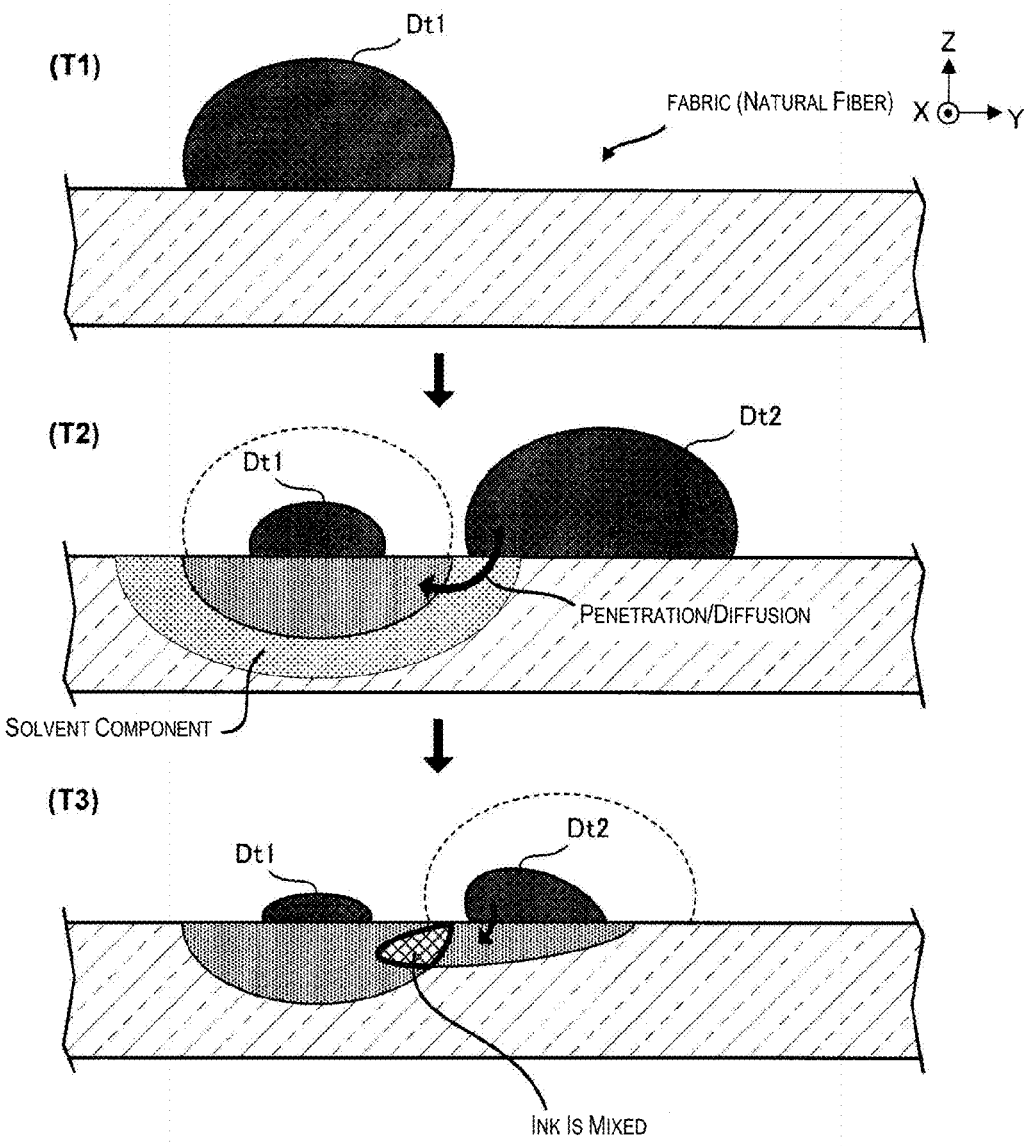
FIG. 18 is an explanatory view for explaining occurrence of blurring of ink on a fabric.

FIG. 18 is an explanatory view for exemplifying a manner in which a dot Dt1 is formed on a natural fiber and a dot Dt2 is later formed on a pixel adjacent to the pixel on which the dot Dt1 was formed.

In an example in this drawing, at a time T1, an ink drop forming the dot Dt1 lands on the natural fiber. Then, during a period from a time T1 to a time T2, most of the ink included in the ink drop for forming the dot Dt1, and especially a solvent component such as the moisture included in an ink drop, etc., is absorbed in the natural fiber. Therefore, at a time T2, when the ink drop forming the dot Dt2 lands on the natural fiber, the ink drop forming the dot Dt2 and the ink diffused on the natural fiber may come into contact. In this case, the ink included in the ink drop forming a dot Dt2, because of osmotic pressure, etc., may diffuse (or permeate) toward a region in which the ink included in the ink drop forming a dot Dt1 in the natural fiber was diffused (especially a solvent component of ink included in the ink drop). Therefore, as shown at a time T3 of FIG. 18, inks included in the ink drop forming dots Dt1 and Dt2 mix together, causing a case in which blurring occurs in a printed image, deteriorating the image quality.

Further, generally, since a natural fiber easily absorbs ink, there are such cases that a so-called "strike-through" occurs, in which ink soaks to the back side of the fabric, etc., and the color material included in the ink cannot be retained near the surface of a recording medium P. In this case, an image having clear colors excellent in color reproducibility cannot be formed, and there is a concern that it causes deterioration in the image quality.

To realize a high quality printing, it is necessary to prevent occurrence of phenomenon causing image quality deterioration as explained above, e.g., blurring caused by diffusion of ink that may occur when printing on a natural fiber, deterioration of color reproducibility due to permeation or strike-through of ink, etc.

Here, in this embodiment, to control at least a part of a phenomenon that causes deterioration of image quality, the following three first to third measures are taken. Hereinafter, these three measures will be explained in order.

The first measure is to reduce the ejection amount of the ink to be ejected by the ejection section D to form one dot.

When the ejection amount of the ink is small, since the ink drop that lands on a recording medium P is also small, the range in which the ink diffuses in the recording medium P also becomes narrow. Therefore, it becomes possible to control blurring of ink due to the wide diffusion of ink in the recording medium P.

Further, when the ejection amount of the ink is small, as compared with a case in which the ejection amount of ink is large, the depth in which the ink included in the ink drop landed on the recording medium P permeates into the recording medium P is shallow. Therefore, it becomes possible to control deterioration of color reproducibility due to the deep permeation of the color material of ink in the recording medium P.

The second measure is to reduce the resolution of the image to be formed on the recording medium P.

When the resolution is low, the distance between two adjacent pixels (dots) becomes long. In this case, even if the ink is widely diffused, the possibility that inks mix together can be kept low, which enables controlling of blurring due to diffusion of ink.

The third measure is to slow down the printing speed. Although the details will be described later, the printing speed is a collective term for a printing speed U, a main scanning printing speed Uy, and a sub-scanning printing speed Ux.

When the printing speed is slow, it becomes possible to extend a period of time from when a certain dot is formed until while a dot adjacent to the dot is formed. In this case, since a portion of a solvent component, such as moisture included in the ink absorbed by the natural fiber, dries up or evaporates, as compared with a case in which the printing speed is fast (the intervals for ejecting the ink is short), the degree of mixing of inks of adjacent dots can be kept low, and even if the ink diffuses widely, the degree of blurring of the image can be kept low.

Figure 19:
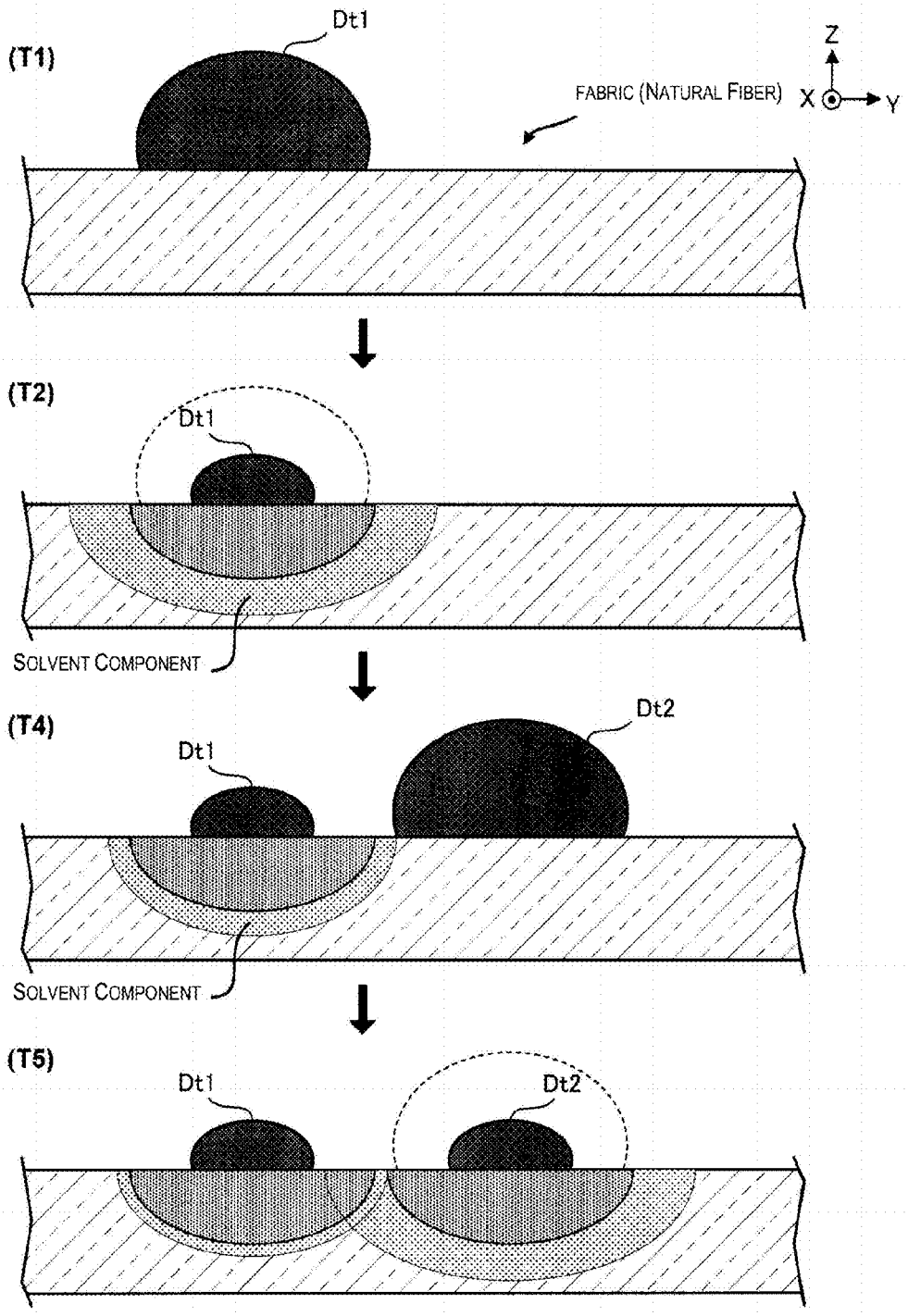
FIG. 19 is an explanatory view for explaining prevention of occurrence of blurring of ink on a fabric.

FIG. 19 is an explanatory view for exemplifying a manner in which a dot Dt1 is formed on a natural fiber and a dot Dt2 is later formed on a pixel adjacent to the pixel on which the dot Dt1 was formed. The example shown in FIG. 19 is similar to the example shown in FIG. 18 except that, rather than landing the ink forming a dot Dt2 at a time T2, the ink drop is landed at a time T4 after the time T2 has passed.

As shown in FIG. 19, the solvent component such as, moisture, etc., included in the ink among the ink forming the dot Dt1 and absorbed by the natural fiber and diffused, dries up and decreases between the time T2 and the time T4. Therefore, rather than the case in which an ink drop forming a dot Dt2 is landed at a time T2 as shown in FIG. 18, in a case in which the ink drop is landed at a time T4 as shown in FIG. 19, among the solvent component of the ink forming the dot Dt1 absorbed by the natural fiber and diffused, the amount of the solvent component that comes into contact with the ink drop forming the dot Dt2 can be reduced. Therefore, as shown in time T5 in FIG. 19, the degree of spread in which the ink included in the ink drop forming the dot Dt2 permeates or diffuses toward the area in which the ink included in the ink drop forming the dot Dt1 is diffused can be decreased. With this, the degree in which inks corresponding to adjacent dots mix together can be reduced, making it possible to control blurring of the image.

<3.3.2. Chemical Fiber>

Next, properties of a chemical fiber will be explained.

Generally, since a chemical fiber, such as, nylon, acryl, polyester, etc., is hard to absorb ink, the volume of a portion of an ink drop that is retained on the surface of a recording medium P is not easily reduced, and as a result, in some cases, ink drops on adjacent pixels may join together, causing condensation.

Figure 20A:
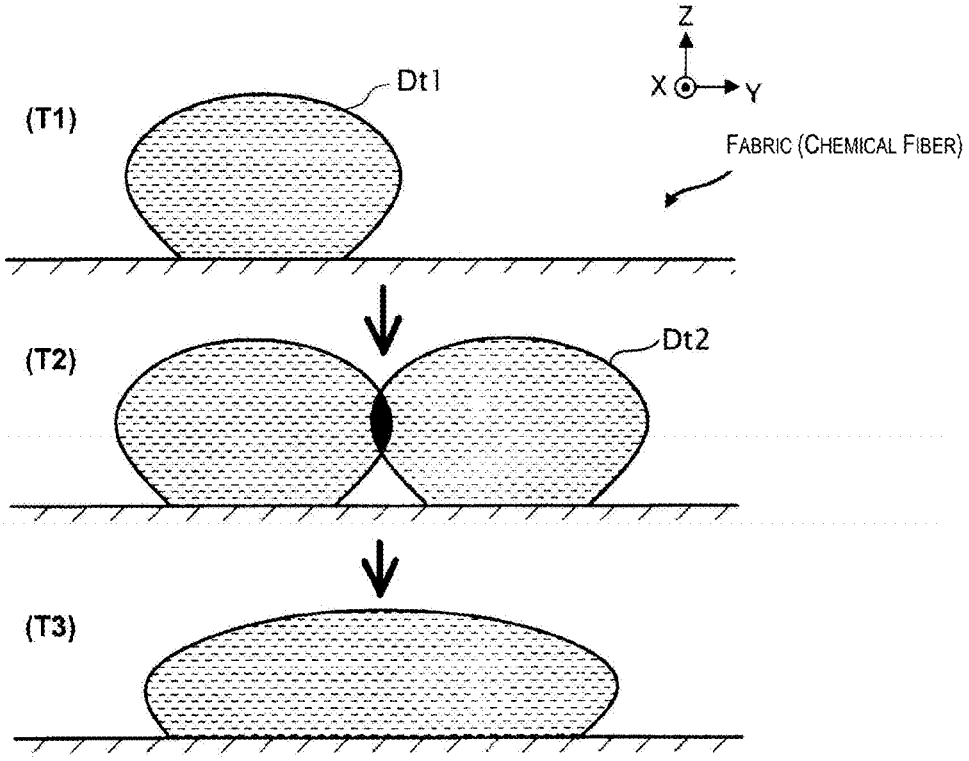
FIGS. 20A and 20B are explanatory views for explaining occurrence of condensation of ink on a fabric and prevention thereof.
Figure 20B:
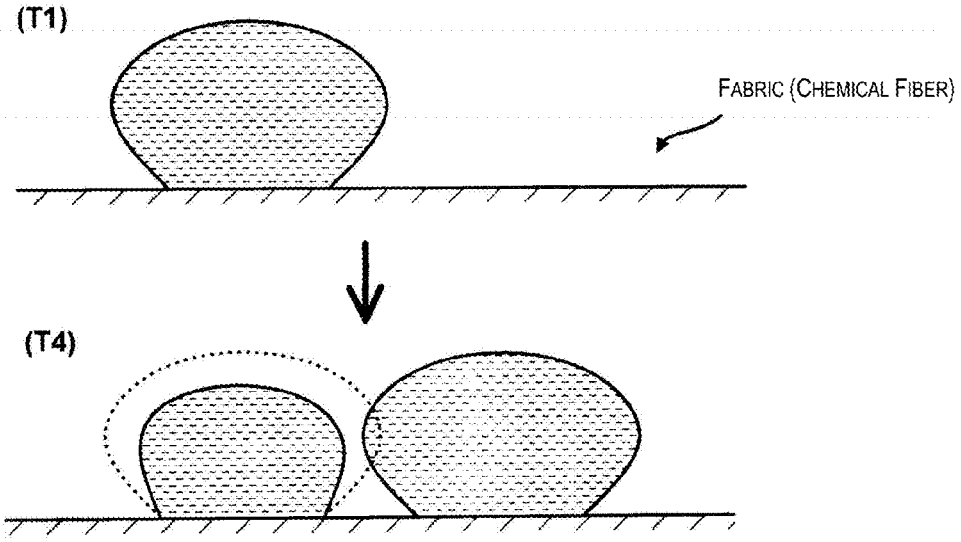

FIGS. 20A and 20B are explanatory views for exemplifying a manner in which a dot Dt1 is formed on a chemical fiber and a dot Dt2 is later formed on a pixel adjacent to the pixel on which the dot Dt1 was formed. FIG. 20A is a drawing illustrating steps in which condensation occurs and FIG. 20B is a drawing illustrating a case in which condensation does not occur.

In the example illustrated in FIG. 20A, at a time T1, an ink drop forming the dot Dt1 lands on the chemical fiber. Then, at a time T2 before the ink drop forming the dot Dt1 becomes small by being absorbed in the chemical fiber or being evaporated, an ink drop forming a dot Dt2 lands. Afterwards, at a time T3, the ink drop forming the dot Dt1 and the ink drop forming the dot Dt2 join together, forming a large ink drop. As a result, condensation of inks which is a state in which the join of ink drops is continuous occurs, which in turn causes deterioration of the print image quality.

As a measure to prevent such condensation of inks that may occur when printing on a chemical fiber, the aforementioned first to third measures for a natural fiber are effective.

That is, by carrying out the first measure to reduce the ejection amount of ink, the distance between two adjacent dots can be increased, and the length of time it takes for an ink, a solvent component, etc., included in an ink drop to be dried can be shortened, and therefore it becomes possible to prevent condensation due to joining of adjacent ink drops.

Also, by carrying out the second measure to decrease the resolution of an image, the distance between two adjacent dots can be increased, and therefore condensation due to the joining of ink drops can be prevented.

Also, by carrying out the third measure to reduce the printing speed, as compared with a case in which the printing speed is fast, since an ink, a solvent component, etc., that is included in an ink drop that landed earlier among the adjacent ink drops becomes smaller by being absorbed by a recording medium P or being evaporated. As a result, the distance between the adjacent dot drops can be increased, which in turn makes it possible to prevent joining of ink drops.

FIG. 20B exemplifies a case in which an ink drop forming a dot Dt1 lands at a time T1 and then an ink drop forming a dot Dt2 lands at a time T4 after a time T2 has passed. As shown in FIG. 20B, the amount of ink within the ink forming the dot Dt1, which is adhered to the surface of a chemical fiber (volume of the ink drop), is reduced between the time T1 and the time T4, so the ink drop of the dot Dt1 becomes small. Therefore, in the case shown in FIG. 20B, as compared with the case shown in FIG. 20A, the possibility that the two ink drops forming the dots Dt1 and Dt2 would join can be reduced. With this, it becomes possible to control the occurrence of condensation.

In addition, condensation may occur in a natural fiber. Therefore, also in a natural fiber, by carrying out the aforementioned first to third measures, occurrence of condensation can be controlled similarly to the case of a chemical fiber.

Further, the aforementioned first to third measures for a fabric can be used as measures to prevent deterioration of image quality in a normal paper.

<3.4. Surface Characteristics of Recording Medium>

Among characteristics of a recording medium P, absorbing characteristics of an ink and measures for deterioration of image quality occurring in association with absorbing characteristics of ink were explained above.

The evaluation information is determined in consideration of absorbing characteristics of ink of a recording medium P as mentioned above. More specifically, the content of the evaluation information is determined by considering whether or not each print mode is appropriately applied with an image deterioration preventative measure associated with ink absorbing characteristics.

Further, in determining the contents of the evaluation information, the characteristics of the recording medium P required to be considered, other than the ink absorbing characteristics of the recording medium P as mentioned above, include the surface characteristics of the recording medium P. Hereinafter, with reference to FIG. 21 and FIGS. 22A and 22B, the surface characteristics of a recording medium P and the measures for deterioration of image quality occurring in association with the surface characteristics of the recording medium P will be explained.

FIG. 21 is a table showing surface characteristics of each recording medium P according to this embodiment, specifically, the general surface roughness, the surface roughness, and the arithmetic mean values of the surface waving. As shown in this drawing, as compared with a normal paper, especially a fabric has a rough surface (that is, the surface is fluffy). Further, terms, definitions, and surface characteristic parameters for describing the surface characteristics (roughness curve, waving curve and cross-sectional curve) are prescribed in "JIS B 0601."

In a recording medium P having rough surface roughness such as a fabric, there is a case in which a fiber constituting the recording medium P reaches the upper surface (+Z side) higher than a nozzle plate 240 and enters inside a nozzle N, and the fiber further comes into contact with an ink filled inside an ejection section D. When the fiber of the recording medium P comes into contact with the ink filled in the ejection section D, there is a case in which the ink propagates to the recording medium P along the fiber, causing contamination of the recording medium P by the ink. In a case in which the recording medium P is contaminated with the ink, the quality of an image to be formed on the recording medium P is deteriorated, and when the contamination is visible by a user of the printing device 1, the print processing itself may fail.

In this embodiment, to prevent such contamination (and deterioration of the print image quality accompanying contamination of the recording medium P) of the recording medium P caused when a fiber of the recording medium P comes into contact with the ink inside an ejection section D, the following fourth measure is carried out.

In the fourth measure, for print processing on a fabric, a meniscus Ms is pulled inside an ejection section D in the +Z direction to be separated from the bottom surface of a nozzle plate 240 (or a recording medium P on a platen 74) (hereinafter, the pull-in of a meniscus Ms in the +Z direction may be referred to as "pull-in of a meniscus position dZ).

Figure 22A:
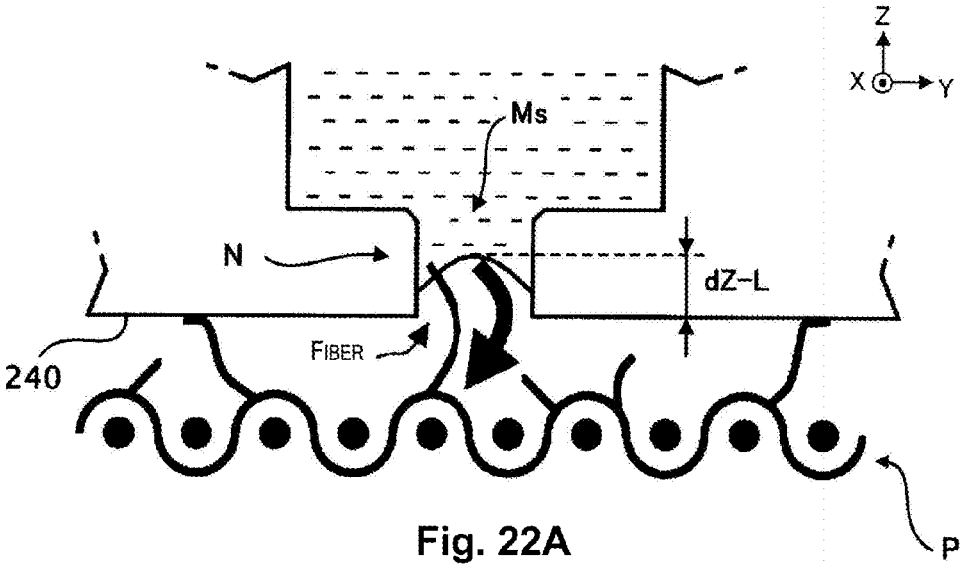
FIGS. 22A and 22B are explanatory views for explaining pull-in of a meniscus position dZ.
Figure 22B:
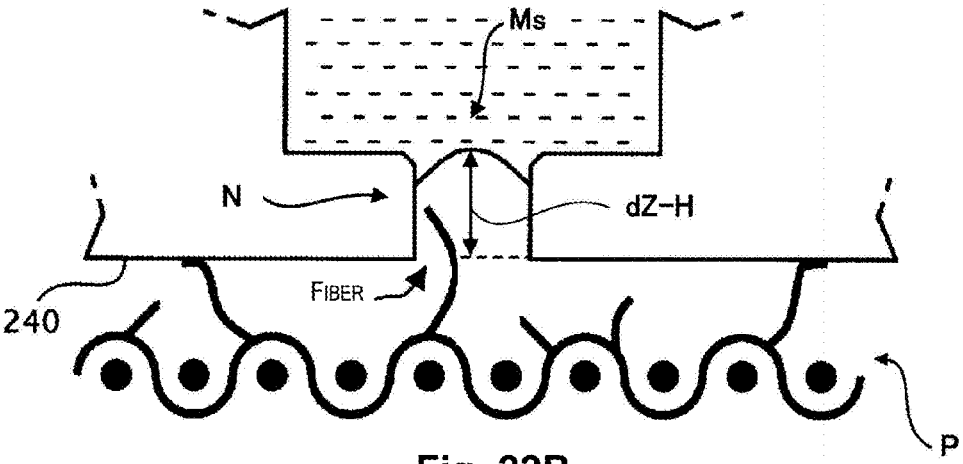

FIGS. 22A and 22B are explanatory views for explaining pull-in of a meniscus position dZ. FIG. 22A shows a case in which the meniscus position dZ is in a low position dZ-L, and FIG. 22B shows a case in which a meniscus position dZ is in a high position dZ-H more on the +Z side than the low position dZ-L.

As shown in FIG. 22A, when the meniscus position dZ is in a low position dZ-L, when a fiber of a recording medium P enters into a nozzle N, the fiber and an ink filled inside the ejection section D come into contact and as a result, the recording medium P is contaminated.

On the other hand, as shown in FIG. 22B, when a meniscus position dZ is pulled in and the meniscus position dZ is in a high position dZ-H, even if a fiber of the recording medium P enters inside a nozzle N, the possibility that the fiber and the ink filled inside the ejection section D come into contact with each other can be kept low and as a result, contamination of the recording medium P can be prevented.

In this way, when the object for printing is a fabric, by carrying out the fourth measure, the contamination of the recording medium P caused by the contact between a fiber of the recording medium P and the ink filled inside the ejection section D can be prevented.

In addition, in this embodiment, the fourth measure is presumed to be carried out only for print processing on a fabric, but the present invention is not limited to that, and for example, the fourth measure can be carried out in print processing on a normal paper, which is a recording medium P having a rough surface roughness, in the same manner as in a fabric.

In the meantime, regarding the surface characteristics of a recording medium P, on the contrary to the contamination of the recording medium P due to an ink inside the ejection section D as described above, a head section 30 (ejection section D) may be contaminated by the recording medium P on which ink was ejected.

Specifically, when executing print processing in a bi-direction mode, after ejecting ink on a recording medium P on a going path, if a fiber of the recording medium P comes into contact with a head section 30 on the returning path, an ink is adhered to the head section 30, contaminating the head section 30, or a fiber itself of the recording medium P to which the ink is adhered may adhere to the head section 30, contaminating the head section 30. When the head section 30 is contaminated, the print image quality may be deteriorated due to the contamination, which in turn requires cleaning of the head section 30 by a recovery mechanism 84, causing a negative effect in which the time needed for print processing is increased.

Such a contamination of the head section 30 by a recording medium P to which an ink was ejected is likely to occur when executing printing on a fabric having a rough surface roughness, especially a natural fiber, in a bi-direction mode.

Therefore, in this embodiment, the following fifth measure is carried out to prevent the negative effect of contamination of the head section 30 by a recording medium P to which an ink was ejected.

The fifth measure is to prohibit the usage of a bi-direction mode in the case of print processing on a fabric.

When carrying out the fifth measure, the inkjet printer 10 is made to eject an ink from an ejection section D only in a going path and return the carriage to a home position (the starting position of printing in the going path) without ejecting an ink from the ejection section D in the returning path. In this case, in the inkjet printer 10, in the returning path, it is not necessary to control the position of the carriage 32 to accurately land ink drops on target positions, and the carriage 32 can simply be moved to the home position.

Therefore, for example, by increasing the moving speed of the carriage 32 in the returning path to a degree that a fiber of the recording medium P cannot adhere to a head section 30, etc., the contamination of the head section 30 by the recording medium P to which an ink was ejected can be prevented.

4. Ink

In print processing, it is preferable that an ink suitable for printing on each recording medium P is used, and the usage of an ink not suited for printing on each recording medium P should be avoided. That is, to execute appropriate print processing by reducing the possibility that the image quality of a printed image is deteriorated or a medium is contaminated by the print processing, it is required that, other than the characteristics of the aforementioned recording mediums P, the characteristics of the inks are considered.

Therefore, in determining the content of the evaluation information, it is required that, other than the characteristics of the aforementioned recording mediums P, the characteristics of ink are considered.

In the meantime, the inkjet printer 10 according to this embodiment uses 9 types (9 colors) of inks divided into three groups, a basic color, a characteristic color, and a light color. When printing a predetermined color in a predetermined region of a recording medium P using the inkjet printer 10, there is a case in which a predetermined color is reproduced by combining the plural types of inks. Normally, there is a plurality of combinations of the inks in this case.

In the following, on the premise of explaining the characteristics of an ink, a method of reproducing a predetermined color by combining plural types of inks will be explained.

FIG. 23 exemplifies the relationship between an ink duty for reproducing a single color and a dot recording rate of each ink. Here, the dot recording rate denotes a probability of a dot being recorded on a pixel. For example, when the dot recording rate is 10%, the dots are recorded at a ratio of 1 pixel for 10 pixels. Further, an ink duty is the product of the dot size (the ratio of the area in which a dot is recorded to the area of a pixel is 100%) and the dot recording rate. That is, an ink duty is a ratio of the area in which a plurality of dots formed in a predetermined area are recorded when the area of a predetermined region to be subjected to printing is 100%, and in other words, it is a value representing the total amount of the ink ejected inside the predetermined area.

Further, in this embodiment, to make it easy to understand, a case in which the dot size is equal to the area of the pixel is assumed.

FIG. 23 is a drawing showing an example of the ways of combining inks for reproducing a certain color. As shown in this drawing, the predetermined color is reproduced by, for example, an ink duty of 80%, a recording rate of cyan of 20%, a recording rate of magenta of 25%, a recording rate of yellow of 35%, and a recording rate of other colors of 0%.

In the meantime, ideally, a color reproduced by a recording rate of cyan of 10%, a recording rate of magenta of 10% and a recording rate of 10% of yellow, and a color reproduced by a recording rate of black of 10% are the same color. Therefore, for example, a color reproduced by combining inks and a color reproduced by reducing the recording rates of cyan, magenta, and yellow from the combination of inks by 5%, respectively, and increasing a recording rate of black by 5% are the same color.

Therefore, in the example illustrated in FIG. 23, the color reproduced when the ink duty is 80% and the color reproduced when the ink duty is 70% become the same color. In the same manner, the color reproduced when the ink duty is 60%, the color reproduced when the ink duty is 50%, and the color reproduced when the ink duty is 40% become the same as the color reproduced when the ink duty is 80%. In this way, to keep the ink duty low, it is understood to just increase the recording rate of black ink.

In reality, when the recording rate of black ink is increased, a problem causing deterioration of image quality such as the increase in a granular quality of the black ink dot, which increases the degree of exposure of the surface of the recording medium P, etc., may occur. Therefore, the recording rate of the black ink is determined in consideration of the tradeoff between such problems and the maximum capacity value of the ink duty of the recording medium P. For example, in a photograph paper having a large absorbing amount of ink, it is preferable that the recording rate of the black ink is reduced to increase the ink duty. On the other hand, in a fabric having a small absorbing amount of ink, it is preferable that the recording rate of black ink is increased to reduce the ink duty.

Further, in this example, the color reproduced by the recording rate of cyan of 10% and the color reproduced by the recording rate of light cyan of 20% become the same color, and the color reproduced by the recording rate of magenta of 10% and the color reproduced by the recording rate of light magenta of 20% become the same color.

Therefore, for example, the color reproduced by combining certain inks and the color reproduced by reducing the recording rates of cyan, magenta, and yellow from the combination of the certain inks by 10%, respectively, and increasing the recording rates of light cyan and light magenta by 20% become the same color. Therefore, in the example shown in FIG. 23, the color reproduced when the ink duty is 80% and the color reproduced when the ink duty is 100% become the same color.

In this way, it is understood that the ink duty is increased when the recording rate of light color ink is increased, and the ink duty is decreased when the recording rate of light color ink is decreased.

When using a light color ink, it is possible to provide more detailed increments of gradations of the image to be printed (increase the number of the gradation) to improve the image quality of the image to be printed. Also, by using a light color ink to improve the ink duty, the granular quality of ink drops can be reduced, thereby reducing the degree of exposure of the surface of the recording medium P.

However, when a light color ink is used, ink duty is increased, causing a case in which an ink amount absorbable by the recording medium P is exceeded. Especially when a light color ink is used for a fabric not provided with an ink absorbing layer, there is a high possibility to cause deterioration in image quality, such that ink drops join on the surface of the recording medium P, causing condensation, inks mix inside the recording medium P, causing blurring, or inks permeate too deeply to cause a strike-through, etc., decreasing the color reproducibility.

Therefore, in this embodiment, the following sixth measure is carried out to prevent deterioration of image quality due to the usage of light color ink.

The sixth measure is to not use a light color ink for print processing on a fabric.

That is, the sixth measure is to prohibit the usage of a light and shade color mode and all color mode for print processing on a fabric.

Further, in this embodiment, a light color ink, compared to a basic color ink or a characteristic color ink, is a collective term of ink having a higher content of a solvent component such as moisture, etc., included in the ink (for example, an ink in which the weight ratio of the solvent component contained to the whole ink is high). Therefore, to describe more generally, it can be expressed that the sixth measure is to reduce the content of the solvent component such as moisture, etc., included in the ink used for print processing on a fabric (reduce the weight ratio of the solvent component contained to the whole ink).

When the content of the solvent component in the ink is low, as compared with the case in which the content rate of the solvent component is high, a range in which the ink (especially the solvent component of the ink) permeates or diffuses in the recording medium P can be narrowed. With this, blurring due to wide diffusion of ink, deterioration of color reproducibility due to deep permeation of ink, etc., can be controlled.

As described above, in this embodiment, in a fabric mode, to reduce occurrence of phenomenon leading to the decrease in image quality such as condensation of ink, blurring of ink, deterioration of color reproducibility due to the permeation of ink, etc., as compared with a photograph paper mode or a normal paper mode, measures such as widening the intervals between dots, reducing the maximum dot forming ink amount W, etc., are carried out. Therefore, in a fabric mode, as compared with other medium modes m, when forming a plurality of dots having different colors using plural types of inks, the possibility that a user of the printing device 1 cannot see the plurality of dots as one increases. In this case, in a fabric mode, as compared with a photograph paper mode or a normal paper mode, it becomes more difficult to reproduce (make visible) a color different (intermediate color) from the plural types of inks by forming a plurality of dots having different colors using a plural types of inks having different colors. In other words, when executing print processing on a fabric using plural types of inks, as compared with the case in which print processing is executed on a photograph paper or a normal paper using the plural kids of inks, it becomes more difficult to increase the color gamut (gamut) in the color space defined by the plural kinds of inks being used and further, to increase the number of gradations of the image to be printed. In this way, when the type of ink used in a fabric mode and the other medium modes m are the same, in a fabric mode, as compared with the other medium modes m, there is a high possibility that the color reproducibility of the image to be printed becomes poor, causing deterioration of image quality.

Further, when carrying out the sixth measure (when a light color ink is not used in a fabric mode), since the light color ink used in a photograph paper mode or a normal paper mode cannot be used in a fabric mode, the number of gradations represented in a fabric mode becomes less than the number of gradations represented in a photograph paper mode or a normal paper mode. In this case, the inclination that the color reproducibility in a fabric mode is poorer as compared with other medium modes m becomes even clearer.

Therefore, in this embodiment, for the purpose of preventing the negative effect of deterioration of the color reproducibility, etc., caused by carrying out the sixth measure, in which a light color ink is not used on a fabric, the following seventh measure is carried out.

The seventh measure is to use a characteristic color ink at least in print processing on a fabric. That is, the seventh measure is to employ a characteristic color mode in the case of print processing on a fabric.

When using a characteristic color ink, as compared with the case in which it is not used, it becomes possible to increase the color gamut (gamut) representable as an image in a color space. For example, when using a green ink, which is a complimentary color to yellow, a representable color gamut can be increased between cyan and magenta.

Further, even when not using a light color ink, when using a characteristic color ink, detailed gradation increments can be made in the same manner as the case in which a light color ink is used. For example, when using two characteristic color inks in addition to a basic color ink of CMY, it becomes possible to represent magenta corresponding to a coordinate axis between the two coordinate axes representing the two characteristic colors in the color space by a magenta ink, and also becomes possible to represent the magenta by the two characteristic color inks. Therefore, when a green ink and a violet ink are used, even when a light magenta ink is not used, in a similar manner as a case in which light magenta is used, it becomes possible to express the gradation in which the increments in the number of gradations in magenta is more detailed.

In this way, by using a characteristic color ink when printing on a fabric, the representable color gamut (gamut) in the color space can be increased and the number of representable gradations can be increased, making it possible to print high quality images having sufficient color reproducibility similar until when printing on a paper medium.

In addition, also in print processing on a photograph paper or a normal paper, the number of gradations can be increased by using a characteristic color ink. Therefore, in view of improving the color reproducibility, it is preferable that the characteristic color ink is used for a photograph paper and a normal paper.

However, as described above, in a normal paper, the absorbable ink amount is small compared to a photograph paper. Therefore, in print processing on a normal paper, when a characteristic color ink is used in addition to a basic floor ink and a light color ink (that is, when all inks in the three color groups are used), the ink amount may sometimes exceed the absorbable ink amount in a normal paper. In this case, the possibility of occurring condensation, blurring, cockling phenomenon, etc., increases, which may leads to deterioration in image quality.

Further, in a normal paper, as compared with a fabric, it is easy to reproduce a color different from plural types of inks by forming a plurality of dots having different colors using the plural types of inks having different colors. Therefore, in print processing on a normal paper, sufficient color reproducibility can be secured even if only ink from one color group or two color groups is used, such as only using a basic color ink, using a basic color ink and a characteristic color ink, or using a basic color ink and a light color ink.

Here, in this embodiment, in print processing on a normal paper, to prevent negative effects such as condensation, blurring, cackling phenomenon, etc., caused by using a basic color ink, a characteristic color ink, and a light color ink concurrently, the following eighth measure is carried out.

The eighth measure is, in print processing on a normal paper, to avoid combined usage of inks for three color groups, the basic color ink, the characteristic color ink, and the light color ink. That is, the eighth measure is to prohibit the usage of all color modes in the case of print processing on a normal paper.

By carrying out the eighth measure, negative effects such as condensation, blurring, cockling phenomenon, etc., can be prevented, and when inks from two color groups are used concurrently, the number of gradations of an image to be printed can be increased.

As explained above, by considering the characteristics of inks and the image quality deterioration preventative measures (sixth to eighth measures) associated with the characteristics of inks, the evaluation information can be appropriately determined.

When carrying out the aforementioned sixth to eighth measures, there is a case in which a different color mode c is used for each recording medium P. When the color modes are different, the types of inks used in print processing differ, so even in the case of reproducing a certain color, there is a case in which the types of inks to be used and the recording rate of each ink is different.

Therefore, in this embodiment, for every color mode c, a color conversion table LUT (see FIG. 1) is provided. More specifically, in this embodiment, since there are five types of color modes c (c=1 to 5), five color conversion tables LUT corresponding one-to-one the aforementioned color modes are provided.

Further, the color conversion section 93, by referencing a color conversion table LUT corresponding to a color mode c set by the print mode setting section 91 (color mode c specified on a print condition specifying screen, etc.), converts the data of the color of an image expressed by image data Img into data expressed in a color space defined by ink colors used by the inkjet printer 10.

5. Operation Set Information

As described above, the evaluation information is designed by considering, in addition to the characteristics of the recording medium P and inks, the characteristics of the operation of the inkjet printer 10.

Hereinafter, the operation set information defining the characteristics of the operation of the inkjet printer 10 will be explained.

The operation set information is information defined by considering measures associated with the characteristics of the aforementioned recording mediums P, especially the first to fourth measures, and is stored in the operation set information table TBL14 in advance.

The print mode setting section 91 of the print data generating section 90, when a print mode is specified, accesses the operation set information table TBL14 and obtains operation set information corresponding to the specified print mode. Then, the print data generating section 90 generates print data PD based on information relating to the print mode set by the print mode setting section 91 and the operation set information obtained by the print mode setting section 91. With this, the inkjet printer 10 executes print processing based on the information relating to the print mode and the operation set information.

FIG. 24 is a view showing one example of a data structure of an operation set information table TBL14. As shown in this drawing, the operation set information table TBL14 stores the print modes and the operation set information corresponding to the print modes in an associated manner.

In this embodiment, the operation set information is set, among the print modes, for each combination of the medium mode m, the image quality mode g, and a dot type mode d. Therefore, in this embodiment, the operation set information table TBL14 stores, among the print modes, the combination of three types of setting modes other than the printing direction mode h and the color mode c and the operation set information in a one-to-one corresponding manner. In this drawing, among the mode numbers, the printing direction mode h and the color mode c are represented by variables. For example, in this drawing, when a photograph paper mode (m=1) is specified as a medium mode m, the image priority mode (g=1) is specified as an image quality mode, and the dot type mode d is specified as 4-bit mode (d=2), the mode number (m, g, h, d, c) is shown as "11*h*2*c*." In this case, the mode number "11*h*2*c*" includes a case in which the printing direction mode h is both "1" and "2" and the color mode c is any of "1" to "5."

As shown in FIG. 24, in this embodiment, the operation set information includes a maximum dot formation ink amount W, a resolution R, a driving frequency F, the number of overlap S, and a meniscus position dZ.

Hereinafter, the contents of the operation set information and the setting conditions of each value of the operation set information will be explained.

<5.1. Maximum Dot Formation Ink Amount>

First, among the operation set information, the maximum dot formation ink amount W will be explained.

The maximum dot formation ink amount W is a maximum value of an ink amount (weight or volume of ink) ejected in a region corresponding to one pixel of the recording medium P.

In this embodiment, there are plural methods for recording pixels on a recording medium P. Specifically, as the first method, there is a method in which one dot is formed by ejecting an ink drop only once from an ejection section D in a region corresponding to a pixel. Further, as the second method, there is a method in which one dot is eventually formed on a region corresponding to a pixel by ejecting ink drops from the ejection section D two or more times to be landed to thereby cause joining of the landed two or more ink drops. Further, as the third method, there is a method in which two or more drops are eventually formed on a region corresponding to pixels by ejecting ink drops from the ejection section D two or more times to be landed without causing joining of these landed two or more ink drops. That is, the third method is a case that in the second method a part or all of the two or more landed ink drops do not join.

Here, to distinguish between a dot finally formed corresponding to each pixel one-to-one to express one image and a dot temporarily formed in the previous step of forming a dot corresponding to a pixel one-to-one, the former will be referred simply as a "dot" and the latter will be referred as a "temporary dot."

More specifically, in the first method, one dot formed on a region corresponding to a pixel by ejecting an ink drop only once from an ejection section D corresponds to the "temporary dot" as well as a "dot." Further, in the second method, each of the two or more dots temporarily formed on regions corresponding to pixels by ejecting ink drops two or more times from an ejection section D corresponds to the "temporary dots," and the one dot finally formed when these two or more temporary dots join corresponds to the "dot." Furthermore, in the third method, each of the two or more dots formed on a regions corresponding to pixels by ejecting ink drops two or more times from an ejection section D corresponds to the "temporary dots," and the aggregation of these two or more temporary dots corresponds to the "dot." That is, in the third method, the "dot" includes a plurality of temporary dots. In addition, the inkjet printer 10 according to this embodiment, in the case of ejecting ink drops two or more times from the ejection section D, the inks are ejected so that the two or more temporary dots to be formed in the region corresponding to a pixel join. In other words, in the inkjet printer 10 according to this embodiment, as a pixel recording method, among the aforementioned first to third methods, the first and the second method are used. However, the inkjet printer 10 may employ the third method as the pixel recording method.

In this way, in this embodiment, one dot is finally formed so as to correspond one-to-one to a region corresponding to one pixel. Also, one dot is formed by one dot or a plurality of temporary dots.

As it is apparent from these explanations, in this embodiment, the maximum dot formation ink amount W denotes a maximum value of an ink amount to be ejected to form one dot (the former "dot"). Further, the dots Dt1 and Dt2 explained with reference to FIG. 16 and FIGS. 18 to 20 refer to the former "dot," but may also refer to the latter "temporary dot."

Hereinafter, the maximum dot formation ink amount W corresponding to the 12 mode numbers shown in FIG. 24 (11*h*1*c*, 11*h*2*c* . . . 32*h*2*c*) are shown as "W1" to "W12."

The maximum dot formation ink amount W is determined by considering the aforementioned first measure.

As described above, the first measure is to reduce the ejection amount of ink for forming one dot to prevent deterioration of image quality due to negative effects such as blurring of ink, deterioration of color reproducibility, condensation of ink drops, etc. A photograph paper is provided with an ink absorbing layer, on the other hand, a fabric is not provided with an ink absorbing layer, and a normal paper absorbs ink in the base paper layer. Therefore, the degree of deterioration of image quality when the ejection amount of ink is increased is highest in the case of printing on a fabric and lowest in the case of printing on a photograph paper. For this reason, the necessity for carrying out the first measure is highest in the case of printing on a fabric and lowest in the case of printing on a photograph paper.

Therefore, in this embodiment, the maximum dot formation ink amount W in a fabric mode is determined so that the maximum dot formation ink amount W becomes less than the maximum dot formation ink amount W in a photograph paper mode or a normal paper mode (hereinafter, the setting condition will be referred to as "first condition").

Specifically, as shown in FIG. 24, the maximum dot formation ink amounts W in a fabric mode (W9 to W12) are set to be less than the maximum dot formation ink amounts W in a normal paper mode (W5 to W8), and the maximum dot formation ink amounts W in a normal paper mode (W5 to W8) are set to be less than the maximum dot formation ink amounts W in a photograph paper mode (W1 to W4).

More specifically, in this embodiment, the maximum value of the maximum dot formation ink amount W in a fabric mode is set to be smaller than the minimum value of the maximum dot formation ink amount W in a normal paper mode, and the maximum value of the maximum dot formation ink amount W in a normal paper mode is set to be smaller than the minimum value of the maximum dot formation ink amount W in a photograph paper mode. In the example of this drawing, the maximum value of the maximum dot formation ink amount W in the case of a fabric mode is W12 (14 nanograms), and the minimum value of the maximum dot formation ink amount W in a normal paper mode is W5 (16 nanograms).

Further, the maximum value of the maximum dot formation ink amount W in the case of a normal paper mode is W8 (22 nanograms), and the minimum value of the maximum dot formation ink amount W in a photograph paper mode is W3 (24 nanograms).

However, the method of determining the maximum dot formation ink amount W according to the "first condition" is not limited to above. For example, it can be determined such that the maximum value of the maximum dot formation ink amount W in a fabric mode become equal to or less than the minimum value of the maximum dot formation ink amount W in a photograph paper mode and also becomes equal to or less than the minimum value of the maximum dot formation ink amount W in a normal paper mode. That is, the maximum dot formation ink amount W can be set without considering the relationship between the maximum dot formation ink amount W in a photograph paper mode and the maximum dot formation ink amount W in a normal paper mode, or the maximum dot formation ink amount W can be set so as to include a case in which the maximum dot formation ink amount W in a fabric mode is equal to the minimum value of the maximum dot formation ink amount W in a photograph paper mode or equal to the minimum value of the maximum dot formation ink amount W in a normal paper mode.

Further, the maximum dot formation ink amount W can be set so that, for example, when the setting modes other than the medium mode m are the same, the maximum dot formation ink amount W in a fabric mode becomes equal to or less than the maximum dot formation ink amount W in a photograph paper mode and also equal to or less than the maximum dot formation ink amount W in a normal paper mode. For example, the maximum dot formation ink amount W can be set so that the maximum dot formation ink amounts W (W1, W5, W9) corresponding to the mode numbers "11*h*1*c*," "21h1*c*," and "31h1*c*" satisfy "W9≤W1" and "W9≤W5."

In this embodiment, the maximum dot formation ink amounts W are set so as to satisfy the first condition for corresponding to the first measure as well as various conditions for improving the image quality.

Specifically, in this embodiment, in a photograph paper mode, the maximum dot formation ink amount W is set so that the maximum dot formation ink amount W in an image quality priority mode becomes an amount over the maximum dot formation ink amount W in the case of a speed priority mode (hereinafter, the setting condition will be referred to as "second condition").

Since a photograph paper is provided with an ink absorbing layer, the absorbable ink amount is large. When the ink absorbing layer absorbs a large amount of ink, as compared with a case in which a small amount of ink is absorbed, a color having more depth can be reproduced.

Therefore, in a photograph paper, in the case of the image quality priority mode which prioritizes an image quality than a print speed, as compared with the case of a speed priority mode, by ejecting a larger amount of ink on a region corresponding to each pixel to enable reproduction of colors having more depth, a high quality image is printed.

Further, in this embodiment, in a normal paper mode and a fabric mode, the maximum dot formation ink amount W is set so that the maximum dot formation ink amount W in an image quality priority mode becomes an amount equal to or less than the maximum dot formation ink amount W in the case of speed priority mode (hereinafter, the setting condition will be referred to as "third condition").

A normal paper or a fabric is smaller in absorbable ink amount as compared with a photograph paper. Therefore, when a large amount of inks is ejected, the possibility of occurrence of condensation, blurring, etc., increases, deteriorating the image quality. Therefore, in a normal paper and a fabric, in the case of the image quality priority mode, as compared with the case of a speed priority mode, by decreasing an amount of ink to be ejected on a region corresponding to each pixel, a high quality image is printed, in which the possibility of occurrence of condensation, blurring, etc., is controlled.

Further, in this embodiment, in cases where the medium mode m and the image quality mode g are the same, the maximum dot formation ink amount W is set so that the maximum dot formation ink amount W in a 2-bit mode becomes an amount equal to or less than the maximum dot formation ink amount W in the case of a 4-bit mode (hereinafter, the setting condition will be referred to as "fourth condition").

Although details will be explained later, in this embodiment, the resolution R in the 2-bit mode is set so that the resolution R is higher than the resolution R in the 4-bit mode. Therefore, in this embodiment, the maximum dot formation ink amount W in the case of 2-bit mode, that is, when the resolution R is high, is set to be equal to or less than the maximum dot formation ink amount W in the 4-bit mode, that is, when the resolution R is low, to thereby prevent adjacent ink drops from coming too close to each other in the 2-bit mode to thereby lower the possibility of occurrence of condensation, blurring, etc.

<5.2. Resolution>

Next, among the operation set information, the resolution R will be explained.

A resolution R, in this specification, is defined as the number of pixels per unit area, that is, the number of dots capable of ultimately being formed per unit area. Further, the resolution Ry in the main scanning direction (hereinafter simply referred to as "resolution Ry") is defined as the number of dots capable of ultimately being formed per unit length in the main scanning direction, and the resolution Rx in the sub-scanning direction (hereinafter simply referred to as "resolution Rx") is defined as the number of dots capable of ultimately being formed per unit length in the sub-scanning direction. That is, in this specification, the resolution R is defined as "(Resolution Ry)×(Resolution Rx)." Further, hereinafter, the case in which the "unit length" is 1 inch and the "unit area" is 1 square inch will be exemplified for explanation.

Hereinafter, the resolutions R corresponding to the 12 mode numbers shown in FIG. 24 (11*h*1*c*, 11*h*2*c*, 32*h*2*c*) are shown as "R1" to "R12."

The resolution R is determined by considering the aforementioned second measure.

As described above, the second measure is to reduce the resolution R of an image to be formed on a recording medium P to prevent deterioration of an image quality due to negative effects such as blurring of ink, condensation of ink drops, etc. The possibility of occurrence of blurring due to diffusion of inks, condensation due to joining of ink drops, etc., is the highest when printing on a fabric and lowest when printing on photograph paper. Therefore, the necessity for carrying out the second measure is highest when printing on a fabric and lowest when printing on a photograph paper.

Therefore, in this embodiment, the resolution R is set so that the resolution R in a fabric mode becomes lower than the resolution R in a photograph paper mode or a normal paper mode (hereinafter, the setting condition will be referred to as "fifth condition").

Further, as described above, the resolution R is "(Resolution Ry×(Resolution Rx)." Therefore, to lower the resolution R in one medium mode m (for example, a fabric mode) than the resolution R in other medium modes m (for example, a photograph paper mode), it is required that at least one of a condition in which the resolution Ry in one medium mode m is set to be lower than the resolution Ry in another medium mode m, or a condition in which the resolution Rx in one medium mode m is set to be lower than the resolution Rx in another medium mode m is satisfied. Therefore, in this embodiment, to define the resolution R so as to satisfy the fifth condition, the resolution Ry and the resolution Rx are defined so that at least one of the conditions, the condition in which the resolution Ry in a fabric mode is set to be lower than a resolution Ry in a photograph paper mode or a normal paper mode, or a condition in which the resolution Rx in a fabric mode is set to be lower than the resolution Rx in a photograph paper mode or a normal paper mode.

Hereinafter, details of the aforementioned fifth condition will be explained. Further, the following explanation is directed to the resolution R, but this explanation can also be applied to the resolution Ry and the resolution Rx.

In this embodiment, the fifth condition, as shown in FIG. 24, is to define the resolution R such that the resolution R (R9 to R12) in a fabric mode becomes lower than the resolution R in a photograph paper mode (R1 to R4) and the resolution R (R5 to R8) in a normal paper mode. More specifically, the maximum value of the resolution R in a fabric mode is set to be smaller than the minimum value of the resolution R in a photograph paper mode and the minimum value of the resolution R in a normal paper mode. In the example in this drawing, the maximum value of the resolution R in the case of a fabric mode is R9 (800×800 dpi), the minimum value of the resolution R in the case of a photograph paper mode is R4 (1000×1000 dpi), and the minimum value of the resolution R in the case of a normal paper mode is R8 (900×900 dpi).

However, the method of determining the resolution R according to the "fifth condition" is not limited to above. For example, the resolution can be set such that the maximum value of the resolution R in a fabric mode becomes equal to or less than the minimum value of the resolution R in a photograph paper mode and also becomes equal to or less than the minimum value of the resolution R in a normal paper mode.

Further, the resolution R can be set, for example, considering the relationship between a photograph paper mode and a normal paper mode, so that the maximum value of the resolution R in a fabric mode becomes equal to or less than the minimum value of the resolution R in a normal paper mode, and the maximum value of the resolution R in a normal paper mode also becomes equal to or less than the minimum value of the resolution R in a normal paper mode.

Further, the resolution R can be set, for example, when the setting modes other than the medium mode m are the same, so that the resolution R in a fabric mode becomes equal to or less than the resolution R in a photograph paper mode and also becomes equal to or less than the resolution R in a normal paper mode. For example, the resolution R can be set so that the resolutions R (R1, R5, R9) corresponding to the mode numbers "11*h*1*c*," "21*h*1*c*," and "31*h*1*c*" satisfy "R9≤R1" and "R9≤R5."

Further, in this embodiment, the resolutions R are set so as to satisfy, in addition to the fifth condition for corresponding to the second measure, the following various conditions.

Specifically, in this embodiment, in each medium mode m, the resolution R is set so that the resolution R in the image quality priority mode becomes equal to or higher than the resolution R in the case of a speed priority mode (hereinafter, the setting condition will be referred to as "sixth condition"). In the case of an image quality priority mode in which a priority is given to an image quality than a printing speed, compared to a case of a speed priority mode, by increasing the resolution R, it becomes possible to print an image with high resolution.

Further, in this embodiment, in a case in which the medium mode m and the image quality mode g are the same, the resolution R is set so that the resolution R in a 2-bit mode becomes equal to or higher than the resolution R in the case of a 4-bit mode (hereinafter, the setting condition will be referred to as "seventh condition").

As described above, in the 2-bit mode, each dot is expressed in two gradations, and in the 4-bit mode, each dot is expressed in four gradations. Therefore, in this embodiment, it is possible to increase the image quality in a 2-bit mode to the same degree as the image quality in a 4-bit mode by increasing the resolution R in a 2-bit mode than the resolution R in the 4-bit mode.

<5.3. Driving Frequency>

Next, among the operation set information, a driving frequency F will be explained.

A driving frequency F is the number of dots formable per unit time by one ejection section D. As the driving frequency F increases, the number of dots formable per unit time by one ejection section D increases, and the print speed improves.

Hereinafter, the driving frequency F corresponding to the 12 mode numbers (11*h*1*c*, 11*h*2*c*, . . . , 32*h*2*c*) shown in FIG. 24 are shown as "F1" to "F12."

The driving frequency F is determined by considering the aforementioned third measure.

As described above, the third measure is to slow down the print speed to prevent deterioration of image quality due to negative effects such as blurring of ink, condensation of ink drops, etc. The possibility of occurrence of blurring caused by diffusion of inks, condensation due to joining of inks, etc., is the highest in the case of printing on a fabric and the lowest in the case of printing on photograph paper. Therefore, the necessity for carrying out the third measure is highest in the case of printing on a fabric and the lowest in the case of printing on a photograph paper.

Therefore, in this embodiment, the driving frequency F is set so that the driving frequency F in a fabric mode becomes lower than the driving frequency F in a photograph paper mode or a normal paper mode (hereinafter, the setting condition will be referred to as "eighth condition").

Specifically, as shown in FIG. 24, the driving frequency F in a fabric mode (F9 to F12) is set to be lower than the driving frequency F in a photograph paper mode (F1 to F4) and also set to be lower than the driving frequency F in a normal paper mode (F5 to F8). More specifically, the maximum value of the driving frequency F in a fabric mode is set to be smaller than the minimum value of the driving frequency F in a photograph paper mode and also set to be smaller than the minimum value of the driving frequency F in a normal paper mode. In the example in this drawing, the maximum value of the driving frequency F in the case of a fabric mode is F11 (16,000 Hz), the minimum value of the driving frequency F in the case of a photograph paper mode is F2 (48,000 Hz), and the minimum value of the driving frequency F in the case of a normal paper mode is R6 (32,000 Hz).

However, the method of determining a driving frequency F according to the "eighth condition" is not limited to above. For example, it can be set such that the maximum value of the driving frequency F in a fabric mode becomes equal to or lower than the minimum value of the driving frequency F in a photograph paper mode, and also becomes equal to or lower than the minimum value of the driving frequency F in a normal paper mode.

Further, the driving frequency F can be set such that, for example, considering the relationship between a photograph paper mode and a normal paper mode, the maximum value of the driving frequency F in a fabric mode becomes equal to or lower than the minimum value of the driving frequency F in a normal paper mode, and the maximum value of the driving frequency F in a normal paper mode also becomes equal to or lower than the minimum value of the driving frequency F in a photograph paper mode.

Further, the driving frequency F can be set such that, for example, in cases where the setting modes other than the medium mode m are the same, the driving frequency F in a fabric mode becomes equal to or lower than the driving frequency F in a photograph paper mode and also becomes equal to or lower than the driving frequency F in a normal paper mode. For example, the driving frequency F can be set so that the driving frequencies F (F1, F5, F9) corresponding to the mode numbers "11*h*1*c*," "21*h*1*c*, and "31*h*1*c*" satisfy "F9≤F1" and "F9≤F5."

Further, in this embodiment, the driving frequencies F are set to satisfy, in addition to the eighth condition for coping with the third measure, the following various conditions.

Specifically, in this embodiment, in each medium mode m, the driving frequency F is set so that the driving frequency F in an image quality priority mode becomes equal to or lower than the driving frequency F in a speed priority mode (hereinafter, the setting condition will be referred to as "ninth condition"). In the case of an image quality priority mode for prioritizing an image quality than a printing speed, compared to the speed priority mode, the driving frequency F is lowered to slow down the print speed, decreasing the possibility of occurrence of blurring, condensation, etc., which makes it possible to execute a high resolution image printing.

Further, in this embodiment, in the case in which the medium mode m and the image quality mode g are the same, the driving frequency F is set so that the driving frequency F in the 2-bit mode becomes equal to or higher than the driving frequency F in the case of the 4-bit mode (hereinafter, the setting condition will be referred to as "tenth condition").

Although details will be explained later, the shape of the waveform of the driving waveform signal Com in the case of the 2-bit mode is a simpler waveform than the shape of the waveform of the driving waveform signal Com in the case of the 4-bit mode. Therefore, the driving frequency F in the case of the 2-bit mode can be set to be higher than the driving frequency F in the case of the 4-bit mode, which makes it possible to speed up the print speed in the case of the 2-bit mode.

<5.4. Number of Overlap S>

Next, among the operation set information, the number of overlap S will be explained.

The number of overlap S is the number of the main scanning (passes) executed to form all dots to be formed on one pixel line (on one raster line) extending in the main scanning direction on a recording medium P.

Here, the main scanning (pass) is, in the case in which a carriage 32 moves in the main scanning direction, a collective term for one main scanning corresponding to a going path in the case in which an ink is ejected from an ejection section D in the going path in the movement, and one main scanning corresponding to a returning path in the case in which an ink is ejected from an ejection section D in the returning path in the movement.

For example, in the case where the number of overlap S is "2," two main scanning (passes) are executed on one pixel line (raster line) to form dots corresponding to all pixels on one pixel line.

More specifically, in the case where the number of overlap S is "2," when the print mode is a single direction mode in which ink is ejected only in the going path, the carriage 32 executes two main scanning by reciprocating twice in the main scanning direction to form all dots on one pixel line, and in a case in which the print mode is a bi-direction mode in which ink is ejected in both the going path and the returning path, the carriage 32 executes two main scanning by reciprocating once in the main scanning direction to form all dots on one pixel line. In these cases, normally, in one main scanning, dots are formed intermittently for every other pixel. Therefore, as the number of overlap S increases, the number of main scanning required for forming all dots on one pixel line increases, and as a result, the print speed decreases.

Hereinafter, the number of overlap S corresponding to the 12 mode numbers shown in FIG. 24 (11*h*1*c*, 11*h*2*c*, . . . , 32*h*2*c*) are shown as "S1" to "S12."

The number of overlap S is determined by considering the aforementioned third measure.

As described above, the necessity for carrying out the third measure is the highest in the case of printing on a fabric and the lowest in the case of printing on a photograph paper. Therefore, in this embodiment, the number of overlap S is set so that the number of overlap S in a fabric mode becomes larger than the number of overlap S in a photograph paper mode or a normal paper mode (hereinafter, the setting condition will be referred to as "eleventh condition").

Specifically, as shown in FIG. 24, the number of overlap S in a fabric mode (S9 to S12) is set to become larger than the number of overlap S in a photograph paper mode (S1 to S4) and also become larger than the number of overlap S in a normal paper mode (S5 to S8). More specifically, the minimum value of the number of overlap S in a fabric mode is set to become larger than the maximum value of the number of overlap S in a photograph paper mode and also become larger than the maximum value of the number of overlap S in a normal paper mode. In the example in this drawing, the minimum value of the number of overlap S in the case of a fabric mode is S11 (28 times), etc., the maximum value of the number of overlap S in the case of a photograph paper mode is S1 (4 times), etc., and the maximum value of the number of overlap S in the case of a normal paper mode is S5 (6 times).

However, the method of determining the number of overlap S according to the "eleventh condition" is not limited to above. For example, it can be set such that the minimum value of the number of overlap S in a fabric mode becomes equal to or larger than the maximum value of the number of overlap S in a photograph paper mode, and also becomes equal to or larger than the maximum value of the number of overlap S in a normal paper mode.

Further, the number of overlap S can be set so that, for example, also considering the relationship between a photograph paper mode and a normal paper mode, the minimum value of the number of overlap S in a fabric mode becomes equal to or larger than the maximum value of the number of overlap S in a normal paper mode, and the minimum value of the number of overlap S in a normal paper mode becomes equal to or larger than the maximum value of the number of overlap S in a normal paper mode.

Further, the number of overlap S can be set so that, for example, in the case where the setting modes other than the medium mode m are the same, the number of overlap S in a fabric mode becomes equal to or larger than the number of overlap S in a photograph paper mode and also become equal to or larger than the number of overlap S in a normal paper mode. For example, the number of overlap S can be set so that the number of overlap S (S1, S5, S9) corresponding to the mode numbers "11*h*1*c*," "21*h*1*c*," and "31*h*1*c*" satisfy "S9≥S1" and "S9≥S5."

Further, in this embodiment, the number of overlap S is set to satisfy, in addition to the eleventh condition for the third measure, the following various conditions.

Specifically, in this embodiment, in each medium mode m, the number of overlap S is set so that the number of overlap S in the image quality priority mode becomes equal to or larger than the number of overlap S in the case of a speed priority mode (hereinafter, the setting condition will be referred to as "twelfth condition").

In the case of an image quality priority mode in which a priority is given to an image quality than a printing speed, compared to a case of a speed priority mode, the number of overlap S is increased to slow down the print speed, decreasing the possibility of occurrence of blurring, condensation, etc., which makes it possible to execute high resolution image printing.

In this embodiment, in the case where the medium mode m and the image quality mode g are the same, the number of overlap S is set to the same value.

<5.5. Meniscus Position>

Next, among the operation set information, the meniscus position dZ will be explained.

A meniscus position dZ is, as described above, a position of a meniscus Ms in the Z-axis direction, and in the operation set information according to this embodiment, is set to either of the two values, a high position dz-H or a low position dZ-L.

Hereinafter, the meniscus positions dZ corresponding to the 12 mode numbers shown in FIG. 24 (11*h*1*c*, 11*h*2*c*, 32*h*2*c*) are shown as "dZ1" to "dZ12."

The meniscus position dZ is determined by considering the aforementioned fourth measure.

As described above, the fourth measure is to pull-in the meniscus position dZ to prevent the contamination of the recording medium P due to the contact of a fiber of the recording medium P to an ink inside the ejection section D. The possibility of contamination of a recording medium P due to the contact of a fiber of the recording medium P to an ink inside the ejection section D is the highest in the case of printing on a fabric and the lowest in the case of printing on photograph paper. Therefore, the necessity for carrying out the fourth measure is the highest in the case of printing on a fabric and the lowest in the case of printing on a photograph paper.

Therefore, in this embodiment, the meniscus position dZ in a fabric mode is set to a position pulled-in more to the +Z side than the meniscus position dZ in a photograph paper mode or a normal paper mode (hereinafter, the setting condition will be referred to as "thirteenth condition").

Specifically, the meniscus position dZ in a fabric mode (dZ9 to dZ12) is set to be more on +Z side than the meniscus position dZ (dZ1 to dZ4) in a photograph paper mode and also set to be more on +Z side than the meniscus position dZ (dZ5 to dZ8) in a normal paper mode. More specifically, as shown in FIG. 24, the meniscus position dZ in a fabric mode is set to a high position dZ-H, the meniscus position dZ in a photograph paper mode is set to a low position dZ-L, and the meniscus position dZ in a normal paper mode is set to a low position dZ-L.

In addition, the actual changes in the meniscus position dZ in the case where inks are ejected from an ejection section D in each of the cases in which the meniscus position dZ is set to a high position dZ-H and a low position dZ-L in the operation set information will be explained separately.

6. Print Speed of Inkjet Printer

As characteristics of the operation of the inkjet printer 10, other than values defined by the operation set information (maximum dot formation ink amount W, resolution R, driving frequency F, number of overlap S, and meniscus position dZ), there exist a print speed U, a main scanning print speed Uy (one example of "main scanning speed"), and sub-scanning print speed Ux (one example of "sub-scanning speed"). Hereinafter, the print speed U, the main scanning print speed Uy, and the sub-scanning speed Ux are collectively referred to as "print performance." The content of the evaluation information is set by considering the print performance of an inkjet printer 10 among the operation characteristics of the inkjet printer 10.

Hereinafter, the print performances of the inkjet printer 10 will be explained.

The print speed U is a printable area of a recording medium P per unit time by an inkjet printer 10. The print speed U is defined based on a resolution R, a driving frequency F, and the number of overlap S among the operation set information, the set content of dot type modes d.

The main scanning print speed Uy is a length of a recording medium P in which dots can be formed by one nozzle in an inkjet printer 10 per unit time in the main scanning direction. The main scanning print speed Uy is defined based on the resolution Ry, the driving frequency F, and the number of overlap S among the operation set information, the set content of dot type modes d, and the number of nozzles N provided in the inkjet printer 10.

The sub-scanning print speed Ux is a printable length of a recording medium P per unit time by an inkjet printer 10 in the sub-scanning direction. The sub-scanning print speed Ux is defined based on the print speed U and the length of the recording medium P in the main scanning direction (size of the recording medium P).

FIG. 25 is an example of a data structure of a print performance table TBL15 storing the print performance of the inkjet printer 10 and the print modes in an associated manner.

The print performance of the inkjet printer 10 is calculated in advance based on the operation set information stored in the operation set information table TBL14, a size of a recording medium P on which the inkjet printer 10 can print, etc., and stored in the print performance table TBL15.

In addition, in FIG. 25, as the print speed U, the number of sheets of a recording medium P of A4 size (8.27×11.69 inch≈96.68 inch$^2$) printable in one minute (60 seconds) is exemplified. That is, in this example, the print speed U is given by the following formula (1) based on the driving frequency F, the resolution R and the number of overlap S.

$$\text{Print Speed } U=\{\text{"60 sec"}\times F\times\text{"total number of nozzles"}\}/\{(R\times S\times\text{"carriage movement coefficient"}\times\text{"96.68"})\} \quad \text{formula (1)}$$

Here, the carriage movement coefficient denotes, when a time required from when printing on one pixel line starts until when printing on the next pixel line starts in a bi-direction mode is defined as "1," a coefficient expressing the length of time required to start printing on the next pixel line after starting printing on one pixel line in a single direction mode. In an example shown in this drawing, the carriage movement coefficient is presumed as "1.2." Further, in an example shown in this drawing, the total nozzle number is presumed to be "1,000."

Further, this drawing exemplifies, as the main scanning print speed Uy, in the case where the inkjet printer 10 executes print processing on an A4 size recording medium P, the number of lines of the recording medium P in which each nozzle N can form dots per minute (60 seconds) is illustrated. That is, the main scanning print speed Uy in the example shown in the drawing is given by the following formula (2) based on the driving frequency F, the resolution Ry and the number of overlap S.

$$\text{Main Scanning Print Speed } Uy=\{\text{"60 sec"}\times F\}/\{\text{"}Ry\times S\times\text{"carriage movement coefficient"}\times\text{"8.27"}\}\} \quad \text{formula (2)}$$

The sub-scanning print speed Ux, as a general rule (that is, when presuming that print processing is executed on a recording medium P having the same size as when the print speed U is calculated), is proportional to the print speed U. Therefore, in this drawing, a drawing of the sub-scanning print speed Ux is omitted.

The information for calculating the print speed U, the main scanning print speed Uy, and the sub-scanning print speed Ux, that is, the set content of the resolution R, the driving frequency F, the number of overlap S, and the dot type mode d (hereinafter, these are collectively referred to as "print speed setting information") are defined by considering the aforementioned third measure.

As described above, the necessity for carrying out the third measure is the highest in the case of printing on a fabric and the lowest in the case of printing on a photograph paper. Therefore, in this embodiment, the print speed setting information is defined so that the print speed U in a fabric mode (one example of the "first print speed") is set to be slower than the print speed U (one example of the "second print speed") in a photograph paper mode or a normal paper mode (hereinafter, the setting condition will be referred to as "fourteenth condition").

Similarly, in this embodiment, the print speed setting information is set so that the main scanning print speed Uy in a fabric mode is slower than the main scanning print speed Uy in a photograph paper mode or a normal paper mode (hereinafter, the setting condition will be referred to as "fifteenth condition").

Similarly, in this embodiment, the print speed setting information is set so that the sub-scanning print speed Ux in a fabric mode is slower than the sub-scanning print speed Ux in a photograph paper mode or a normal paper mode (hereinafter, the setting condition will be referred to as "sixteenth condition").

Hereinafter, details of the aforementioned fourteenth condition will be explained. Further, although the following explanation is an explanation of the fourteenth condition, this explanation can be similarly applied to the fifteenth condition and the sixteenth condition.

The fourteenth condition, as shown in FIG. 25, is to define the print speed setting information so that the print speed U in a fabric mode is slower than the print speed U in a photograph paper mode and is also slower than the print speed U in a normal paper mode. More specifically, the print speed setting information is defined so that the maximum value of the print speed U in a fabric mode is set to be slower than the minimum value of the print speed U in a photograph paper mode and is also set to be slower than the maximum value of the print speed U in a normal paper mode.

However, the method of determining the print speed setting information according to the "fourteenth condition" is not limited to above, and for example, it can be set so that the maximum value of the print speed U in a fabric mode becomes equal to or lower than the minimum value of the print speed U in a photograph paper mode, and also becomes equal to or lower than the minimum value of the print speed U in a normal paper mode.

Further, the print speed setting information can be set so that, for example, also considering the relationship between a photograph paper mode and a normal paper mode, the maximum value of the print speed U in a fabric mode becomes equal to or lower than the minimum value of the print speed U in a normal paper mode, and the maximum value of the print speed U in a normal paper mode becomes equal to or lower than the minimum value of the print speed U in a normal paper mode.

Further, the print speed setting information can be set so that, for example, in the case where the setting modes other than the medium mode m are the same, the print speed U in a fabric mode becomes equal to or slower than the print speed U in a photograph paper mode and also becomes equal to or lower than the print speed U in a normal paper mode. For example, the print speed setting information can be defined so that the print speed U corresponding to the mode numbers "11111," "21111," "31111" satisfies "(speed of the mode number 31111)≤(speed of mode number 11111)," and "(speed of the mode number 31111)≤(speed of mode number 21111).

Further, the print speed setting information can be defined so that, for example, the print speed U in a fabric mode becomes equal to or slower than a certain speed.

7. Evaluation Information

Next, the evaluation information will be explained.

The contents (values) of the evaluation information is determined by considering the aforementioned first to eighth measures and the first to sixteenth conditions corresponding to the measures.

More specifically, in this embodiment, a print mode in which all of the first to eighth measures are carried out adequately and the operation set information satisfies all of the first to sixteenth conditions is defined as a "best print mode," an "adequate print mode," or a "limited adequate print mode," and other print modes are each defined as an "inadequate print mode."

Further, in cases where the operation set information is defined so as to satisfy all of the first to sixteenth conditions, it can be considered that all of the first to fourth measures have been adequately carried out. Therefore, like in this embodiment, in cases where the operation set information is defined so as to satisfy all of the first to sixteenth conditions, the contents of the evaluation information are determined based on whether or not the fifth to eighth measures are adequately carried out.

Hereinafter, the specific contents of the evaluation information will be explained with reference to the fifth to eighth measures.

As described above, the fifth measure is to "prohibit the employment of a bi-direction mode in the case of print processing on a fabric." In this embodiment, as shown in FIG. 14, to cope with the fifth measure, among the plurality of print modes, a print mode in which the medium mode m is a "fabric mode" and the print direction mode h is the "bi-direction mode" is defined as an inadequate print mode.

Also, as described above, the sixth measure is "to prohibit the employment of a light and shade color mode and all color mode in print processing on a fabric" and the seventh measure is "to employ a characteristic color mode in print processing on a fabric." Therefore, in this embodiment, as shown in FIG. 14, to cope with the sixth measure and the seventh measure, among the plurality of print modes, a print mode in which the medium mode m is a "fabric mode" and the color mode c is a color mode other than the "characteristic color mode" is defined as an inadequate print mode.

Further, as described above, the eighth measure is "to prohibit the employment of all color modes in print processing on a normal paper." Therefore, in this embodiment, as shown in FIG. 14, to cope with the eighth measure, among the plurality of print modes, a print mode in which the medium mode m is a "normal paper mode" and the color mode c is "all color mode" is defined an inadequate print mode.

In this embodiment, as shown in FIG. 14, among a plurality of print modes, a print mode in which the medium mode m is a "photograph paper mode" or a "normal paper mode" and the image quality mode g is an "image quality priority mode" and the color mode c is a "pure black mode" is defined as an inadequate print mode. With this, even in the case of executing monochrome printing, since inks of other colors will be used together with a black ink, as compared with the case in which printing is executed in a pure black mode which only uses a black ink, a black color of depth can be reproduced.

In this embodiment, among the 40 patterns of print modes belonging to each medium mode m, only one print mode is classified as the best print mode "◎ in the drawing."

More specifically, as shown in FIG. 14, in the photograph paper mode, the print mode having the mode number "11225" is classified as the best print mode.

A photograph paper is a recording medium P normally used for the purpose of executing high quality printing. Therefore, in printing on a photograph paper, by setting the combination of an "image quality priority mode," a "single direction mode," a "4-bit mode," and "all color mode" which are print modes most capable of increasing image quality, as a "best print mode," print processing meeting the needs of a user of a printing device 1, high quality printing, can be executed.

Also, in a normal paper mode, the print mode having the mode number "22112" is classified as the best print mode.

A normal paper is a recording medium P which is daily used, and in print processing, priority is often given to a print speed than an image quality and costs for printing is often required to be reduced. Therefore, when printing on a normal paper, by setting a print mode corresponding to a "print speed priority mode," a "bi-direction mode," and a "2-bit mode," which can attain a fastest print speed and also corresponding to a "basic color mode" which can reduce the cost relating to inks without using a characteristic color ink, a light color ink, etc., as a "best print mode," print processing meeting the needs of a user of a printing device 1 can be executed.

Also, in a fabric mode, the print mode of "31224" is classified as a best print mode.

A fabric is a recording medium P used as clothes, etc., and print processing is often executed for the purpose of improving the design of clothes, etc. That is, when printing on a fabric, the priority is often given to an image quality. Therefore, for printing on a fabric, by setting a print mode in which the combination of an "image quality priority mode," a "single direction mode," a "4-bit mode," and a "characteristic color mode," which can best increase an image quality, as a "best print mode," print processing meeting the needs of a user of a printing device 1 can be executed.

As described above, some of print modes among the plurality of print modes are defined as a "best print mode" and an "inadequate print mode." Further, among the plurality of print modes, print modes other than a "best print mode" and an "inadequate print mode" are defined as an "adequate print mode" or a "limited adequate print mode."

Specifically, among the print modes other than a "best print mode" or an "inadequate print mode," a print mode in which the color mode c is a "pure black mode" and the medium mode m is a "photograph paper mode" or a "normal paper mode" is defined as a "limited adequate print mode."

Further, print modes other than a "best print mode," an "inadequate print mode" or a "limited adequate print mode" are defined as an "adequate print mode."

In the aforementioned manner, the evaluation information to be stored in the mode evaluation table TBL13 shown in FIG. 14 is defined.

The print mode setting section 91 of the print data generating section 90 sets a print mode based on the setting mode specified on the print condition specifying screen and the evaluation information stored by the mode evaluation table TBL13. Further, from the operation set information table TBL 14, the print mode setting section 91 obtains an operation set information corresponding to the print mode set by the print mode setting section 91.

The resolution conversion section 92 converts the resolution of an image expressed by image data 1 mg to a resolution R included in the operation set information obtained by the print mode setting section 91.

Further, the color conversion section 93 converts, by referring to a color conversion table LUT corresponding to a color mode c of a print mode set by the print mode setting section 91, the data of the color of an image expressed by image data Img to data expressed in a color space defined by ink colors used by an inkjet printer 10 in a color mode c of a print mode specified by the print mode setting section 91. Further, the color conversion section 93 determines, by referring to a color conversion table LUT, the type of ink used by an inkjet printer 10 in print processing.

The halftone processing section 94 executes halftone processing for determining the dot allocation, the dot size, etc., to be formed on a recording medium P based on, the set content of the print direction mode h and the set content of the dot type mode d among the print modes set by the print mode setting section 91, and the maximum dot formation ink quantity W, resolution R, driving frequency F, number of overlap S, etc., among the operation set information obtained by the print mode setting section 91.

The rasterizing section 95 executes rasterizing processing for arranging the halftone processed image data in an order of data to be forwarded to an inkjet printer 10, and creates print data PD based on the rasterized image data. In this embodiment, the print data PD includes, other than the rasterized image data, for example, the content of various setting modes of print modes set by the print mode setting section 91 and the operation set information obtained by the print mode setting section 91.

8. Structure and Operation of Driving Signal Generation Section

Next, with reference to FIG. 26 to FIG. 31, the structure and the operation of the driving signal generation section 50 will be explained.

Figures 26, 27:
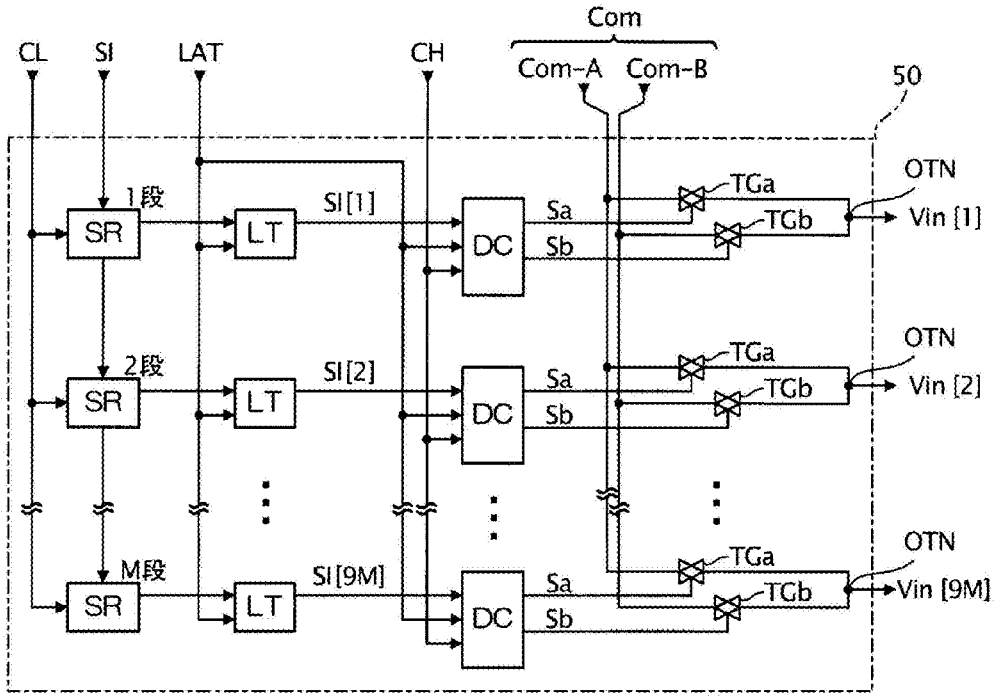
FIG. 26 is a block diagram showing a structure of a driving signal generation section 50.
FIG. 27 is an explanatory view showing decode contents of a decoder DC.

FIG. 26 is a block diagram showing a structure of a driving signal generation section 50. As shown in FIG. 26, the driving signal generation section 50 is provided with 9M sets each constituted by a shift register SR, a latch circuit LT, a decoder DC, and a transmission gates TGa and TGb so as to correspond one-to-one to 9M ejection sections D. Hereinafter, each element constituting these 9M sets may be denoted as stage 1, stage 2, . . . , stage 9M.

To the driving signal generation section 50, the control section 60 supplies a clock signal CL, a print signal SI, a latch signal LAT, a change signal CH and a driving waveform signal Com (Com-A, Com-B).

Here, the print signal SI is a digital signal for defining the type of dot size to be formed by ink ejected from each ejection section D (each nozzle N) when forming a dot corresponding to one image. The signal is supplied from the controlling section 60 to the driving signal generation section 50 in synchronous with the clock signal CL.

More specifically, the print signal SI according to this embodiment defines, in the case where the dot type mode d is a 4-bit mode, the type of the dot size to be formed by ink ejected from each ejection section D by 2 bits of the first bit b1 and the second bit b2, and defines, in the case where the dot type mode d is a 2-bit mode, the types of dot sizes to be formed by ink ejected from each ejection section D by 1 bit of the first bit b1. Here, the types of dot sizes to be formed by inks ejected from each ejection section D are, in the case where the dot type mode d is a 4-bit mode, 4 types of sizes, i.e., a non-record, a small dot, a middle dot, and a large dot, which can express four gradations in each pixel of a recording medium P, and in the case where the dot type mode d is a 2-bit mode, 2 types of sizes, i.e., a non-record and a record, which can express two gradations in each pixel of the recording medium P.

Each of the shift registers SR temporarily holds the print signal SI per bit corresponding to each ejection section D. Specifically, 9M shift registers SR of stage 1, stage 2, . . . , stage M corresponding one-to-one to the 9M ejection sections D are connected to each other in series, and the serially provided print signals SI are sequentially forwarded to a post stage according to the clock signal CL. Then, when all of the print signals SI of the 9M shift registers SR are forwarded, the supply of the clock signals CL is stopped, and a state in which each of the 9M shift registers SR holds 2 bit data (in the case of a 4-bit mode) or 1 bit data (in the case of a 2-bit mode) corresponding to itself among the print signals SI is maintained.

Each of the 9M latch circuits LT simultaneously latches, at a timing when the latch signal LAT raises, 3 bits of print signals SI corresponding to each stage held by each of the 9M shift registers SR. In FIG. 26, each of SI [1], SI [2], . . . , SI [9M] represents a print signal SI of 2 bits (in the case of a 4-bit mode) and 1 bit (in the case of a 2-bit mode) each latched by a latch circuit LT corresponding to the shift register SR of stage 1, stage 2, . . . , stage 9M.

The operation period, which is a period in which the inkjet printer 10 executes print processing, is constituted by a plurality of unit periods Tu. The length of a unit period Tu is defined based on the driving frequency F determined by the print data generating section 90. More specifically, a unit period Tu is "1/F."

Further, in the case where the dot type mode d is a 4-bit mode, each unit period Tu is divided into a control period Ts1 and a following control period Ts2. Here, the control period Ts1 and Ts2 can be the same length of time.

A control section 60 supplies print signals SI per unit period Tu to the driving signal generation section 50 and controls the driving signal generation section 50 so that the latch circuit LT latches the print signals SI [1], SI [2], . . . , SI [9M] per unit period Tu. That is, the control section 60 controls the driving signal generation section 50 so that the driving signal Vin is supplied per unit period Tu to 9M ejection sections D.

A decoder DC decodes 2 bits (in the case of a 4-bit mode) or 1 bit (in the case of a 2-bit mode) of the print signal SI latched by the latch circuit LT and outputs selection signals Sa and Sb.

FIG. 27 is an explanatory drawing showing the contents of the decoding done by a decoder DC when the dot type mode d is in a 4-bit mode. As shown in FIG. 27, when the content shown by a print signal SI [m] corresponding to the stage m (m is a natural number satisfying $1 \leq m \leq 9$) is, for example, (b1, b2)=(1, 0), the decoder DC in the stage m sets, in a control period Ts1, the selection signal Sa to a high level H and sets the selection signal Sb to a low level L, and sets, in a control period Ts2, the selection signal Sb to a high level H and sets the selection signal Sa to a low level L.

FIG. 28 is an explanatory drawing showing the content of the decoding done by a decoder DC when the dot type mode d is in a 2-bit mode. As shown in FIG. 28, when the content shown by a print signal SI [m] corresponding to the stage m is, for example, b1=(1), the decoder DC in the stage m sets, in an unit period Tu, the selection signal Sa to a high level H and sets the selection signal Sb to a low level L.

Returning to FIG. 26, as shown in FIG. 26, the driving signal generation section 50 is equipped with 9M pairs of transmission gates TGa and TGb. These 9M pairs of transmission gates TGa and TGb are provided so as to correspond to 9M ejection sections D one-to-one.

The transmission gate TGa turns on when the selection signal Sa is at an H level and turns off when it is at an L level. The transmission gate TGb turns on when the selection signal Sb is at an H level and turns off when it is at an L level.

At the end of the transmission gate TGa, a driving waveform signal Com-A is supplied, and at the end of the transmission gate TGb, a driving waveform signal Com-B is supplied. Also, the other ends of the transmission gates TGa and TGb are commonly connected to the output end OTN to the ejection section D.

As it is clear from FIG. 27 and FIG. 28, both the transmission gates TGa and TGb will not simultaneously turn on in a stage m. Therefore, in the case in which one of the transmission gates TGa and TGb turns on, either one of the driving waveform signals Com-A and Com-B is selected, and the selected driving waveform signal Com is supplied to a piezoelectric element 200 of the ejection section D in the stage m as a driving signal Vin [m].

Figure 29:
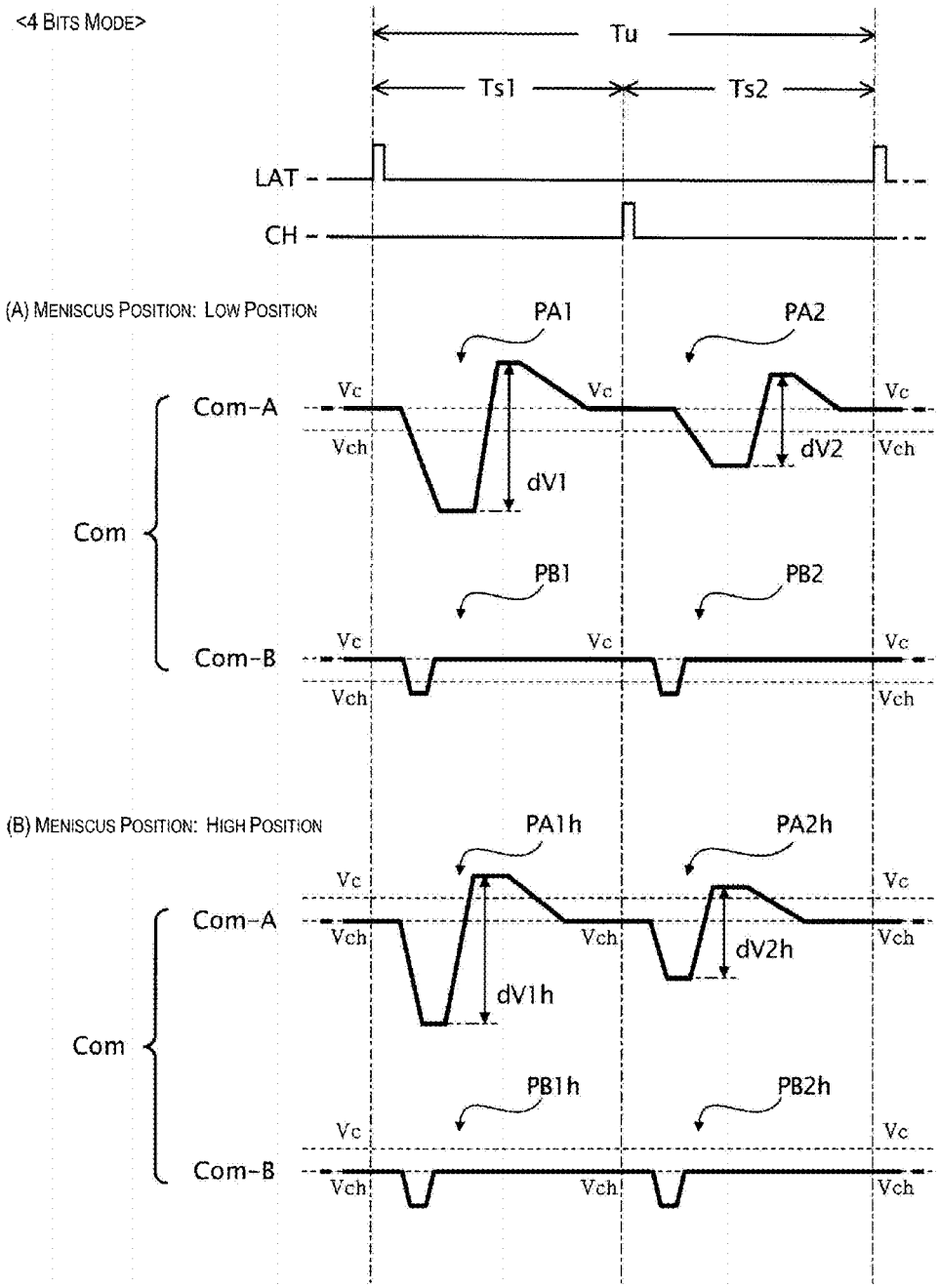
FIG. 29 is a timing chart showing an operation of the driving signal generation section 50.

FIG. 29 is a timing chart for explaining the operation of the driving signal generation section 50 in each unit time Tu in a case in which the dot type mode d is in a O-bit mode.

As shown in FIG. 29, the unit time Tu is a period defined by latch signals LAT output by the control section 60. Further, the control period Ts1 and Ts2 included in the unit time Tu are periods defined by the latch signal LAT and the change signal CH output by the control section 60.

The control section 60 supplies print signals SI to the driving signal generation section 50 per unit time Tu. Also, 9M latch circuits LT output, at a timing when the latch signal LAT rises up, that is, at a timing when the unit time Tu starts, print signals SI [1], SI [2], . . . , SI [9M]. Also, the decoder DC in the stage m decodes 2 bits of print signals SI [m] latched by the latch signals LAT based on the content of the table shown in FIG. 27, and outputs selection signals Sa and Sb in each of the control periods Ts1 and Ts2.

Therefore, the driving signal generation section 50 selects either one of the driving waveform signals Com-A or Com-B in each of the control periods Ts1 and Ts2, and supplies the selected driving waveform signal Com-A or Com-B to the ejection section D on the stage m as a driving signal Vin [m].

FIG. 29 (A) illustrates the waveform of the driving waveform signals Com in a 4-bit mode in the case in which the meniscus position dZ is set at a low position dZ-L.

Further, FIG. 29 (B) illustrates the waveform of the driving waveform signals Com in a 4-bit mode in the case in which the meniscus position dZ is set at a high position dZ-H.

As shown in FIG. 29 (A), in the case in which the meniscus position dZ is set to a low position dZ-L, the driving waveform signal Com-A supplied from the control section 60 in each unit time Tu has a waveform including a unit waveform PA1 provided in the control period Ts1 and a unit waveform PA2 provided in the control period Ts2.

These unit waveforms PA1 and PA2 are determined according to the maximum dot formation ink amount W corresponding to the print mode set by the print data generating section 90. More specifically, the unit waveform PA1 and PA2 is defined so that the total value of the amount of ink ejected from the ejection section D in the case where the ejection section D is driven by the driving signal Vin having the unit waveform PA1 and the amount of ink ejected from the ejection section D in a case where the ejection section D driven by the driving signal Vin having the unit waveform PA2 becomes a maximum dot formation ink amount W.

Further, the unit waveforms PA1 and PA2 are defined so that the amount of ink ejected from the ejection section D based on the unit waveform PA1 becomes larger than the amount of ink ejected from the ejection section D based on the unit waveform PA2. More specifically, in this embodiment, the unit waveforms PA1 and PA2 are set so that the potential difference dV1 of the maximum electrical potential and the minimum electrical potential of the unit waveform PA1 becomes to be larger than the potential difference dV2 of the maximum electrical potential and the minimum electrical potential of the unit waveform PA2.

Further, the waveforms of the unit waveform PA1 and PA2 are set so that all of the electrical potentials at the timing of the beginning and the end of the unit waveforms PA1 and PA2 become a reference potential Vc.

Further, as shown in FIG. 29 (A), in the case where the meniscus position dZ is set to a low position dZ-L, the driving waveform signal Com-B supplied from the control section 60 in each of the unit times Tu has a waveform including a unit waveform PB1 provided in the control period Ts1 and a unit waveform PB2 provided in the control period Ts2.

These unit waveforms PB1 and PB2 are, for example, waveforms for providing slight vibration to the ejection section D, and the waveforms are set so that, when the ejection section D is driven by the unit waveform PB1 or PB2, ink is not ejected from the ejection section D.

Further, the unit waveform PB1 and PB2 are set so that the electrical potential at the timing of the beginning and the end of the unit waveforms PB1 and PB2 becomes a reference potential Vc.

In the case in which the content of the print signal SI [m] supplied in the unit time Tu is (b1, b2)=(1,1), the ejection section D in the stage m ejects a moderate amount of ink based on the unit waveform PA1 and a small amount of ink based on the unit waveform PA2 in the unit time Tu. Since the twice ejected inks join on the recording medium P, a large dot having an ink amount corresponding to the maximum dot formation ink amount W is formed on the recording medium P.

In the case in which the content of the print signal SI [m] supplied in the unit time Tu is (b1, b2)=(1,0), the ejection section D in the stage m ejects a moderate amount of ink based on the unit waveform PA1 in the unit time Tu and therefore a middle dot is formed on the recording medium P.

In the case in which the content of the print signal SI [m] supplied in the unit time Tu is (b1, b2)=(0,1), the ejection section D in the stage m ejects a small amount of ink based on the unit waveform PA2 in the unit time Tu and a small dot is formed on the recording medium P.

In the case in which the content of the print signal SI [m] supplied in the unit time Tu is (b1, b2)=(0,0), ink is not ejected from the ejection section D in the stage m, and therefore, no dot is formed on the recording medium P (non-recorded).

As shown in FIG. 29 (B), in a case in which the meniscus position dZ is set to a high position dZ-H, the driving waveform signal Com-A supplied from the control section 60 in each unit time Tu has a waveform including a unit waveform PA1*h* provided in the control period Ts1 and the unit waveform PA2*h* provided in the control period Ts2.

These unit waveforms PA1*h* and PA2*h* are set so that the total value of the amount of ink ejected from the ejection section D based on the unit waveform PA1*h* and the amount of ink ejected from the ejection section D based on the unit waveform PA2*h* becomes the maximum dot formation ink amount W.

Further, the unit waveforms PA1*h* and PA2*h* are set so that the amount of ink ejected from the ejection section D based on the unit waveform PAIN becomes larger than the amount of ink ejected from the ejection section D based on the unit waveform PA2*h*, for example, the electric potential difference dV1*h* between the maximum potential and the minimum potential of the unit waveform PA1*h* becomes larger than the electric potential difference dV2*h* between the maximum potential and the minimum potential of the unit waveform PA2*h*.

Further, the waveforms of the unit waveform PA1*h* and PA2*h* are set so that both of the electrical potentials at the timing of the beginning and at timing of the ending of the unit waveforms PA1 and PA2 become a pull-in potential Vch. Here, the pull-in electrical potential Vch is an electrical potential for pulling-in the meniscus position dZ when the driving signal Vin of the pull-in potential Vch is supplied to the ejection section D to the +Z side (inside of the cavity 245 of the ejection section D) than the meniscus position dZ when the driving signal Vin at the reference potential Vc is supplied to the ejection section D.

As shown in FIG. 29 (B), in the case in which the meniscus position dZ is set to a high position dZ-H, the driving waveform signal Com-B supplied from the control section 60 in each of the unit times Tu has a waveform including a unit waveform PB1*h* provided in a control period Ts1 and a unit waveform PB2*h* provided in a control period Ts2.

These unit waveforms PB1*h* and PB2*h* are waveforms, in a similar manner as the unit waveforms PB1 and PB2, for giving a slight vibration to the ejection section D, for example, and set so that, when the ejection section D is driven by the unit waveforms PB1*h* and PB2*h*, ink will not be ejected from the ejection section D.

Further, the unit waveforms PB1*h* and PB2*h* are set so that all of the electrical potentials at the timing of the beginning and the timing of the ending of the unit waveforms PB1*h* and PB2*h* become a pull-in potential Vch.

In the case in which the content of the print signal SI [m] supplied in the unit time Tu is (b1, b2)=(1,1), the ejection section D in the stage m ejects a moderate amount of ink based on the unit waveform PA1*h* and a small amount of ink based on the unit waveform PA2*h* in the unit time Tu. Since the twice ejected inks join on a recording medium P, a large dot having an ink amount corresponding to the maximum dot formation ink amount W is formed on the recording medium P.

Similarly, in the case in which the content of the print signal SI [m] supplied in the unit time Tu is (b1, b2)=(1,0), the ejection section D in the stage m ejects a moderate amount of ink based on the unit waveform PA1*h* in the unit time Tu, and a middle dot is formed on the recording medium P.

In the case in which the content of the print signal SI [m] supplied in the unit time Tu is (b1, b2)=(0,1), the ejection section D in the stage m ejects a small amount of ink based on the unit waveform PA1*h* in the unit time Tu, and a small dot is formed on the recording medium P.

In the case in which the content of the print signal SI [m] supplied in the unit time Tu is (b1, b2)=(0,0), ink is not ejected from the ejection section D in the stage m, and therefore, no dot is formed on the recording medium P (non-recorded.)

Figure 30:
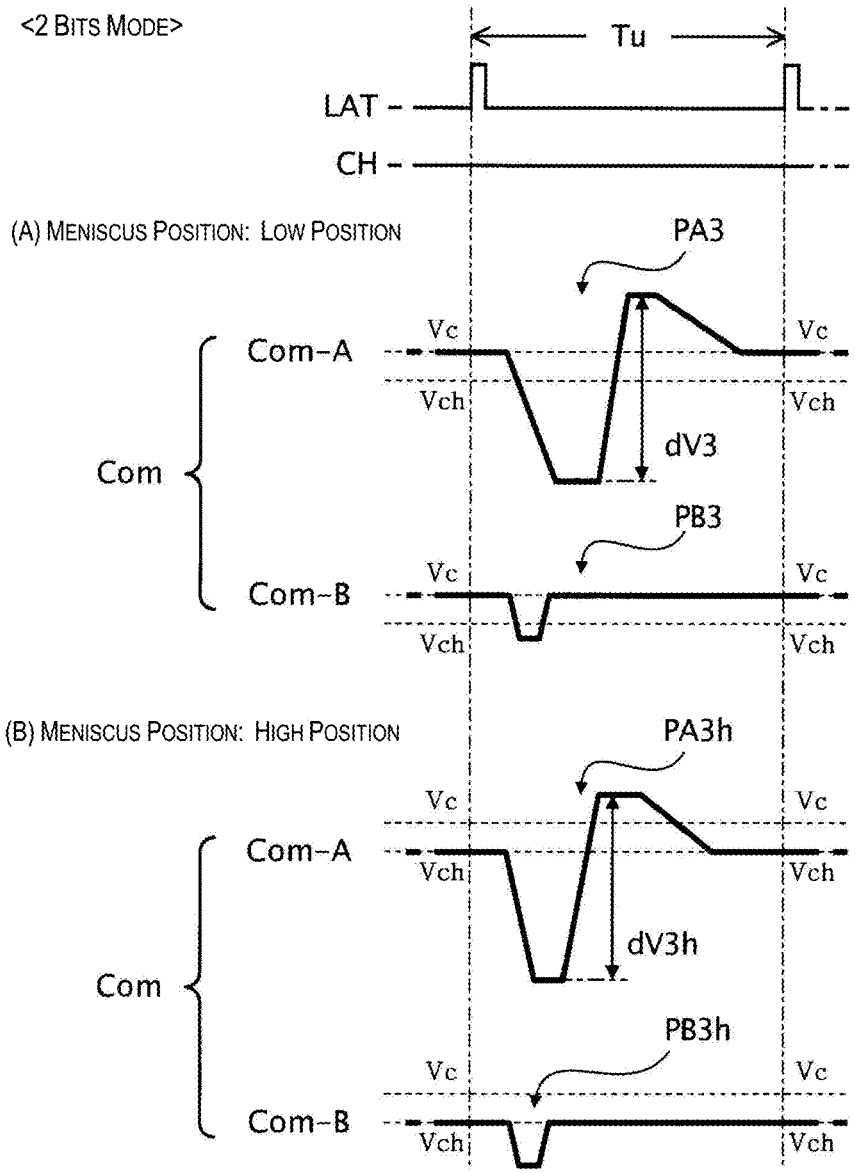
FIG. 30 is a timing chart showing an operation of the driving signal generation section 50.

FIG. 30 is, in the case in which the dot type mode d is a 2-bit mode, a timing chart for explaining the operation of the driving signal generation section 50 in each unit time Tu.

As shown in FIG. 30, a 2-bit mode differs from a 4-bit mode in that change signals CH are not supplied from the control section 60 and the unit time Tu is not divided into control periods Ts1 and Ts2. Further, the decoder DC in the stage m decodes 1 bit of the print signals SI [m] latched by the latch signal LAT based on the content of the table shown in FIG. 28, and outputs selection signals Sa or Sb every unit time Tu. That is, the driving signal generation section 50 selects either one of the driving waveform signal Com-A or Com-B in each unit time Tu, and supplies the selected driving waveform signal Com-A or Com-B to the ejection section D in the stage m as a driving signal Vin [m.]

FIG. 30 (A) shows the waveform of the driving waveform signals Com in a 2-bit mode in the case in which the meniscus position dZ is set at a low position dZ-L.

Further, FIG. 30 (B) shows the waveform of the driving waveform signals Com in a 2-bit mode in the case in which the meniscus position dZ is set at a high position dZ-H.

As shown in FIG. 30 (A), in the case in which the meniscus position dZ is set at a low position dZ-L, the waveform of the driving waveform signal Com-A becomes a unit waveform PA3. The unit waveform PA3 is set according to the maximum dot formation ink amount W corresponding to the print mode set by the print data generating section 90, and the amount of ink to be ejected from the ejection section D in the case in which the ejection section D is driven by a driving signal Vin having a unit waveform PA3 is set to be the maximum dot formation ink amount W. Further, in the unit waveform PA3, the electrical potential difference between the maximum potential and the minimum potential is dV3 and the electrical potential at the timing of the beginning and the ending of the unit waveform PA3 is a reference potential Vc.

Further, as shown in FIG. 30 (A), in the case in which the meniscus position dZ is set at a low position dZ-L, the waveform of the driving waveform signal Com-B becomes the unit waveform PB3. The unit waveform PB3, in a similar manner as the unit waveform PB1, etc., when the ejection section D is driven by the unit waveform PB3, is a waveform in which inks are not ejected from the ejection section D. In addition, in the unit waveform PB3, the electrical potential at the timing of the beginning or the ending of the unit waveform PB3 is a reference potential Vc.

In the case in which the content of the print signal SI [m] supplied in the unit time Tu is b1="1," the ejection section D in the stage m ejects ink based on the unit waveform PA3 in the unit time Tu and a dot is formed on the recording medium P. Further, in the case in which the content of the print signal SI [m] supplied in the unit time Tu is b1="0," ink is not ejected from the ejection section D in the stage m, and therefore, no dot is formed on the recording medium P (non-recorded).

As shown in FIG. 30 (B), in the case in which the meniscus position dZ is set at a high position dZ-H, the waveform of the driving waveform signal Com-A becomes the unit waveform PA3*h*. The unit waveform PA3*h* is set so that the amount of ink to be ejected from the ejection section D in the case in which the ejection section D is driven by a driving signal Vin having a unit waveform PA3*h* becomes the maximum dot formation ink amount W. Further, in the unit waveform PA3*h*, the electrical potential difference between the maximum potential and the minimum potential is dV3*h* and the electrical potential at the timing of the beginning or the ending of the unit waveform PA3*h* is a pull-in potential Vch.

Further, as shown in FIG. 30 (B), in the case in which the meniscus position dZ is set at a high position dZ-H, the waveform of the driving waveform signal Com-B becomes the unit waveform PB3*h*. The unit waveform PB3*h* is, in a similar manner as the unit waveform PB1, etc., when the ejection section D is driven by the unit waveform PB3*h*, a waveform in which inks are not ejected from the ejection section D. In addition, in the unit waveform PBh3, the electrical potential at the timing of the beginning or the ending of the unit waveform PB3*h* is a pull-in potential Vch.

In the case in which the content of the print signal SI [m] to be supplied in the unit time Tu is b1=(1), the ejection section D in the stage m ejects ink based on the unit waveform PA3*h* and a dot is formed on the recording medium P. Further, in the case in which the content of the print signal SI [m] supplied in the unit time Tu is (b1)=(0), ink is not ejected from the ejection section D in column m, and therefore, no dot is formed on the recording medium P (non-recorded).

Figure 31:
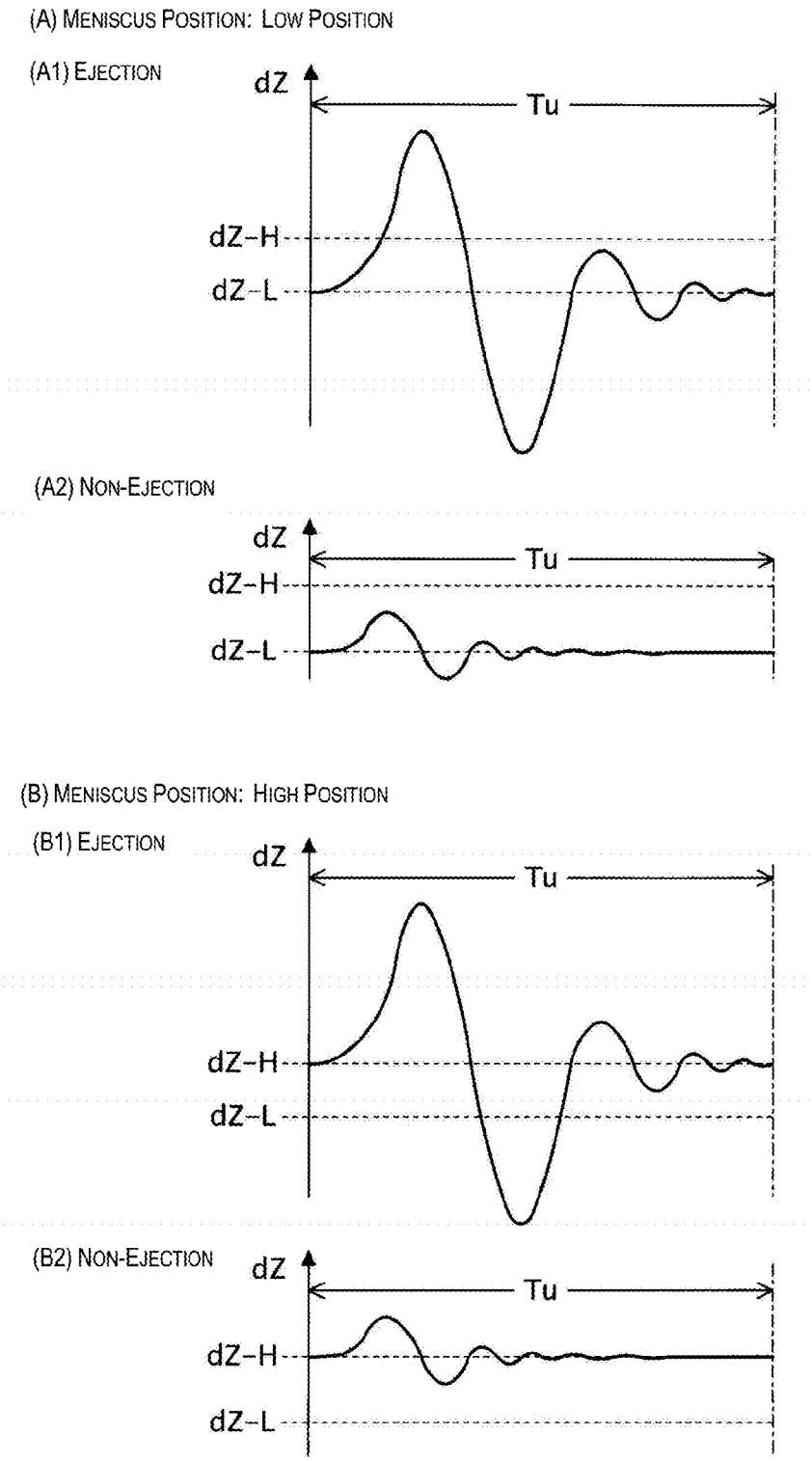
FIG. 31 is an explanatory view for explaining changes of a meniscus position dZ in a unit period Tu.

FIG. 31 is an explanatory view for explaining changes of a meniscus position dZ in each unit time Tu. In this drawing, for simplicity, a case of a 2-bit mode in which each unit time Tu is not divided into control periods Ts1 and Ts2 is exemplified.

As described, above, in each unit time, since the ejection section D is driven by a driving signal Vin, the meniscus position dZ also changes in each unit time Tu. Therefore, in this embodiment, in the case in which the meniscus position dZ changes in such a manner, the meniscus position dZ in the unit time Tu is shown as an average value of the meniscus position in the unit time Tu. However, in the case in which the meniscus position dZ changes, the meniscus position dZ in the unit time Tu can be the meniscus position at an arbitrary timing in the unit time Tu (for example, in the case of a 2-bit mode, a timing at which the unit time Tu starts; and in the case of a 4-bit mode, a timing at which a control period Ts1 or a control period Ts2 starts, etc.).

As shown in FIG. 31 (A), when the meniscus position dZ in the print data generating section 90 is set to a low position dZ-L, the control section 60 creates a driving waveform signals Com having a waveform in which the meniscus position dZ in the unit time Tu (for example, the average value of the meniscus position dZ in the unit time Tu or the meniscus position dZ at a timing when the unit period Tu starts) is in a low position dZ-L in both cases in which the ejection section D ejects ink (A1) and does not eject ink (A2).

Similarly, as shown in FIG. 31 (B), when the meniscus position dZ in the print data generating section 90 is set to a high position dZ-H, the control section 60 creates driving waveform signals Corn having a waveform in which the meniscus position dZ in the unit time Tu becomes a high position dZ-H in both cases in which the ejection section D ejects ink (B1) and does not eject ink (B2).

9. Dot Recording System

Next, a dot recording system according to this embodiment will be explained. Here, a dot recording system is a system for defining the relationship between a pixel position and a pass where each ejection section D belonging to each nozzle line (each nozzle N) ejects ink in the case in which an inkjet printer 10 executes print processing. Hereinafter, first, an interlace recording system, which is a dot recording system that is normally employed, will be explained.

An interlace recording system denotes a recording system employed when the nozzle pitch k is 2 or more. When the nozzle pitch k is 2 or more, in one main scanning (pass), a raster line remains, in which recording cannot be executed between adjacent nozzles in the X-axis direction. Therefore, in the interlace recording system, the pixels on the raster line that cannot be formed by the one main scanning are recorded in another main scanning.

Figures 32A, 32B:
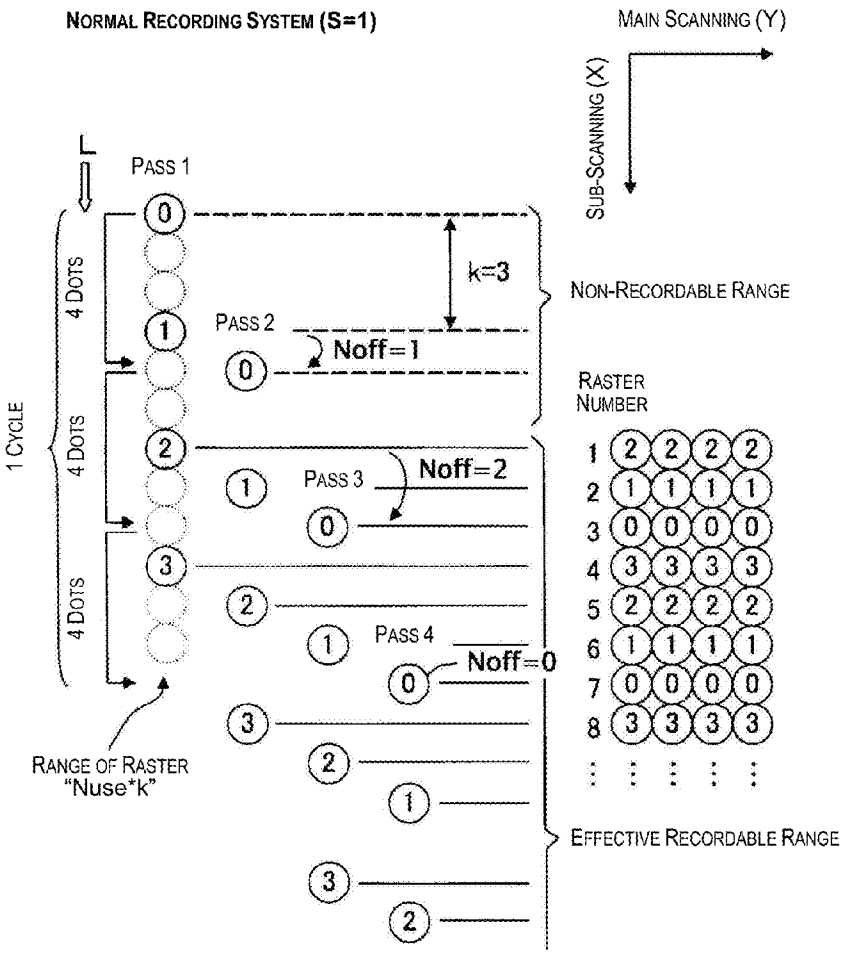
FIGS. 32A and 32B are explanatory views for explaining an interlace recording system.

FIGS. 32A and 32B are explanatory views for explaining basic conditions of a normal interlace recording system. FIG. 32A shows an example of a sub-scanning conveyance in the case of employing four nozzles N, and FIG. 32B shows the parameters of the dot recording system.

In FIG. 32A, the solid line circles containing numbers show the positions of the four nozzles N in each pass in the sub-scanning direction. As described above, a "pass" means one main scanning. The numbers 0 to 3 inside the circles mean the numbers of the nozzles (nozzle numbers). The positions of four nozzles N are conveyed in the sub-scanning direction each time one main scanning ends. Strictly, the movement conveyance in the sub-scanning direction is achieved by conveying a recording medium P using the paper feeder motor 71 (see FIG. 2 and FIG. 3). Therefore, the conveyance of the four nozzle N positions in the sub-scanning direction means a relative movement in the sub-scanning direction of the recording medium P.

As shown in the left edge of FIG. 32A, in this example, the sub-scanning conveyance amount L is a constant value of 4 dots. Therefore, every time a sub-scanning conveyance is executed, the positions of the four nozzles N are dislocated by 4 dots in the sub-scanning direction. For each nozzle, all dot locations (also referred to as "pixel position") on each raster line are recording target in one main scanning. As described above, the total number of main scanning executed on each raster line (also referred to as a "main scanning line") is referred to as "number of overlap (S)."

On the right edge of FIG. 32A, the numbers of nozzles N for recording dots on each raster line are shown. On the raster lines drawn by broken lines extending in the right direction (main scanning direction) from the circles showing the sub-scanning positions of the nozzles N, since recording cannot be executed on at least one of the raster lines above or below thereof, recording of dots are prohibited in reality. On the other hand, for raster lines drawn with solid lines extending in the main scanning direction, the raster lines before and after thereof are in a range to be recordable by dots. In this way, a range in which recording can be actually executed is referred to as an effective recording range (or "effective printing range," "print execution range," "recording execution range") hereinafter.

FIG. 32B shows various parameters regarding the dot recording system. In the parameters of the dot recording system, a nozzle pitch k [dots], the number of nozzles used Nuse [pieces], the number of overlap S, the number of effective nozzles Neff [pieces], and the sub-scanning conveyance amount L [dots] are included.

In the example of FIGS. 32A and 32B, the nozzle pitch k is 3 dots. The number of nozzles used Nuse is four. Further, the number of nozzles Nuse is the number of nozzles N actually employed in the plurality of mounted nozzles N. In this example, the number of overlap S is "1." The number of effective nozzles Neff is a value obtained by dividing the number of used nozzles Nuse by the number of overlap S. The number of effective nozzles Neff can be considered to show the net number of the raster lines in which the dot recording is completed by one main scanning.

The table of FIG. 32B shows the sub-scanning conveyance amount L in each pass, the cumulative total value Lsum, and the offset of the nozzle Noff.

Here, the offset Noff denotes a value showing, when it is presumed that a periodic position of the nozzle N in the first pass 1 (positions every 4 dots in FIGS. 32A and 32B) is a reference position in which the offset is 0, how far the position of the nozzle N in each of the following passes is from the reference position in the sub-scanning direction by how many dots. For example, as shown in FIG. 32A, after the pass 1, the position of the nozzle N moves in the sub-scanning direction by the sub-scanning conveyance amount L (4 dots). On the other hand, the nozzle pitch K is 3 dots. Therefore, the offset Noff of the nozzle N in the pass 2 is "1" (see FIG. 32A). Similarly, the position of the nozzle N in the pass 3 has moved by Lsum=8 dots from the initial position and the offset Noff is "2." The position of the nozzle N in the pass 4 has moved by Lsum=12 dots from the initial position and the offset Noff is "0." Since the offset Noff of the nozzle N return to "0" in the pass 4 after three sub-scanning conveyances, by repeating this cycle as three sub-scanning as one cycle, all dots on raster lines in the effective recording range can be recorded.

As it can be understood from the example in FIGS. 32A and 32B, when the position of the nozzle is in a position distant from the initial position by integer multiples of the nozzle pitch k, the offset Noff is "0." Further, the offset Noff is given by the remainder of the value obtained by dividing the cumulative total value Lsum of the sub-scanning conveyance amount L by the nozzle pitch k "Lsum % k." Here, "%" is an operator indicating that the remainder of the division should be taken. Further, when the initial position of the nozzle N is considered to be a periodic position, the offset Noff can also be thought to show the phase shift amount from the initial position of the nozzle N.

In the case in which the number of overlap S is "1," it is required to meet the following conditions to ensure that there are no omission or overlap on a raster line to be a recording target in an effective recording range.

(Condition c1) The number of sub-scanning conveyance in one cycle is equal to the nozzle pitch K.

(Condition c2) The offset Noff of the nozzle N after each sub-scanning conveyance in one cycle becomes a different value for each of the ranges "0" to "k−1."

(Condition c3) The average conveyance amount of the sub-scanning "Lsum/k" is equal to the number of used nozzles Nuse.

In other words, the cumulative total value Lsum of the sub-scanning conveyance amount per cycle is equal to a value "Nuse×k" obtained by multiplying the number of used nozzles Nuse and the nozzle pitch k.

Each of the aforementioned conditions can be understood by thinking in the following manner. Since (k−1) raster lines exist between neighboring nozzles N, to execute recording on these (k−1) raster lines and return to the reference position of the nozzle (the position where the offset Noff is "0") in one cycle, the number of sub-scanning conveyance in one cycle is k times. When the sub-scanning conveyance in one cycle is less than k, omissions occur on the raster lines to be recorded, and on the other hand, when the sub-scanning conveyance is more than k times in one cycle, overlapping occurs on the raster line to be recorded. Therefore, the following condition c1 is satisfied.

When the number of sub-scanning in one cycle is k times, only when the value of the offset Noff after each sub-scanning conveyance is a value difference in the range of "0" to "k−1," there are no omission and/or overlap on the raster line to be recorded. Therefore, the following condition c2 is satisfied.

When the aforementioned conditions c1 and c2 are both satisfied, each of the Nuse number of nozzles executes recording on k raster lines in one cycle. Therefore, in one cycle, recording is executed on "Nuse×k" raster lines.

On the other hand, when the aforementioned condition c3 is satisfied, as shown in FIG. 32A, the position of the nozzle N after one cycle (after k times of sub-scanning conveyance) comes to a position distant from the initial nozzle position by "Nuse x k" raster lines. Therefore, by satisfying the aforementioned conditions c1 to c3, in the range of "Nuse×k" raster lines, the raster lines to be recorded can be free of omissions and overlaps.

Figures 33A, 33B:
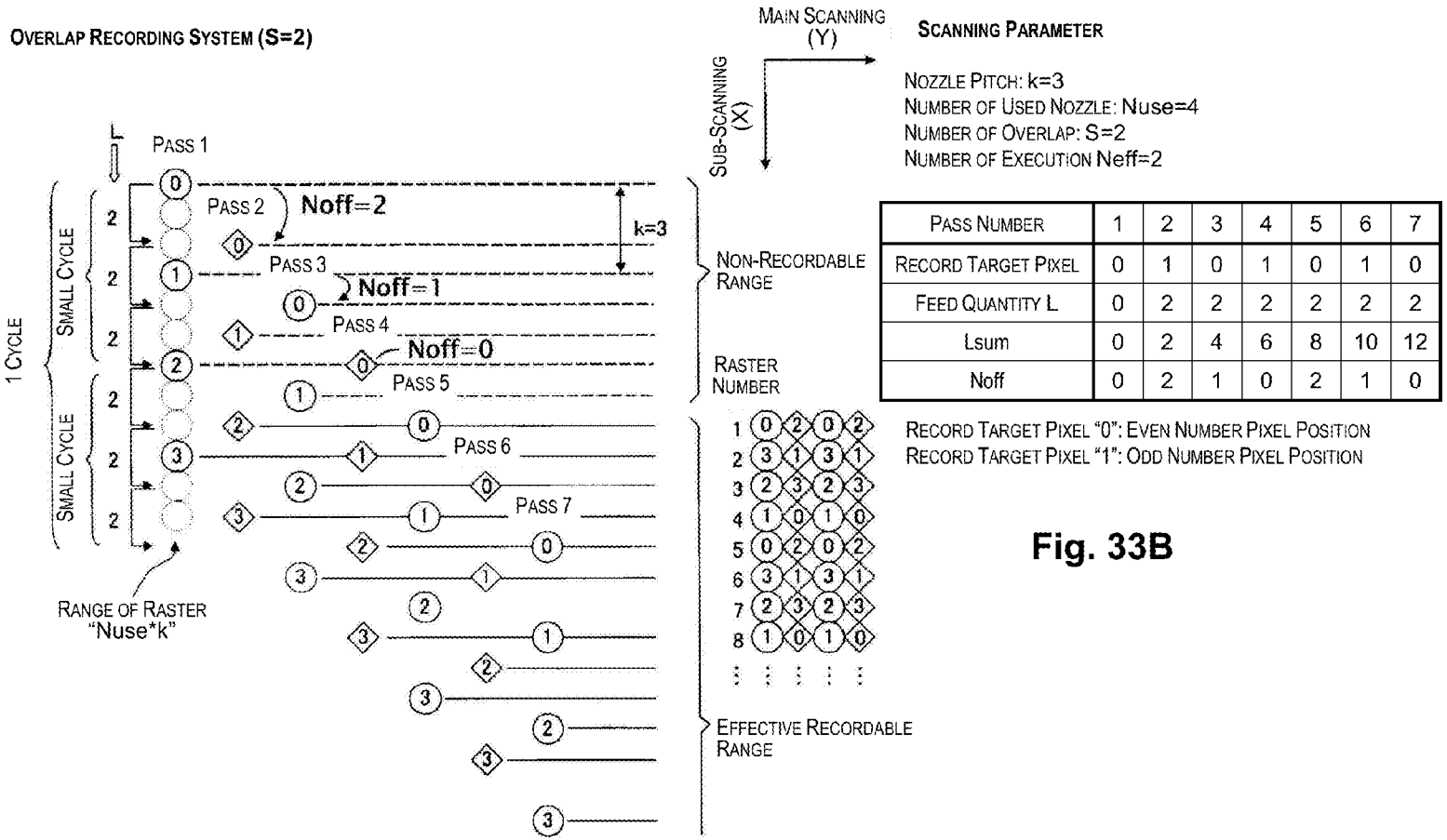
FIGS. 33A and 33B are explanatory views for explaining an overlap system.

FIGS. 33A and 33B are explanatory views for explaining the basic conditions of a dot recording system in the case in which the number of overlap S is 2 or more. In the case in which the number of overlap S is 2 or more, main scanning is executed S times on the same raster line. The dot recording system in which the number of overlap S is 2 or more may sometimes be referred to as "overlap system."

In this embodiment, as shown in FIG. 24, the case in which the number of overlap S is 2 or more is presumed. Therefore, in the present invention, the overlap system explained below is employed as the dot recording system. However, the number of overlap S shown in FIG. 24 is an example, and in the present invention, the case in which the number of overlap S is "1" can be included and the aforementioned interlace recording system can be employed as the dot recording system.

In the dot recording system shown in FIGS. 33A and 33B (overlap system), among the parameters in the dot recording system shown in FIG. 32B, the number of overlap S and the sub-scanning conveyance amount L are changed. As shown in FIG. 33A, the sub-scanning conveyance amount L in the dot recording system of FIGS. 33A and 33B is a constant value of 2 dots. In FIG. 33A, the positions of the nozzle N in the even-numbered passes are shown by diamond shapes and the positions of the nozzles N in the odd-numbered passes are shown by circles to differentiate them.

Normally, as shown in the right edge of FIG. 33A, the dot position recorded in an even-numbered pass is shifted from the dot position recorded in the odd-numbered pass by one dot in the main scanning direction. Therefore, each of the plurality of dots on the same raster line is intermittently recorded by two different nozzles N. For example, the raster line on the uppermost edge in the effective recording range is intermittently recorded every other dot by the number 0 nozzle N in pass 5 after being intermittently recorded every other dot by the number 2 nozzle N in pass 2. In the overlap system in which the number of overlap is "S," after each nozzle N records one dot in one main scanning, the nozzle N is driven at an intermittent timing so as to prohibit the recording of "S−1" dots.

In this way, an overlap system in which the intermittent pixel position on a raster line in each main scanning is a recording target is referred to as "intermittent overlap system." Further instead of making the intermittent pixel positions as recording targets, all pixel positions on a raster line in each main scanning can be recording targets. That is, when executing the main scanning S times on one raster line, overprinting of dots at the same pixel position can be allowed. Such an overlap system is referred to as "overprint overlap system" or "complete overlap system."

Further, in the intermittent overlap system, it is enough that the positions of the plurality of nozzles N for recording the same raster line in the main scanning direction is shifted, and therefore the actual shift amount in the main scanning direction at the time of each main scanning can be various amounts other than shown in FIG. 33A. For example, it can be configured such that, in the pass 2, the positions of dots shown in circles are recorded without shifting in the main scanning direction, and in the pass 5, the positions of dots shown by diamonds are recorded by shifting in the main scanning direction.

The lowermost row in the table of FIG. 33B shows the values of the offset Noff in each pass in one cycle. One cycle includes six passes, and the offset Noff in each pass from pass 2 to pass 7 each includes twice in the range of "0 to 2." Further a change in the offset Noff in the three passes from pass 2 to pass 4 is equal to the change in the offset Noff in three passes from pass 5 to pass 7. As shown on the left edge of FIG. 33A, six passes in one cycle can be classified into 2 sets of small cycles every three times. That is, in the case in which the number of overlap is "S," one cycle is completed by repeating the small cycle S times.

In the case in which the number of overlap S is an integer of 2 or more, the aforementioned conditions c1 to c3 are rewritten as the following conditions c1a, c2a, c3a.

(Condition c1a) The number of sub-scanning conveyance in one cycle is equal to a value obtained by multiplying the nozzle pitch k and the number of overlap S.

(Condition c2a) The offset Noff of the nozzle N after each sub-scanning conveyance in one cycle is a value in a range of "0" to "k−1" and each value is repeated S times.

(Condition c3a) The average conveyance amount of the sub-scanning {Lsum/(k×S)} is equal to the number of effective nozzles Neff ("Nuse/S"). In other words, the value of the cumulative total value Lsum of the sub-scanning conveyance amount per cycle is equal to a value {Neff×(k×S)} in which the number of effective nozzles Neff and the number of sub-scanning conveyances (k×S) are multiplied.

The aforementioned conditions c1a to c3a are also satisfied in the case in which the number of overlap S is "1." Therefore, the conditions c1a to c3a are considered to be conditions generally satisfied in a dot recording system regardless of the value of the number of overlap S. That is, when the aforementioned three conditions c1a to c3a are satisfied, in the effective recording range, the recorded dots can be free of omissions and unnecessary overlaps.

However, in the case in which an intermittent overlap system is employed, a condition that the recording positions of the nozzle N for recording the same raster lines are shifted in the main scanning direction is also required. Further, in the case of employing an overprint overlap system, it is enough that the aforementioned conditions c1a to c3a are satisfied, and in each pass, all pixel positions are regarded as recording targets.

Further, in FIGS. 32A and 32B and FIGS. 33A and 33B, although the case in which the sub-scanning conveyance amount L is a constant value was explained, the aforementioned conditions c1a to c3a are not limited to the case in which the sub-scanning conveyance amount L is a constant value, and are applicable for the case in which a combination of a plurality of different values are used as the sub-scanning conveyance amount.

Further, in this embodiment, the sub-scanning conveyance in which the sub-scanning conveyance amount L is a constant value is referred to as "regular conveyance," and the sub-scanning conveyance in which a combination of a plurality of different values is used as the sub-scanning conveyance amount L is referred to as "irregular conveyance."

Hereinafter, in this embodiment, the overlap system explained FIGS. 33A and 33B is employed as the dot recording system, but for example, the dot recording system of the first to fourth examples which will be explained in the following FIGS. 34 to 40 can be employed.

Figure 34:
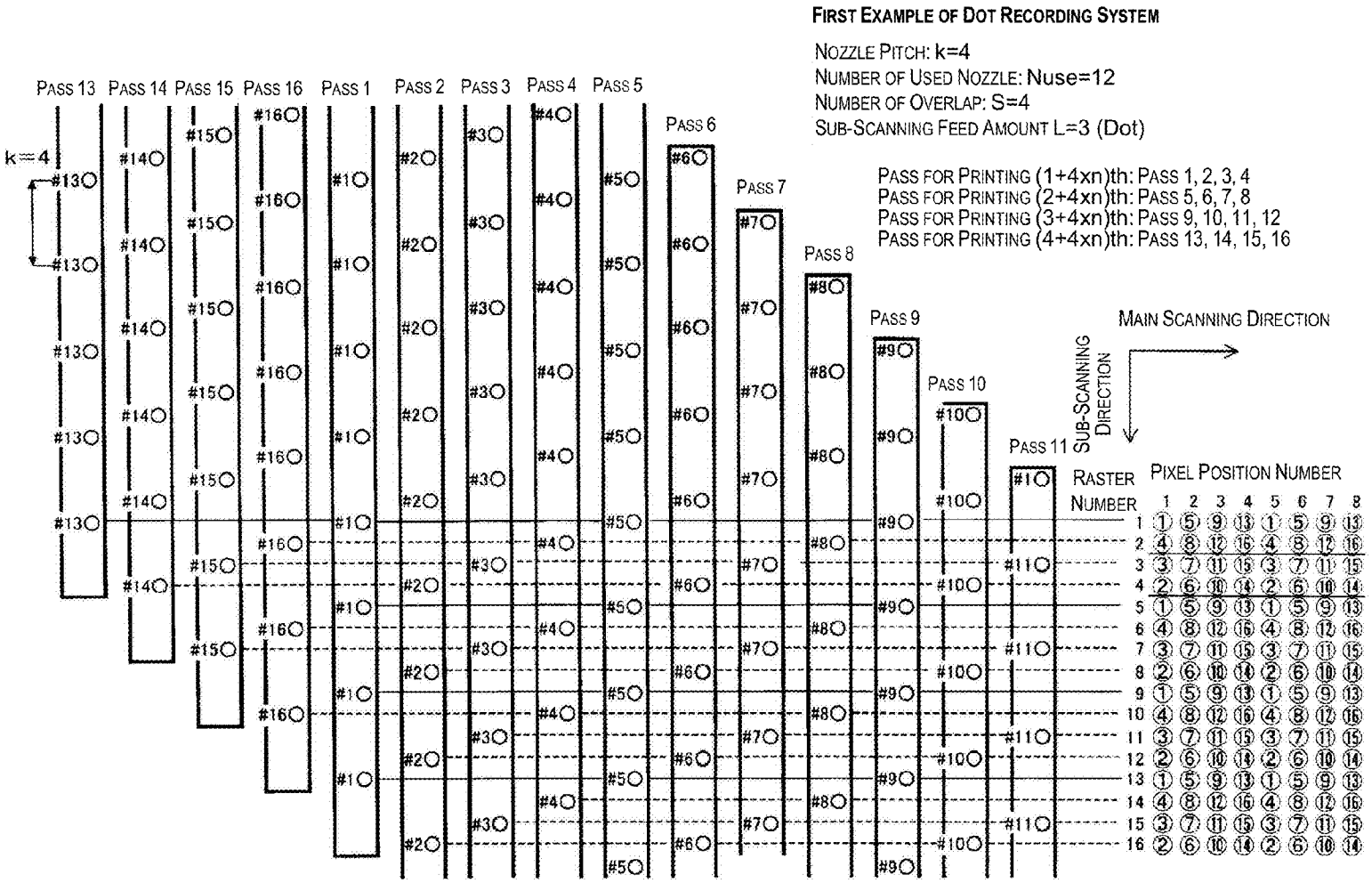
FIG. 34 is an explanatory view for explaining a first example of a dot recording system.

FIG. 34 is an explanatory drawing showing a first example of a dot recording system among dot recording systems that could be employed in the present invention. In FIG. 34, as an example of the parameters in the first example of the dot recording system, it is assumed the case in which the nozzle pitch k=4, the number of used nozzles Nuse=12, the number of overlap S=4, and the sub-scanning conveyance amount L=3. These parameters satisfy the aforementioned conditions c1a to c3a. Therefore, printing can be executed without causing omissions and/or unnecessary overlaps for dots to be recorded. Further, as explained in the basic conditions of the recording system, since the nozzle pitch k is "4" and the number of overlap S is "4," 16 passes are included in one cycle. In FIG. 34, a portion of the 16 passes included in the one cycle is shown.

The pixel position number shown at the right edge of FIG. 34 shows the order of the arrangement of the pixels on each raster line, and the number inside the circles show the number of passes in charge of forming the dots at the pixel positions. For example, in the first raster line, a dot is formed with four passes, #1, #5, #9, and #13. That is, when n is an integer "0" or more, for the first raster line, the dot having a pixel position number of (1+4×n) is formed by #1 pass, the dot having a pixel position number of (2+4×n) is formed by #5 pass, the dot having a pixel position number of (3+4×n) is formed by #9 pass, and the dot having a pixel position number of (4+4×n) is formed by #13 pass. Similarly, the dot on the second raster line is formed by #4, #8, #12 and #16 passes, the dot on the third raster line is formed by #3, #7, #11 and #15 passes, and the dot on the fourth raster line is formed by #2, #6, #10 and #14 passes.

In this way, when a is an integer of "0" or more, the $(1+3\times\alpha)^{th}$ raster line is formed by #1, #5, #9 and #13 passes, the $(2+3\times\alpha)^{th}$ raster line is formed by #4, #8, #12 and #16 passes, the $(3+3\times\alpha)^{th}$ raster line is formed by #3, #7, #11 and #15 passes, and the $(4+3\times\alpha)^{th}$ raster line is formed by #2, #6, #10 and #14 passes.

The control section 60 determines the content of the print signals SI (see FIG. 27 and FIG. 28) so that such raster lines are formed.

Specifically, for example, to form a dot with the #1 pass on a pixel having a pixel position number of (1+4×n) on the first raster line, in the #1 pass, the value shown by a print signal SI in the #1 pass is set to "record" only for the $(1+4\times n)^{th}$ pixel position and set to "non-record" for the $(3+4\times n)^{th}$, $(3+4\times n)^{th}$ and $(4+4\times n)^{th}$ pixel positions.

Here, the case in which the content of the print signal SI indicates "record" is any of the cases of (b1, b2) (1, 1), (1, 0), and (0, 1) when the dot type mode d is a 4-bit mode, and is the case b1="1" when the dot type mode d is a 2-bit mode. Further, the case in which the content of the print signal SI indicates "non-record" is the case of (b1, b2)=(0, 0) when the dot type mode d is a 4-bit mode, and the case of b1="0" when the dot type mode d is a 2-bit mode.

The interval of time for forming dots of two pixels adjacent in the main scanning direction is, for example, when the time required for each pass is 5 seconds, 20 seconds for a pixel in which the raster number is 1 and the pixel position number is 1 (recorded in pass 1) and a pixel in which the raster number is 1 and the pixel number is 2 (recorded in pass 5). In this way, when the number of overlap S becomes 2 or more, since one raster line is formed in a plurality of passes, a dot of pixels adjacent in the main scanning direction is not formed in a continuous main scanning and can be formed in a discontinuous main scanning. As a result, the ink drop of the dot formed earlier on pixels adjacent in the main scanning direction considerably dries, and therefore condensation or blurring of ink drops in the main scanning direction are controlled.

However, focusing on the pixel positon of the pixel position number 1, the pixel of a raster number of 5 is handled by #1 pass, the pixel of a raster number 4 is handled by #2 pass, the pixel of a raster number 3 is handled by #3 pass, and the pixel of a raster number 2 is handled by #4 pass. In this way, continuous passes, #1, #2, #3 . . . are arranged adjacent in order in the sub-scanning direction. Further, the other pixel positions are similar.

Figure 35:
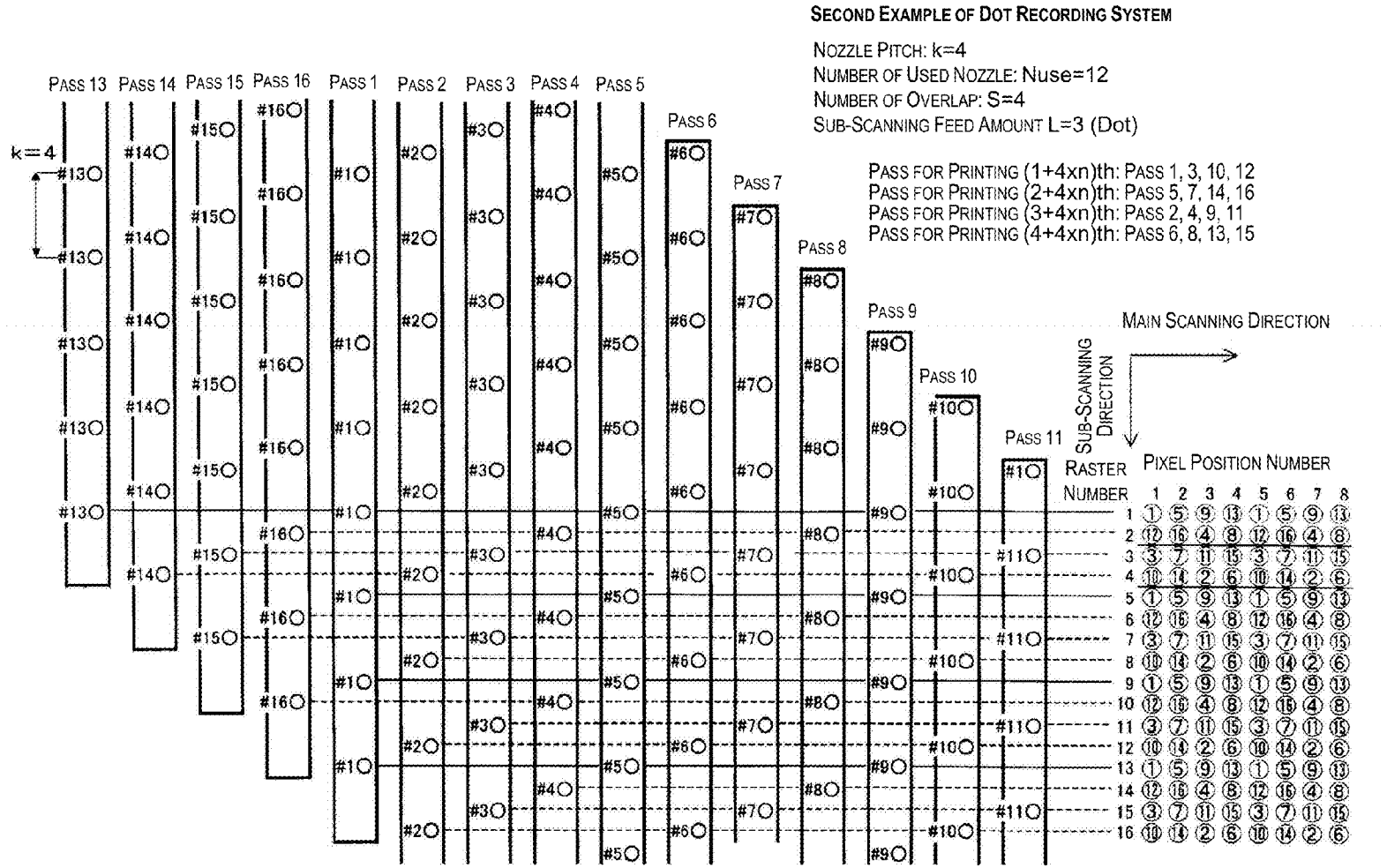
FIG. 35 is an explanatory view for explaining a second example of a dot recording system.

FIG. 35 is an explanatory drawing showing a second example of a dot recording system in the present invention. In the dot recording system, the parameters are the same in the first example of the dot recording system, but the pixel positions recorded by each pass are different from the dot recording system of the first example. Specifically, although the $(1+4\times\alpha)^{th}$ and $(3+4\times\alpha)^{th}$ raster lines are similar to the first example of the dot recording system, the adjacent $(2+4\times\alpha)^{th}$ and $(4+4\times\alpha)^{th}$ raster lines have different pixel positions. For example, in the second example of this dot recording system, although the dot having a pixel position number of (1+4×n) is formed by #10 pass, a pixel position number of (2+4×n) is formed by #14 pass, a pixel position number of (3+4×n) is formed by #2 pass, and a pixel position number of (4+4×n) is formed by #6 pass, it is different from the first example in that dots are formed by other passes.

FIG. 36 is an explanatory view showing pixels recorded by dots in each pass in the first example and the second example of the dot recording system of the present invention. As shown in the drawing, in the $(4+4\times m)^{th}$ raster line in the second example of the dot recording system and the $(4+4\times m)^{th}$ raster line of the first example of the dot recording system, the pixel position numbers of the pixels recorded by the pass #2, #6, #10 and #14 are switched. Specifically, the $(1+4\times n)^{th}$ and $(2+4\times n)^{th}$ dots and the $(3+4\times n)^{th}$ and $(4+4\times n)^{th}$ dots are switched. This switch can be achieved by changing the value shown by the print signal SI.

In this way, by changing the value of the print signal SI in each pass to change the pass handling the recording of each pixel position, it can be ensured that the continuous pass does not record dots of the pixels adjacent in the sub-scanning direction.

However, focusing on the pixels adjacent in a diagonal direction between the main scanning direction and the sub-scanning direction, in the second example, there exist pixels in which the recording is handled by continuous passes. Specifically, they are #4 and #5 passes and #8 and #9 passes. However, since a pixel adjacent in the diagonal direction has larger intervals of distance as compared with a pixel adjacent in the main scanning direction or a sub-scanning direction, occurrence of condensation, etc., are comparably unlikely to occur.

Figure 37:
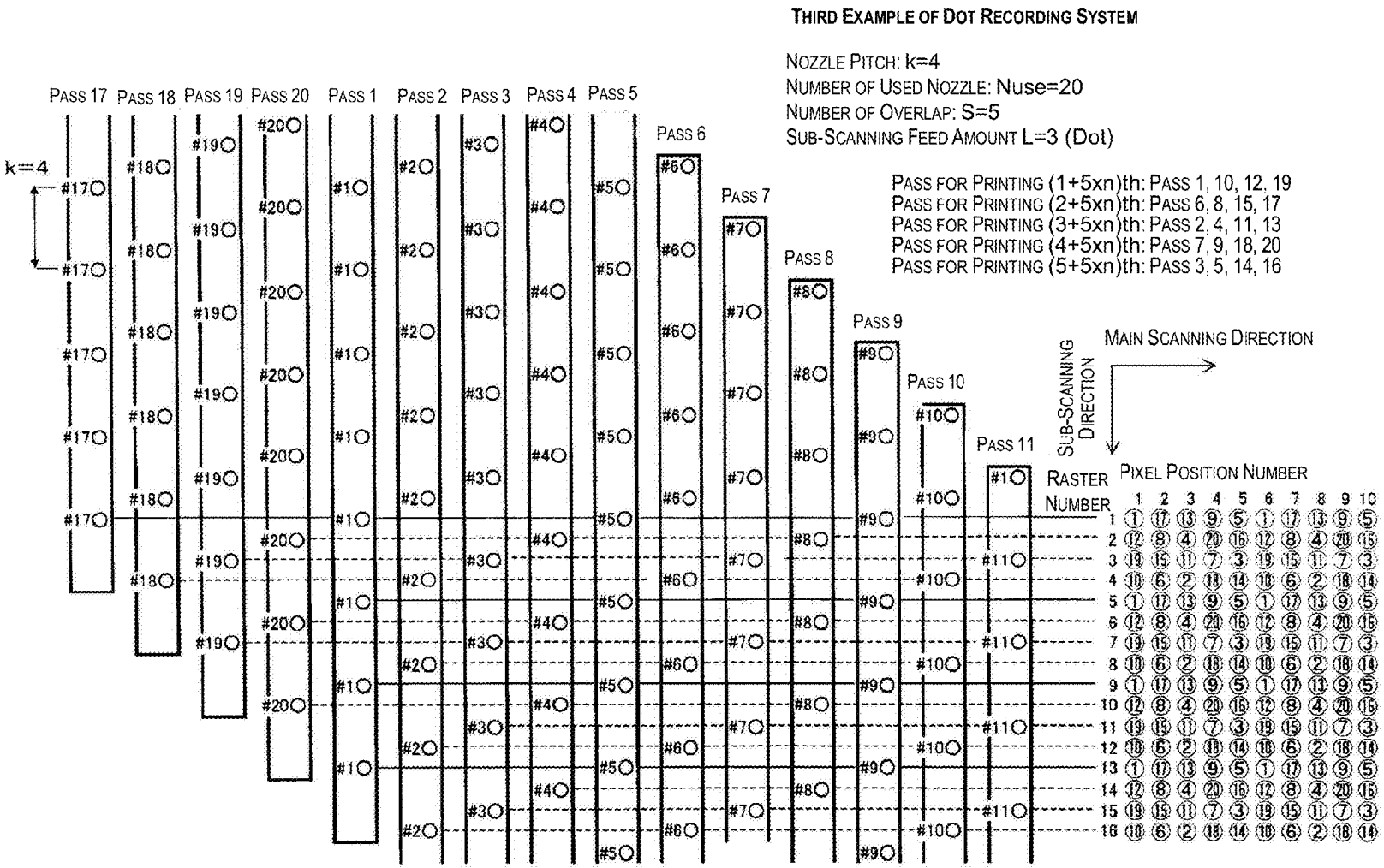
FIG. 37 is an explanatory view for explaining a third example of a dot recording system.

FIG. 37 is an explanatory drawing showing a third example of a dot recording system in the present invention. In FIG. 37, as an example of the parameters in the third example of the dot recording system, the case in which the nozzle pitch k=4, the number of used nozzles Nuse=20, the number of overlap S=5, and the sub-scanning conveyance amount L=3 is assumed. These parameters satisfy the aforementioned conditions c1a to c3a. Therefore, printing can be executed without omissions and/or unnecessary overlaps for dots to be recorded.

The difference between the dot recording system shown in FIG. 35 and the second example is that the number of overlap S is increased from "4" to "5" and the freedom of the pixel position in which each pass handles the recording thereof is increased.

FIG. 38 is an explanatory view showing the dot recording positions by each pass in the second example and the third example and the second example of the dot recording system of the present invention. In the second example of the dot recording system shown in FIG. 35, the position to be recorded by each pass could be selected from four pixel positions, but in the third example of the dot recording system, the pixel position to be recorded by each pass can be selected from five pixel positions, in which the pixel positions are (1+5×n), (2+5×n), (3+5×n), (4+5×n), and (5+5×n). As a result, in the third example of the dot recording system, for an adjacent pixel in the diagonal direction, it is possible to record so that there is no continuous recording pass.

Figure 39:
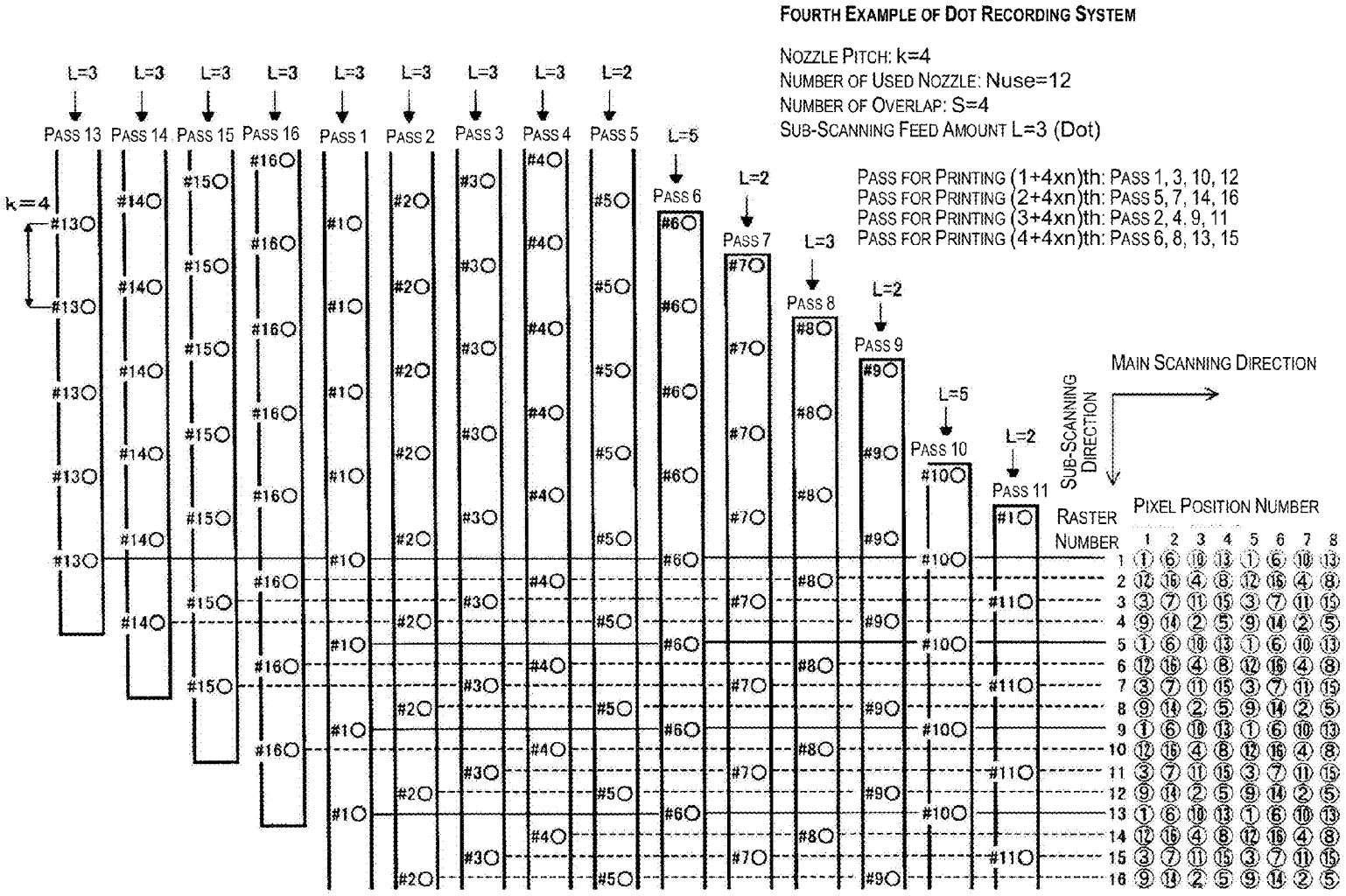
FIG. 39 is an explanatory view for explaining a fourth example of a dot recording system.

FIG. 39 is an explanatory drawing showing a fourth example of a dot recording system in the present invention. The difference between the dot recording system shown in FIG. 35 and the second example is that the sub-scanning conveyance is an irregular conveyance. In the fourth example of the dot recording system, by changing the sub-scanning conveyance from a regular conveyance to irregular conveyance, the raster lines handled by some of the passes are switched. Specifically, the pixels to be recorded between the #5 pass and #6 pass, and between #9 pass and #10 pass are switched.

FIG. 40 is an explanatory view showing dot recording positions of each pass in the second example and the fourth example of the dot recording system of the present invention. When the dot recording positions in each pass in the second example of the dot recording system and the fourth example of the dot recording system are compared, although the #5 pass records the $(1+4\times\alpha)^{th}$ raster line in the second example of the dot recording system, it records the $(4+4\times\alpha)^{th}$ raster line in the fourth example of the dot recording system. On the other hand, the #6 pass records the $(4+4\times\alpha)^{th}$ raster line in the second example of the dot recording system, it records the $(1+4\times\alpha)^{th}$ raster line in the fourth example of the dot recording system. Further, the #9 and #10 passes are similarly reversed.

The reversing of raster lines in which the recording is handled by passes can be executed by partially changing the sub-scanning conveyance amount L of each pass. Specifically, the reversing of the #5 pass and the #6 pass can be made, as shown in FIG. 39, by, for a constant sub-scanning conveyance amount L=3 in the second example of the dot recording system, in the fourth example of the dot recording system, feeding the #5 pass at a sub-scanning conveyance amount L=2, #6 pass at a sub-scanning conveyance amount L=5, and the #7 at a sub-scanning conveyance amount of L=2. The reversing of the #9 pass and the #10 pass can be executed by similarly adjusting the sub-scanning conveyance amount.

As it can be understood from the first to fourth examples of the aforementioned dot recording system, the pixel in which each pass handles the recording thereof can be changed by adjusting the content of the value shown by the print signal SI in each pass or the sub-scanning conveyance amount L of each pass. In this way, by adequately changing the pixel in which each pass handles the recording, the timing of the recording of adjacent pixels can be shifted.

The aforementioned third measure (the print speed on a fabric is especially slowed down), as described above, aims to extend the time length from when a dot is formed till when another dot adjacent to the dot is formed.

Therefore, in this embodiment, a dot recording system for recording dots so that continuously recording passes do not exist for pixels adjacent in any of the main scanning direction, the sub-scanning direction and the diagonal direction (for example, the third example or the fourth example of the dot recording system), is employed. Hereinafter, "recording dots so that continuously recording passes does not exist for pixels adjacent in any of the directions" will be referred to as "seventeenth condition." By employing a dot recording system satisfying the seventeenth condition, the third measure can be effectively carried out, which in turn can prevent occurrence of condensation and/or blurring and can control deterioration of the print image.

Further, as described above, the present invention can employ the aforementioned interlace recording system or various overlap systems.

10. Conclusion of First Embodiment

As explained above, in this embodiment, by setting the operation set information so as to satisfy the first to sixteenth conditions and employing a system satisfying the seventeenth condition as the dot recording system, the first to fourth measures are adequately carried out in each print mode. Further, the print modes not carrying out the fifth to eighth measures are inadequate print modes. Therefore, in this embodiment, print processing can be executed by a print mode employing the first to eighth measures.

Therefore, various negative effects occurring when print processing is executed on a photograph paper, a normal paper, and a fabric without carrying out these measures, such as, for example, condensation of ink, blurring of ink, occurrence of cockling phenomenon, deterioration of color reproducibility due to the permeation of color materials included in the ink, contamination of the recording medium P due to a contact with a fiber of the recording medium P and ink inside an ejection section D, contamination of the ejecting section D (nozzle N) due to adhesion of fiber of the recording medium P, etc., can be adequately controlled. With this, print processing on a recording medium such as a photograph paper, a normal paper, etc., and print processing on a fabric can be executed by one printing device 1. Therefore, for a user having a need to print on both a paper medium and a fabric, reduction of cost relating to printing and improvements in the convenience can be attained.

Furthermore, the inkjet printer 10 according to this embodiment is not required to execute various unique processing for printing on a fabric, such as, applying a blurring preventative on a fabric to prevent blurring of ink as a pretreatment to be carried out before ejecting ink, heating a fabric so as to stably adhere an ink landed on a fabric, etc., as a post-treatment to be carried out after ejecting ink on the fabric. Therefore, as compared with the case in which unique print processing is executed to print on these fabrics, the manufacturing cost of the inkjet printer 10 can be kept low.

Further, in the inkjet printer 10 according to this embodiment, it is not required to execute a post-treatment such as heating processing, etc., to volatilize the solvent component of the ink (print processing can be executed without executing such post-treatment). Therefore, to chemical fibers weak to heat such as nylon, etc., print processing can be executed without damaging the recording medium P.

Further, when printing on a fabric, conventionally, processing for applying a pretreatment agent and/or a post-treatment agent (blurring preventive), etc., for fixing an ink on a fabric, etc., is performed. However, like some chemical fibers, there exists a recording medium P in which a pre-treatment agent and/or a post-treatment agent cannot exert the function. Therefore, in these recording mediums P, even if processing for applying a pretreatment agent, a post-treatment agent, etc., is applied as conventionally carried out, it is difficult to stably fix the ink. However, in the inkjet printer 10 of this embodiment, it is possible to fix ink to a recording medium P without executing processing for applying a pretreatment agent, a post-treatment agent (blurring preventive), etc., for fixing the ink on a recording medium P. Therefore, for a recording medium P, such as a chemical fiber, in which a pretreatment agent or a post-treatment agent does not function effectively, it becomes possible to stably fix ink thereto.

Further, in the inkjet printer 10 of this embodiment, since it is not required to execute processing for applying a pre-treatment agent or a post-treatment agent (blurring preventive), etc., for fixing the ink on a recording medium P, there is no need to control the application amount of the pretreatment agent, the after-treatment agent, etc., according to the thickness or the material of the recording medium P, thereby making it possible to simplify the control of the inkjet printer 10.

B. Second Embodiment

In the aforementioned first embodiment, as shown in FIG. 10, the print mode is defined as a combination of five types of setting modes, i.e., a medium mode m, an image quality mode g, a print direction mode h, a dot type mode d, and a color mode c.

On the other hand, the second embodiment, as shown in FIG. 41, differs from the first embodiment in that, a print mode is defined as a combination of a total of six types of setting modes, i.e., a medium mode m, an image quality mode g, a print direction mode h, a dot type mode d, a color mode c, as well as a medium type mode p.

Further, the printing device according to the second embodiment is structured similarly to the printing device 1 of the first embodiment except that the types of setting modes included in the print mode and the contents of the operation set information are different from those of the printing device 1 of the first embodiment. Therefore, as for the elements of the second embodiment explained below having effects and functions equivalent to those of the first embodiment, detailed explanations will be arbitrarily omitted by using the symbols used as references in the aforementioned explanation (the same will be done for modified Embodiments which will be explained below).

FIG. 41 is an explanatory view showing each of set contents of six types of setting modes constituting a print mode according to the second embodiment.

As shown in this drawing, among the print modes of the second embodiment, the contents of the five types of setting modes excluding the medium type mode p are the same as the contents of the setting modes of the first embodiment shown in FIG. 10.

Further, as shown in FIG. 41, the medium type mode p, as a medium type mode p which can be specified when a photograph paper mode is specified, includes a photo paper mode (p=11), a luster photo paper mode (p=12), a mat photo paper mode (p=13), a coated paper mode (p=14), a luster photograph paper mode (p=15), and a silky tone luster photograph paper mode (p=16) respectively corresponding to printing on a photograph paper, a luster photo paper, a mat photo paper, a coated photo paper, a luster photograph paper, and a silky tone luster photograph paper.

Further, the medium type mode p, as a medium type mode p which can be specified when specifying a normal paper mode, includes a normal paper mode (p=21), recycled paper mode (p=22) and fine paper mode (p=23) corresponding to, respectively, a normal paper, a recycled paper, and a fine paper.

Further, the medium type mode p, as a medium type mode p which can be specified when specifying a fabric mode, includes a natural fiber mode (p=31) and a chemical fiber mode (p=32) corresponding to, respectively, printing on natural fibers and chemical fibers.

FIG. 42 is a schematic view showing a data structure of an operation set information table TBL14. The operation set information table TBL14A stores, in the same manner as the operation set information table TBL14 shown in FIG. 24, the print modes and the operation set information corresponding to the print modes in an associated manner.

In the second embodiment, the operation set information is set, among the print modes, for each combination of the medium mode m, the medium type mode p, the image quality mode g, the print direction mode h, and the dot type mode d. However, in the second embodiment, the operation set information other than the meniscus position dZ are set for each combination of the medium mode m, the image quality mode g, and the dot type mode d, similarly to the content of the first embodiment regardless of the setting content of the medium type mode p (see FIG. 24).

Further, in FIG. 42, among the operation set information, only the meniscus position dZ, the maximum dot formation ink amount W, and the number of overlap S are shown, and the other operation set information are not shown. Further, in this drawing, the combination of setting modes in which the content regarding the meniscus position dZ are the same are collectively shown for each combination of the setting modes (shown as "all" in the drawing). Also, in this drawing, the print speed U stored in the print function table TBL15 is partly shown for the convenience of explanation. Further, since the maximum dot formation ink amount W, the number of overlap S, and the print speed U are similar to FIG. 23 and FIG. 24, some of them are omitted in the drawing (denoted as "not illustrated" in the drawing).

The meniscus position dZ shown in FIG. 42 is determined by considering the aforementioned fourth measure.

As described above, the fourth measure is "to pull-in the meniscus position dZ to prevent the contamination of the recording medium P due to the contact of a fiber of the recording medium P to an ink inside the ejection section D."

To adequately carry out the fourth measure, in the first embodiment, the operation set information is set so as to satisfy the thirteenth condition. Specifically, the meniscus position dZ in a fabric mode is set to a high position dZ-H and the meniscus position dZ in a normal paper mode is set to a low position dZ-L.

However, in the case where ink is continuously ejected to a normal paper, the amount of ink to be ejected to the normal paper exceeds the ink amount absorbable by the normal paper, which in turn sometimes causes a cockling phenomenon. The possibility of occurrence of the cockling phenomenon increases as the maximum dot formation ink amount W increases. Then, when the cockling phenomenon occurs on a normal paper, as compared with the case in which no cockling phenomenon occurs, the recording medium P and the ejection section D come closer to each other. This increases the possibility that the recording medium P contacts the ink inside the ejection section D to cause contamination of the recording medium P.

However, a certain amount of time is required from the ejection of ink to the recording medium P until the occurrence of the cockling phenomenon. Therefore, even in the case in which the cockling phenomenon occurs, the possibility of contamination of the recording medium P can be kept low by increasing the print speed U.

In addition, from the view point of making the ink accurately land on a targeted position on a recording medium P, a low position dZ-L in which the distance between the meniscus position dZ and the recording medium P is close is more preferable than a high position dZ-H in which the distance between the meniscus position dZ and the recording medium P is far.

By considering the above, in the second embodiment, among print modes in which the normal paper mode is the medium mode m, in a specified print mode (hereinafter referred to as "normal paper specified print mode"), the operation set information is set so that the meniscus position dZ switches from the low position dZ-L to the high position dZ-H in the middle of a plurality of passes (the number defined by the number of overlap S) (hereinafter, this condition is referred to as "eighteenth condition").

Here, the normal paper specified print mode denotes a print mode in which the medium mode m is a normal paper mode, the maximum dot formation ink amount W is equal to or more than the threshold Wth1 (the threshold Wth1 is a positive real number), and the print speed U is equal to or less than the threshold Uth1 (the threshold Uth1 is a positive real number).

In the second embodiment, the normal paper specified print mode is a print mode in which the meniscus position dZ is shown as "dZ-L→dZ-H" in FIG. 42. More specifically, in the second embodiment, the normal paper specified print mode is a print mode in which the medium mode m is a normal paper mode, the image quality mode g is an image quality priority mode, the print direction mode h is a single direction mode, and the dot type mode d is a 4-bit mode.

Generally, as compared with the speed priority mode, the print speed U in the image quality priority mode is often slower (see the ninth condition or the twelfth condition). Further, normally, the print speed U in the single direction mode is slower than the bi-direction mode. Further, generally, as compared with a 2-bit mode, the maximum dot formation ink amount W in the 4-bit mode is often larger (see the fourth condition). In other words, in the normal paper specified print mode, a cockling phenomenon occurs in the middle of a plurality of passes and as a result, there is a high possibility that the recording medium P is contaminated.

Therefore, in the second embodiment, in the normal paper specified print mode, the meniscus position dZ is set so as to satisfy the eighteenth condition in place of the thirteenth condition. With this, even if a cockling phenomenon occurs on the recording medium P (normal paper) in the middle of a plurality of passes, the possibility that a fiber of the recording medium P contacts the ink inside the ejection section D can be kept low, and therefore the possibility that the recording medium P is contaminated can be reduced.

Further, in FIG. 42, it is presumed that the threshold Wth1 is "18 nanograms" and the threshold Uth1 is "2.0 pages/min." However, the values of the threshold Wth1 and the threshold Uth1 are examples, and these values can be arbitrarily set by considering the properties of the normal paper.

Further, the normal paper specified print mode shown in FIG. 42 is an example, and for example, all print modes in which the medium mode m is a normal paper mode and the image quality mode g is an image quality priority mode can be set as a normal paper specified print mode.

Further, in the first embodiment, although the meniscus position dZ in a fabric mode was set at a high position dZ-H so as to satisfy the thirteenth condition, as described above, from the view point of making an ink accurately land on a target position on the recording medium P, it is preferable that the meniscus position dZ is set at a low position dZ-L.

Further, since a natural fiber easily absorbs ink, fluffing of the natural fiber due to the ejection of ink drops can be controlled. In the case in which fluffing is controlled, even if the meniscus position dZ is set to a low position dZ-L, the possibility that the fibers of the recording medium P contact the ink inside the ejection section D can be kept low.

Further, more than a certain degree of the amount of ink is required to control fluffing of natural fibers, and more than a certain degree of time is required from when ink is ejected until fluffing is controlled.

Considering the above, in the second embodiment, among the print modes in which a medium mode m is a fabric mode, in a specified print mode (hereinafter referred to as "fabric specified print mode"), the operation set information is set so that the meniscus position dZ switches from a high position dZ-H to a low position dZ-L in the middle of a plurality of passes (the number defined by the number of overlap S) (hereinafter, this condition is referred to as "nineteenth condition").

Here, the fabric specified print mode is a print mode in which the medium mode m is a fabric mode, the maximum dot formation ink amount W is equal to or more than a threshold Wth2 (the threshold Wth2 is a positive real number), and the print speed U is equal to or less than the threshold Uth2 (the threshold Uth2 is a positive real number).

In the second embodiment, the fabric specified print mode is a print mode in which the meniscus position dZ is shown as "dZ-H→dZ-L" in FIG. 42. More specifically, in the second embodiment, the fabric specified print mode is a print mode in which the medium mode m is a fabric mode, the medium type mode p is a natural fiber mode, the image quality mode g is an image quality priority mode, and the dot type mode d is a 4-bit mode.

As described above, as compared with the speed priority mode, the print speed U in the image quality priority mode is often slower, and further, as compared with a 2-bit mode, the maximum dot formation ink amount W in a 4-bit mode is often larger. In other words, in the fabric specified print mode, fluffing is controlled in the middle of a plurality of passes, and as a result, the possibility that the recording medium P is contaminated is lowered. For this reason, in the fabric specified print mode, by setting the meniscus position dZ so as to satisfy the nineteenth condition in place of the thirteenth condition, the meniscus position dZ can be set to a low position dZ-L in the middle of a plurality of passes without contaminating the recording medium P, and as a result, the image quality of an image to be printed can be enhanced.

Further, in FIG. 42, it is presumed that the threshold Wth2 is "10 nanograms" and the threshold Uth2 is "1.0 pages/min." However, the values of the threshold Wth2 and the threshold Uth2 are examples, and these values can be arbitrarily set by considering the properties of a fabric (natural fiber).

Further, the fabric specified print mode shown in FIG. 42 is an example, and for example, all print modes in which the medium mode m is a fabric mode, the medium type mode p is a natural fiber mode, and the image quality mode g is an image quality priority mode, can be set as the fabric specified print mode.

As explained above, in the second embodiment, by subdividing the print modes by introducing the medium type mode p, print processing which considers more meticulously the properties of each recording medium P can be executed. In particular, in a fabric, a natural fiber and a chemical fiber are distinguished, and print processing can be executed in a manner adequate for each fiber.

In the second embodiment, since operation set information and the dot recording system are set so that the first condition to the nineteenth condition are satisfied, print processing can be executed by a print mode which carries out the first to eighth measures.

In this way, in cases where print processing on a paper medium and print processing on a fabric are executed by a single printing device 1, high quality print processing satisfying the needs of a user of the printing device 1 can be executed in each print processing.

C. Modified Embodiment

The aforementioned embodiments can be modified in various ways. The specific modifications are exemplified as follows. Two or more modifications arbitrarily selected from the following examples can be arbitrarily combined within a range in which they do not contradict each other.

Modified Embodiment 1

In the aforementioned embodiment, a print mode that can be employed in print processing (best print mode, adequate print mode, and limited adequate print mode) are limited to the print modes which adequately carry out all of the first to eighth measures, and other print modes are considered to be an "inadequate print mode," but the present invention is not limited to that. A print mode that can be employed in print processing can be a mode capable of adequately carrying out at least one of the measures among the first to eighth measures.

Similarly, although the operation set information is set so as to satisfy all of the first to seventeenth conditions in the first embodiment and to satisfy all of the first to nineteenth conditions in the second embodiment, the present invention is not limited to such embodiment. In the invention, it is enough that at least one of the conditions among those conditions is satisfied.

For example, to attain that each print mode adequately carries out at least the first measure (ink ejection amount particularly for printing on a fabric is reduced), the operation set information can be set so that at least the first condition (the maximum dot formation ink amount W in a fabric mode is reduced than the maximum dot formation ink amount W in the other medium modes m) is satisfied.

Further, for example, to attain that each print mode adequately carries out at least the second measure (the resolution is reduced when printing particularly on a fabric), the operation set information can be set so that at least the fifth condition (the resolution R in a fabric mode is reduced than the resolution R in the other medium modes m) is satisfied.

Further, for example, to attain that each print mode adequately carries out at least the third measure (the print speed is decreased when printing particularly on a fabric), the operation set information can be set so as to satisfy the fourteenth condition (the print speed U in the fabric mode is set to be slower than the print speed U in other medium modes m) by setting the operation set information so that at least either one of the eighth condition (the driving frequency F in the fabric mode is set to be lower than the driving frequency F in other medium modes m) or the eleventh condition (the number of overlap S in the fabric mode is set to be larger than the number of overlap S of other medium modes m).

Further, in this case, for example, when the operation set information is set so that the fifth condition (the resolution R in the fabric mode is set to be lower than the resolution R in other medium modes m) is satisfied, the print speed increases, causing the case in which the third measure cannot be adequately carried out. In such a case, the print mode which is not adequately carried out the third measure can be excluded from print modes that can be employed in print processing as an inadequate print mode.

Further, generally, when the driving frequency F or the number of overlap S is constant, the print speed U increases as the resolution R decreases. Therefore, considering the relationship between the print speed U and the resolution R, the third measure (the print speed is reduced when printing especially on a fabric) can be relaxed. Specifically, in cases where the resolution R in a fabric mode is lower than the resolution in other medium modes m, the driving frequency F and the number of overlap S in the print speed setting information can be set so that the print speed U in the fabric mode is faster than the print speed U in other medium modes m.

Further, as in this modified Embodiment, in the case in which the operation set information is set by considering only some conditions among the first to nineteenth conditions, the operation set information can be set without carrying out the second measure (the resolution is reduced when printing on a fabric in particular) and without considering the fifth condition (the resolution R in a fabric mode is set to be lower than the resolution R in other medium modes m). That is, the resolution R in a fabric mode can be set to be more than the resolution R in other medium modes m. However, in this case, it is preferable to carry out the third measure (the print speed is reduced when printing on a fabric in particular). Specifically, in the case in which the resolution R in a fabric mode and the resolution R in other medium modes m are the same, or in the case in which the resolution R in the fabric mode is higher than the resolution R in the other medium modes m, it is preferable that the driving frequency F and the number of overlap S of the print speed setting information are set so that the print speed U in the fabric mode is slower than the print speed U in other medium modes m.

Further, among the first to eighth measures, in the case in which one or two or more measures are selected, for example, it can be configured so that a user of the printing device 1 can select the necessary measure(s) among the first to the eighth measure on the print condition specifying screen. Similarly, among the first to the nineteenth conditions, it can be configured so that one or two or more conditions can be selected on, e.g., the print condition specifying screen.

Modified Embodiment 2

In the aforementioned embodiments and modified Embodiments, only the medium mode m among the five types of setting modes is a required specifying item on the print condition specifying screen, but the present invention is not limited to that. Among the five types of setting modes, two or more types of setting modes including at least the medium mode m can be a required specifying item.

In the case in which two or more types of the setting modes are set to be required specifying items, it is preferable that the medium mode m and the image quality mode g are set to be required specifying items. In this case, as shown in FIG. 43, in a plurality of print modes belonging to each medium mode m (40 print modes in this drawing), it is preferable that one print mode among print modes in which the image quality mode g is an image quality priority mode is set to be the best print mode, and one print mode in which the image quality mode g is a speed priority mode is set to be the best print mode. More specifically, as in the mode evaluation table TBL 13 according to this modified Embodiment shown in FIG. 43, it is enough to set such that in the photograph paper mode, the print mode having the highest print image quality (mode number: 11225) and the print mode having the fastest print speed (mode number: 12125) are set as best print modes (see FIG. 13 for the mode numbers. See FIG. 25 for the print speed), that in the normal paper, the print mode having the highest print image quality (mode number: 21222) and the print mode having the fastest print speed (mode number: 22112) are set as best print modes, and that in fabric mode, the print mode having the highest print image quality (mode number: 31224) and the print mode having the fastest print speed (mode number: 32224) can be set as best print modes.

Further, in the aforementioned embodiments and the modified Embodiments, although a user of the printing device 1 can specify five types of setting modes, i.e., the medium mode m, the image quality mode g, the print direction mode h, the dot type mode d, and the color mode c, on the print condition specifying screen. However, the present invention is not limited to that, and it can be configured such that on the print condition specifying screen, only some of the setting modes can be specified among the five types of setting modes. Further, it can be configured such that on the print condition specifying screen, the operation set information such as, the resolution R, can be specified. However, even in these cases, on the print condition specifying screen, it is preferable that at least the medium mode m can be specified, and it is more preferable that the medium mode m and the image quality mode g can be specified.

Modified Embodiment 3

In the aforementioned Embodiments and modified Embodiments, as the seventh measure, although a characteristic color mode is employed in print processing on a fabric. However, the present invention is not limited to that. It can be configured such that, for example, as shown in FIG. 43, the seventh measure is relaxed such that in the fabric mode, the color mode c can be set as a characteristic color mode, a pure black mode, or a basic color mode.

Even in this case, in print processing on a fabric, since a light color ink is not employed, a specific image quality can be secured.

Modified Embodiment 4

In the aforementioned embodiment and modified Embodiments, for example, as shown in FIG. 12, although the color mode c is set to any one of the pure black mode, the basic color mode, the light and shade color mode, the characteristic color mode, and the all color mode. However, the present invention is not limited to that, and it can be set to one or two or more color modes c among the five color modes c. For example, the color mode c can be set to any of the basic color mode, the light and shade color mode, and the characteristic color mode.

In this case, for example, as in the mode evaluation table TBL13 according to the modified Embodiment exemplified in FIG. 44, it can be configured such that when the medium mode m is a fabric mode, the print mode in which the color mode c is the characteristic color mode is set as a best print mode or an adequate color mode, and when the medium mode m is a photograph paper mode or a normal paper mode, the print mode in which the color mode c is the basic color mode or the light and shade color mode is set as a best print mode or an adequate print mode.

In this case, the number of types of ink employed in a fabric mode is more than the number of types of inks employed in a photograph paper mode and a normal paper mode.

Modified Embodiment 5

In the aforementioned Embodiments and modified Embodiments, in each print mode, the maximum dot formation ink amount W is set to be common in all ejection sections D. However, the present invention is not limited to that, and it can be configured such that in each print mode, the maximum dot formation ink amount W is different values in each nozzle array (each ejection group). In other words, in each print mode, for every type of inks ejected from the ejection section D, the maximum dot formation ink amount W is set to be different values.

In that case, for example, it can be configured such that for each ejection group, driving signal generation sections 50 is separately provided and the driving waveform signals Corn has different waveforms for each driving signal generation section 50. Specifically, it can be configured such that nine driving signal generation sections 50 are provided corresponding to nine ejection groups one-to-one, and the control section 60 outputs nine types of driving waveform signals Com corresponding to nine driving signal generation sections 50 one-to-one.

Further, for example, for each color classification of the inks ejected by the ejection section D, the driving signal generation sections 50 can be separately provided. Specifically, it can be configured such that three driving signal generation sections 50 are provided corresponding to three color classifications one-to-one, and the control section 60 outputs three types of driving waveform signals Com corresponding to three driving signal generation sections 50 one-to-one (a driving waveform signal Corn corresponding to the basic color ink, a driving waveform signal Corn corresponding to characteristic color ink, and a driving waveform signal Corn corresponding to a light color ink).

In these cases, the control section 60 creates a waveform of the driving waveform signals Corn supplied to each driving signal generation section 50 so that the ink amount of the large dot formed by the ejection section D corresponding to the driving signal generation section 50 and the maximum dot formation ink amount W corresponding to the type of ink ejected from the ejection section D become equal.

In the meantime, in the light color ink, the weight ratio of the solvent component in the ink is larger as compared with other inks. Therefore, when the maximum dot formation ink amount W of the light color ink is small, sufficient color reproducibility may not be obtained. Therefore, for example, in each print mode, the maximum dot formation ink amount W of the light color ink can be set to be more than the maximum dot formation ink amount W of the basic color ink or the characteristic color ink.

Further, in the aforementioned embodiments and modified Embodiments, the maximum dot formation ink amount W is set for each combination of the medium mode m, the image quality mode g and the dot type mode d regardless of the content of the color mode c provided. However, the present invention is not limited to that, and the maximum dot formation ink amount W can be set to different values for each color mode c.

For example, for inks of each color, the maximum dot formation ink amount W in the light and shade color mode and the all color mode can be set to be equal to or less than the maximum dot formation ink amount W in the other color modes c. In the light and shade color mode and the all color mode, since a light color ink is used, a total amount of ink used for printing may sometimes increase. Therefore, in the case of using a light color ink, by reducing the maximum dot formation ink amount W ejected from each ejection section D, it becomes possible to control occurrence of condensation due to joining of ink drops, blurring caused by mixing of inks, etc.

Further, for example, in ink of each color, the maximum dot formation ink amount W in the pure black mode and the basic color mode can be set to be equal to or more than the maximum dot formation ink amount W in the other color modes c. In the pure black mode or the basic color mode, as compared with other color modes c, the ratio of the black ink employed in print processing is increased, thereby increasing the ink duty. As a result, the ratio that the surface of the recording medium P is exposed increases. Therefore, in these cases, by increasing the maximum dot formation ink amount W, the ratio that the surface of the recording medium P is exposed can be kept low.

Further, in the case in which the maximum dot formation ink amount W is set to a different value for each type of ink, or in the case in which the maximum dot formation ink amount W is set to a different value for each color mode d, the aforementioned first condition (the maximum dot formation ink amount W in a fabric mode is set to be less than the maximum dot formation ink amount W in other medium modes m) can be satisfied for each ink in each color. More specifically, in the case of using a certain color ink that can be used in all of the medium modes m, the photograph paper mode, the normal paper mode, and the fabric mode, the aforementioned first condition can be a condition to set the maximum dot formation ink amount W for the certain color ink so that the maximum dot formation ink amount W when using the certain color ink in the fabric mode becomes less than the maximum dot formation ink amount W when using the certain color ink in the photograph paper mode or the normal paper mode.

Modified Embodiment 6

In the aforementioned Embodiments and modified Embodiments, although the inkjet printer 10 may employ a total of nine types of colors classified into three classifications of a basic color, a characteristic color, and a light color, the present invention is not limited to that, and only some of the inks among the aforementioned nine types can be used, or inks other than the nine types of ink can be used.

For example, the inkjet printer 10 can employ only a total of seven types of ink (a case not using a light color ink) of two color classifications, i.e., a basic color and a characteristic color.

Modified Embodiment 7

In the aforementioned Embodiments and modified Embodiments, the fifth measure is a measure which prohibits employment of the bi-direction mode in print processing on a fabric, but the present invention is not limited to that. It can be configured such that the requirements of the fifth measure is relaxed and the employment of the bi-direction mode is prohibited only when printing on a natural fiber among fabrics, and the employment of the bi-direction mode is allowed for printing on chemical fibers among fabrics.

As shown in FIG. 21, chemical fibers are lower in degree of surface roughness compared with natural fibers (not fluffy). Therefore, when the bi-direction mode is allowed for printing on chemical fibers, as compared with the case in which the bi-direction mode is allowed for printing on natural fibers, the possibility that the head section 30 is contaminated is low. Therefore, in this modified Embodiment, for printing on chemical fibers among fabrics, the print speed for chemical fibers is increased by allowing employment of the bi-direction mode.

Modified Embodiment 8

In the aforementioned embodiments and modified embodiments, although the print data generating section 90 is provided at the host computer 9, the present invention is not limited to such embodiments, and the print data generating section 90 may be provided at the inkjet printer 10. That is, the print data generating section 90 may be a function block which is realized by executing the printer driver program PgDR by the CPU 61 of the inkjet printer 10.

Further, in the aforementioned embodiments and modified embodiments, although the printer driver program PgDR, the plurality of print mode tables TBL, and the color conversion table LUT are stored in the storing section 103 of the host computer 9, the present invention is not limited to those embodiments, and they may be stored in the recording section 62 of the inkjet printer 10.

In these cases, although the printing device 1 is configured to include the inkjet printer 10 and the host computer 9, it may be configured to not include the host computer 9. That is, the inkjet printer 10 itself may be a printing device 1.

A print data generating section (e.g., print data generating section 90) and a print operation control section (e.g., control section 60) will be collectively referred to as a print control section. In this case, the present invention includes an embodiment in which the print control section is arranged in the host computer 9 and the inkjet printer 10 in a dispersed manner, like the aforementioned embodiments and modified embodiments, and an embodiment in which the print control section is arranged in the inkjet printer 10 in a concentrated manner like this modified embodiment.

That is, the printing device according to the present invention can be, for example, a printing device capable of forming an image on the recording medium including a paper medium and a fabric medium and including a print execution section for forming an image on the recording medium by ejecting ink on the recording medium and a print control section for controlling an operation of the print execution portion, wherein the print control section controls the print execution section so that a print resolution in the textile print mode for forming an image on the fabric medium become lower than a print resolution in the paper medium print mode for forming an image on the paper medium.

Modified Embodiment 9

In the aforementioned Embodiments and modified Embodiments, as shown in FIG. 29 and FIG. 30, for the driving waveform signal Com-A for ejecting inks from the ejection section D, the waveform in the case in which the meniscus position dZ is at a high position dZ-H and the waveform in the case in which the meniscus position dZ is at a low position dZ-L are set to be different waveforms, but the present invention is not limited to that, and the driving waveform signal Com-A can have only the waveform in the case in which the meniscus position dZ is at a low position dZ-L.

When the driving signal Vin corresponding to the driving waveform signal Com-A is supplied to the ejection section D, ink is ejected onto the recording medium P from the ejection section D. Therefore, in such a case, the negative effects due to the contact of the ink inside the ejection section D and the fibers of the recording medium P less occur, the possibility that the contact between the fibers of the recording medium P and the ink develops into contamination of the recording medium P is low.

Further, also in this modified Embodiment, for the driving waveform signal Com-B having a waveform in which ink is not ejected from the ejection section D, as shown in FIG. 29 and FIG. 30, it is preferable that it has both a waveform in the case in which the meniscus position dZ is at a high position and a waveform in the case in which the meniscus position dZ is at a low position.

Modified Embodiment 10

Figure 45:
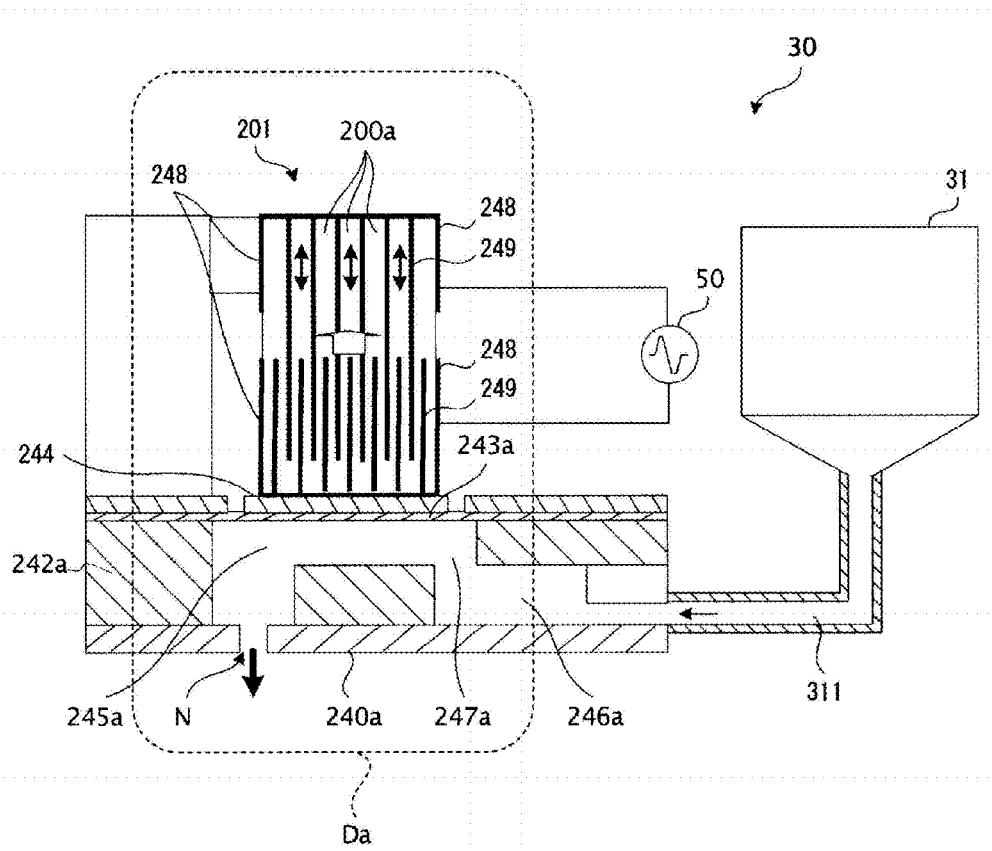
FIG. 45 is a schematic cross-sectional drawing showing a main section of a head section 30 according to a modified Embodiment 10 of the present invention.

In the aforementioned Embodiments and modified Embodiments, although the inkjet printer 10 is provided with the ejection section D and the reservoir 246 shown in FIG. 4, the present invention is not limited to that, and it can be equipped with an ejection section Da and a reservoir 246*a* shown in FIG. 45 in place of the ejection section D and the reservoir 246 shown in FIG. 4.

The ejection section Da shown in FIG. 45 is different from the ejection section D shown in FIG. 4 in that it is equipped with a multilayer piezoelectric element 201 in which a plurality of piezoelectric elements 200*a* are laminated in place of the piezoelectric element 200, and a cavity 245*a* is provided in place of the cavity 245. In the ejection section Da, the diaphragm 243 vibrates in accordance with the driving of the piezoelectric element 200*a* and the ink inside the cavity 245*a* is ejected from the nozzle N.

The cavity 245*a* of the ejection section Da is a space partitioned by a cavity plate 242*a*, a nozzle plate 240*a* to which nozzles N are formed, and a diaphragm 243*a*. The cavity 245*a* is in communication with the reservoir 246*a* via the ink supply opening 247*a*. The reservoir 246*a* is a space partitioned by the cavity plate 242*a* and the nozzle plate 240*a* and is in communication with an ink cartridge 31 via an ink intake opening 311.

In FIG. 45, the bottom end of the multilayer piezoelectric element 201 is joined to the diaphragm 243*a* via an intermediate layer 244. A plurality of external electrodes 248 and internal electrodes 249 are joined to the multilayer piezoelectric element 201. That is, on the outer surface of the multilayer piezoelectric element 201, external electrodes 248 are joined, and between each piezoelectric elements 200 constituting the multilayer piezoelectric element 201 (or inside each piezoelectric element 200*a*), internal electrodes 249 are provided. More specifically, the external electrodes 248 and the internal electrodes 249 are arranged so that some of them alternately overlap in the thickness direction of the piezoelectric element 200*a*.

Between the external 248 and the internal electrode 249, by supplying the driving signal Vin from the driving signal generation section 50, the multilayer piezoelectric element 201 deforms (expands and contracts in the up and down direction of FIG. 45) and vibrates as shown by the arrows in FIG. 45, and the vibration causes vibration of the diaphragm 243*a*. The volume of the cavity 245*a* (the pressure inside the cavity 245*a*) changes by the vibration of the diaphragm 243*a* and the ink filled inside the cavity 245*a* is ejected from the nozzle N. When the ink amount inside the cavity 245*a* is reduced by the ejection of ink, ink is supplied from the reservoir 246*a*. Further, ink is supplied to the reservoir 246*a* from the ink cartridge 31 via the ink intake opening 311.

Modified Embodiment 11

In the aforementioned embodiments or modified Embodiments, the driving waveform signal Com includes two signals, i.e., Com-A and Com-B, but the present invention is not limited to that, and the driving waveform signal Com can be constituted by one signal (for example, only by Com-A) or an arbitral number of signals of 3 or more. Further, the number of bits for the print signal SI is not limited to 1 bit or 2 bits, and can be arbitrarily determined from the gradations to be displayed and the number of signals included in the driving waveform signal Corn.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A printing device comprising:

a paper medium print mode configured to execute printing on a paper medium; and a textile print mode configured to execute printing on a fabric medium, a maximum value of a print resolution in the textile print mode being lower than a minimum value of a print resolution in the paper medium print mode.

2. The printing device according to claim 1, wherein a print resolution in a main scanning direction in the textile print mode is lower than a print resolution in the main scanning direction in the paper medium print mode.

3. The printing device according to claim 2, wherein a print speed in the textile print mode is slower than a print speed in the paper medium print mode.

4. The printing device according to claim 2, wherein types of inks used in the textile print mode are greater in number than types of inks used in the paper medium print mode.

5. The printing device according to claim 2, wherein a weight ratio of a solvent included in an ink not used in the textile print mode but used in the paper medium print mode to a whole ink is larger than a weight ratio of a solvent contained in an ink used in the textile print mode and the paper medium print mode to a whole ink.

6. The printing device according to claim 1, wherein a print resolution in a sub-scanning direction in the textile print mode is lower than a print resolution in the sub-scanning direction in the paper medium print mode.

7. The printing device according to claim 1, wherein an ink weight required for forming a maximum dot in the textile print mode is smaller than an ink weight required for forming a maximum dot in the paper medium print mode.

8. The printing device according to claim 1, wherein a distance between a meniscus position of a nozzle ejecting ink in the textile print mode and the fabric medium is longer than a distance between a meniscus position of a nozzle ejecting ink in the paper medium print mode and the paper medium.

9. A control method for a printing device, comprising:

executing printing on a paper medium in a paper medium print mode; and executing printing on a fabric medium in a textile print mode, a maximum value of a print resolution in the textile print mode being lower than a minimum value of a print resolution in the paper medium print mode.

10. A non-transitory computer readable medium storing a control program for a printing device with a computer, the control program comprising:

a paper medium print mode configured to execute printing on a paper medium; and a textile print mode configured to execute printing on a fabric medium, the control program causing the computer to execute printing in which a maximum value of a print resolution in the textile print mode is lower than a minimum value of a print resolution in the paper medium print mode.

* * * * *